US007419009B2

(12) United States Patent
Cook et al.

(10) Patent No.: US 7,419,009 B2
(45) Date of Patent: Sep. 2, 2008

(54) APPARATUS FOR RADIALLY EXPANDING AND PLASTICALLY DEFORMING A TUBULAR MEMBER

(75) Inventors: Robert Lance Cook, Katy, TX (US); David Paul Brisco, Duncan, OK (US); R. Bruce Stewart, The Hague (NL); Lev Ring, Houston, TX (US); Richard Carl Haut, Sugar Land, TX (US); Robert Donald Mack, Katy, TX (US)

(73) Assignee: Shell Oil Company, Houston, TX (US)

( * ) Notice: Subject to any disclaimer, the term of this patent is extended or adjusted under 35 U.S.C. 154(b) by 537 days.

(21) Appl. No.: 11/084,788

(22) Filed: Mar. 18, 2005

(65) Prior Publication Data

US 2005/0161228 A1 Jul. 28, 2005

Related U.S. Application Data

(63) Continuation-in-part of application No. 10/418,687, filed on Apr. 18, 2003, now Pat. No. 7,021,390.

(51) Int. Cl.
*E21B 23/01* (2006.01)
*E21B 19/16* (2006.01)

(52) U.S. Cl. ..... 166/382; 166/380; 166/384; 166/207; 166/208

(58) Field of Classification Search ..... None
See application file for complete search history.

(56) References Cited

U.S. PATENT DOCUMENTS

| | | | |
|---|---|---|---|
| 46,818 | A | 3/1865 | Patterson |
| 331,940 | A | 12/1885 | Bole |
| 332,184 | A | 12/1885 | Bole |
| 341,237 | A | 5/1886 | Healey |
| 519,805 | A | 5/1894 | Bavier |
| 802,880 | A | 10/1905 | Phillips, Jr. |
| 806,156 | A | 12/1905 | Marshall |
| 958,517 | A | 5/1910 | Mettler |
| 984,449 | A | 2/1911 | Stewart |
| 1,166,040 | A | 12/1915 | Burlingham |
| 1,233,888 | A | 7/1917 | Leonard |
| 1,494,128 | A | 5/1924 | Primrose |
| 1,589,781 | A | 6/1926 | Anderson |
| 1,590,357 | A | 6/1926 | Feisthamel |

(Continued)

FOREIGN PATENT DOCUMENTS

| | | |
|---|---|---|
| AU | 767364 | 2/2004 |

(Continued)

OTHER PUBLICATIONS

Halliburton Energy Services, "Halliburton Completion Products" 1996, Page Packers 5-37, United States of America.

(Continued)

*Primary Examiner*—Zakiya W. Bates
(74) *Attorney, Agent, or Firm*—Todd Mattingly; King & Spalding, LLP

(57) ABSTRACT

An apparatus and method according to which a tubular member is radially expanded and plastically deformed.

80 Claims, 43 Drawing Sheets

U.S. PATENT DOCUMENTS

| | | | |
|---|---|---|---|
| 1,597,212 | A | 8/1926 | Spengler |
| 1,613,461 | A | 1/1927 | Johnson |
| 1,756,531 | A | 4/1930 | Aldeen et al. |
| 1,880,218 | A | 10/1932 | Simmons |
| 1,981,525 | A | 11/1934 | Price |
| 2,046,870 | A | 7/1936 | Clasen et al. |
| 2,087,185 | A | 7/1937 | Dillom |
| 2,122,757 | A | 7/1938 | Scott |
| 2,145,168 | A | 1/1939 | Flagg |
| 2,160,263 | A | 5/1939 | Fletcher |
| 2,187,275 | A | 1/1940 | McLennan |
| 2,204,586 | A | 6/1940 | Grau |
| 2,211,173 | A | 8/1940 | Shaffer |
| 2,214,226 | A | 9/1940 | English |
| 2,226,804 | A | 12/1940 | Carroll |
| 2,246,038 | A | 6/1941 | Graham |
| 2,273,017 | A | 2/1942 | Boynton |
| 2,301,495 | A | 11/1942 | Abegg |
| 2,305,282 | A | 12/1942 | Taylor, Jr. et al. |
| 2,371,840 | A | 3/1945 | Otis |
| 2,383,214 | A | 8/1945 | Prout |
| 2,447,629 | A | 8/1948 | Beissinger et al. |
| 2,500,276 | A | 3/1950 | Church |
| 2,546,295 | A | 3/1951 | Boice |
| 2,583,316 | A | 1/1952 | Bannister |
| 2,609,258 | A | 11/1952 | Taylor, Jr. et al. |
| 2,627,891 | A | 2/1953 | Clark |
| 2,647,847 | A | 8/1953 | Black et al. |
| 2,664,952 | A | 1/1954 | Losey |
| 2,691,418 | A | 10/1954 | Connolly |
| 2,723,721 | A | 11/1955 | Corsette |
| 2,734,580 | A | 2/1956 | Layne |
| 2,796,134 | A | 6/1957 | Binkley |
| 2,812,025 | A | 11/1957 | Teague et al. |
| 2,877,822 | A | 3/1959 | Buck |
| 2,907,589 | A | 10/1959 | Knox |
| 2,919,741 | A | 1/1960 | Strock et al. |
| 2,929,741 | A | 1/1960 | Strock et al. |
| 3,015,362 | A | 1/1962 | Moosman |
| 3,015,500 | A | 1/1962 | Barnett |
| 3,018,547 | A | 1/1962 | Marskell |
| 3,039,530 | A | 6/1962 | Condra |
| 3,067,801 | A | 12/1962 | Sortor |
| 3,067,819 | A | 12/1962 | Gore |
| 3,068,563 | A | 12/1962 | Reverman |
| 3,104,703 | A | 9/1963 | Rike et al. |
| 3,111,991 | A | 11/1963 | O'Neal |
| 3,162,245 | A | 12/1964 | Howard et al. |
| 3,167,122 | A | 1/1965 | Lang |
| 3,175,618 | A | 3/1965 | Lang et al. |
| 3,179,168 | A | 4/1965 | Vincent |
| 3,188,816 | A | 6/1965 | Koch |
| 3,191,677 | A | 6/1965 | Kinley |
| 3,191,680 | A | 6/1965 | Vincent |
| 3,203,451 | A | 8/1965 | Vincent |
| 3,203,483 | A | 8/1965 | Vincent |
| 3,209,546 | A | 10/1965 | Lawton |
| 3,210,102 | A | 10/1965 | Joslin |
| 3,233,315 | A | 2/1966 | Levake |
| 3,245,471 | A | 4/1966 | Howard |
| 3,270,817 | A | 9/1966 | Papaila |
| 3,297,092 | A | 1/1967 | Jennings |
| 3,326,293 | A | 6/1967 | Skipper |
| 3,343,252 | A | 9/1967 | Reesor |
| 3,353,599 | A | 11/1967 | Swift |
| 3,354,955 | A | 11/1967 | Berry |
| 3,358,760 | A | 12/1967 | Blagg |
| 3,358,769 | A | 12/1967 | Berry |
| 3,364,993 | A | 1/1968 | Skipper |
| 3,371,717 | A | 3/1968 | Chenoweth |
| 3,397,745 | A | 8/1968 | Owens et al. |
| 3,412,565 | A | 11/1968 | Lindsey et al. |
| 3,419,080 | A | 12/1968 | Lebourg |
| 3,422,902 | A | 1/1969 | Bouchillon |
| 3,424,244 | A | 1/1969 | Kinley |
| 3,427,707 | A | 2/1969 | Nowosadko |
| 3,463,228 | A | 8/1969 | Heam |
| 3,477,506 | A | 11/1969 | Malone |
| 3,489,220 | A | 1/1970 | Kinley |
| 3,489,437 | A | 1/1970 | Duret |
| 3,498,376 | A | 3/1970 | Sizer et al. |
| 3,504,515 | A | 4/1970 | Reardon |
| 3,508,771 | A | 4/1970 | Duret |
| 3,520,049 | A | 7/1970 | Lysenko et al. |
| 3,528,498 | A | 9/1970 | Carothers |
| 3,532,174 | A | 10/1970 | Diamantides et al. |
| 3,568,773 | A | 3/1971 | Chancellor |
| 3,572,777 | A | 3/1971 | Blose et al. |
| 3,574,357 | A | 4/1971 | Alexandru et al. |
| 3,578,081 | A | 5/1971 | Bodine |
| 3,579,805 | A | 5/1971 | Kast |
| 3,581,817 | A | 6/1971 | Kammerer, Jr. |
| 3,605,887 | A | 9/1971 | Lambie |
| 3,631,926 | A | 1/1972 | Young |
| 3,665,591 | A | 5/1972 | Kowal |
| 3,667,547 | A | 6/1972 | Ahlstone |
| 3,669,190 | A | 6/1972 | Sizer et al. |
| 3,678,727 | A | 7/1972 | Jackson |
| 3,682,256 | A | 8/1972 | Stuart |
| 3,687,196 | A | 8/1972 | Mullins |
| 3,691,624 | A | 9/1972 | Kinley |
| 3,693,717 | A | 9/1972 | Wuenschel |
| 3,704,730 | A | 12/1972 | Witzig |
| 3,709,306 | A | 1/1973 | Curington |
| 3,711,123 | A | 1/1973 | Arnold |
| 3,712,376 | A | 1/1973 | Owen et al. |
| 3,746,068 | A | 7/1973 | Deckert et al. |
| 3,746,091 | A | 7/1973 | Owen et al. |
| 3,746,092 | A | 7/1973 | Land |
| 3,764,168 | A | 10/1973 | Kisling, III et al. |
| 3,776,307 | A | 12/1973 | Young |
| 3,779,025 | A | 12/1973 | Godley et al. |
| 3,780,562 | A | 12/1973 | Kinley |
| 3,781,966 | A | 1/1974 | Lieberman |
| 3,785,193 | A | 1/1974 | Kinely et al. |
| 3,797,259 | A | 3/1974 | Kammerer, Jr. |
| 3,805,567 | A | 4/1974 | Agius-Sincero |
| 3,812,912 | A | 5/1974 | Wuenschel |
| 3,818,734 | A | 6/1974 | Bateman |
| 3,826,124 | A | 7/1974 | Baksay |
| 3,830,294 | A | 8/1974 | Swanson |
| 3,830,295 | A | 8/1974 | Crowe |
| 3,834,742 | A | 9/1974 | McPhillips |
| 3,848,668 | A | 11/1974 | Sizer et al. |
| 3,866,954 | A | 2/1975 | Slator et al. |
| 3,874,446 | A | 4/1975 | Crowe |
| 3,885,298 | A | 5/1975 | Pogonowski |
| 3,887,006 | A | 6/1975 | Pitts |
| 3,893,718 | A | 7/1975 | Powell |
| 3,898,163 | A | 8/1975 | Mott |
| 3,915,478 | A | 10/1975 | Al et al. |
| 3,915,763 | A | 10/1975 | Jennings et al. |
| 3,935,910 | A | 2/1976 | Gaudy et al. |
| 3,942,824 | A | 3/1976 | Sable |
| 3,945,444 | A | 3/1976 | Knudson |
| 3,948,321 | A | 4/1976 | Owen et al. |
| 3,963,076 | A | 6/1976 | Winslow |
| 3,970,336 | A | 7/1976 | O'Sickey et al. |
| 3,977,473 | A | 8/1976 | Page, Jr. |
| 3,989,280 | A | 11/1976 | Schwarz |
| 3,997,193 | A | 12/1976 | Tsuda et al. |
| 3,999,605 | A | 12/1976 | Braddick |
| 4,011,652 | A | 3/1977 | Black |
| 4,018,634 | A | 4/1977 | Fenci |

4,019,579 A 4/1977 Thuse
4,026,583 A 5/1977 Gottlieb
4,053,247 A 10/1977 Marsh, Jr.
4,069,573 A 1/1978 Rogers, Jr. et al.
4,076,287 A 2/1978 Bill et al.
4,096,913 A 6/1978 Kenneday et al.
4,098,334 A 7/1978 Crowe
4,099,563 A 7/1978 Hutchinson et al.
4,125,937 A 11/1978 Brown et al.
4,152,821 A 5/1979 Scott
4,168,747 A 9/1979 Youmans
4,190,108 A 2/1980 Webber
4,204,312 A 5/1980 Tooker
4,205,422 A 6/1980 Hardwick
4,226,449 A 10/1980 Cole
4,253,687 A 3/1981 Maples
4,257,155 A 3/1981 Hunter
4,274,665 A 6/1981 Marsh, Jr.
RE30,802 E 11/1981 Rogers, Jr.
4,304,428 A 12/1981 Grigorian et al.
4,328,983 A 5/1982 Gibson
4,355,664 A 10/1982 Cook et al.
4,358,511 A 11/1982 Smith, Jr. et al.
4,359,889 A 11/1982 Kelly
4,363,358 A 12/1982 Ellis
4,366,971 A 1/1983 Lula
4,368,571 A 1/1983 Cooper, Jr.
4,379,471 A 4/1983 Kuenzel
4,380,347 A 4/1983 Sable
4,384,625 A 5/1983 Roper et al.
4,388,752 A 6/1983 Vinciguerra et al.
4,391,325 A 7/1983 Baker et al.
4,393,931 A 7/1983 Muse et al.
4,396,061 A 8/1983 Tamplen et al.
4,397,484 A 8/1983 Miller
4,401,325 A 8/1983 Tsuchiya et al.
4,402,372 A 9/1983 Cherrington
4,407,681 A 10/1983 Ina et al.
4,411,435 A 10/1983 McStravick
4,413,395 A 11/1983 Garnier
4,413,682 A 11/1983 Callihan et al.
4,420,866 A 12/1983 Mueller
4,421,169 A 12/1983 Dearth et al.
4,422,317 A 12/1983 Mueller
4,422,507 A 12/1983 Reimert
4,423,889 A 1/1984 Weise
4,423,986 A 1/1984 Skogberg
4,424,865 A 1/1984 Payton, Jr.
4,429,741 A 2/1984 Hyland
4,440,233 A 4/1984 Baugh et al.
4,442,586 A 4/1984 Ridenour
4,444,250 A 4/1984 Keithahn et al.
4,449,713 A 5/1984 Ishido et al.
4,458,925 A 7/1984 Raulins et al.
4,462,471 A 7/1984 Hipp
4,467,630 A 8/1984 Kelly
4,468,309 A 8/1984 White
4,469,356 A 9/1984 Duret et al.
4,473,245 A 9/1984 Raulins et al.
4,483,399 A 11/1984 Colgate
4,485,847 A 12/1984 Wentzell
4,491,001 A 1/1985 Yoshida
4,495,073 A 1/1985 Beimgraben
4,501,327 A 2/1985 Retz
4,505,017 A 3/1985 Schukei
4,505,987 A 3/1985 Yamada et al.
4,506,432 A 3/1985 Smith
4,507,019 A 3/1985 Thompson
4,508,129 A 4/1985 Brown
4,508,167 A 4/1985 Weinberg et al.
4,511,289 A 4/1985 Herron
4,513,995 A 4/1985 Niehaus et al.
4,519,456 A 5/1985 Cochran
4,521,258 A 6/1985 Tamehiro et al.
4,526,232 A 7/1985 Hughson et al.
4,526,839 A 7/1985 Herman et al.
4,527,815 A 7/1985 Frick
4,530,231 A 7/1985 Main
4,531,552 A 7/1985 Kim
4,537,429 A 8/1985 Lanriault
4,538,442 A 9/1985 Reed
4,538,840 A 9/1985 DeLange
4,541,655 A 9/1985 Hunter
4,550,782 A 11/1985 Lawson
4,550,937 A 11/1985 Duret
4,553,776 A 11/1985 Dodd
4,573,248 A 3/1986 Hackett
4,576,386 A 3/1986 Benson et al.
4,581,817 A 4/1986 Kelly
4,582,348 A 4/1986 Dearden et al.
4,590,227 A 5/1986 Nakamura et al.
4,590,995 A 5/1986 Evans
4,592,577 A 6/1986 Ayres et al.
4,595,063 A 6/1986 Jennings et al.
4,596,913 A 6/1986 Takechi
4,598,938 A 7/1986 Boss et al.
4,601,343 A 7/1986 Lindsey, Jr. et al.
4,603,889 A 8/1986 Welsh
4,605,063 A 8/1986 Ross
4,611,662 A 9/1986 Harrington
4,614,233 A 9/1986 Menard
4,629,218 A 12/1986 Dubois
4,629,224 A 12/1986 Landriault
4,630,849 A 12/1986 Fukui et al.
4,632,944 A 12/1986 Thompson
4,634,317 A 1/1987 Skogberg et al.
4,635,333 A 1/1987 Finch
4,637,436 A 1/1987 Stewart, Jr. et al.
4,646,787 A 3/1987 Rush et al.
4,649,492 A 3/1987 Sinha et al.
4,651,831 A 3/1987 Baugh et al.
4,651,836 A 3/1987 Richards
4,656,779 A 4/1987 Fedeli
4,660,863 A 4/1987 Bailey et al.
4,662,446 A 5/1987 Brisco et al.
4,669,541 A 6/1987 Bissonnette
4,674,572 A 6/1987 Gallus
4,676,563 A 6/1987 Curlett et al.
4,682,797 A 7/1987 Hildner
4,685,191 A 8/1987 Mueller et al.
4,685,834 A 8/1987 Jordan
4,693,498 A 9/1987 Baugh et al.
4,711,474 A 12/1987 Patrick
4,714,117 A 12/1987 Dech
4,730,851 A 3/1988 Watts
4,732,416 A 3/1988 Dearden et al.
4,735,444 A 4/1988 Skipper
4,739,654 A 4/1988 Pilkington et al.
4,739,916 A 4/1988 Ayres et al.
4,754,781 A 7/1988 Putter
4,758,025 A 7/1988 Frick
4,762,344 A 8/1988 Perkins et al.
4,776,394 A 10/1988 Lynde et al.
4,778,088 A 10/1988 Miller
4,779,445 A 10/1988 Rabe
4,793,382 A 12/1988 Szalvay
4,796,668 A 1/1989 Depret
4,799,544 A 1/1989 Curlett
4,817,710 A 4/1989 Edwards et al.
4,817,712 A 4/1989 Bodine
4,817,716 A 4/1989 Taylor et al.
4,822,081 A 4/1989 Blose
4,825,674 A 5/1989 Tanaka et al.
4,826,347 A 5/1989 Baril et al.
4,827,594 A 5/1989 Cartry et al.
4,828,033 A 5/1989 Frison 4,830,109 A 5/1989 Wedel
4,832,382 A 5/1989 Kapgan
4,836,278 A 6/1989 Stone et al.
4,836,579 A 6/1989 Wester et al.
4,838,349 A 6/1989 Berzin
4,842,082 A 6/1989 Springer
4,848,459 A 7/1989 Blackwell et al.
4,854,338 A 8/1989 Grantham
4,856,592 A 8/1989 Van Bilderbeek et al.
4,865,127 A 9/1989 Koster
4,871,199 A 10/1989 Ridenour et al.
4,872,253 A 10/1989 Carstensen
4,887,646 A 12/1989 Groves
4,888,975 A 12/1989 Soward et al.
4,892,337 A 1/1990 Gunderson et al.
4,893,658 A 1/1990 Kimura et al.
4,904,136 A 2/1990 Matsumoto
4,907,828 A 3/1990 Change
4,911,237 A 3/1990 Melenyzer
4,913,758 A 4/1990 Koster
4,915,177 A 4/1990 Claycomb
4,915,426 A 4/1990 Skipper
4,917,409 A 4/1990 Reeves
4,919,989 A 4/1990 Colangelo
4,921,045 A 5/1990 Richardson
4,924,949 A 5/1990 Curlett
4,930,573 A 6/1990 Lane et al.
4,934,038 A 6/1990 Caudill
4,934,312 A 6/1990 Koster et al.
4,938,291 A 7/1990 Lynde et al.
4,941,512 A 7/1990 McParland
4,941,532 A 7/1990 Hurt et al.
4,942,925 A 7/1990 Themig
4,942,926 A 7/1990 Lessi
4,958,691 A 9/1990 Hipp
4,968,184 A 11/1990 Reid
4,971,152 A 11/1990 Koster et al.
4,976,322 A 12/1990 Abdrakhmanov et al.
4,981,250 A 1/1991 Persson
4,995,464 A 2/1991 Watkins et al.
5,014,779 A 5/1991 Meling et al.
5,015,017 A 5/1991 Geary
5,026,074 A 6/1991 Hoes et al.
5,031,370 A 7/1991 Jewett
5,031,699 A 7/1991 Artynov et al.
5,040,283 A 8/1991 Pelgrom
5,044,676 A 9/1991 Burton et al.
5,048,871 A 9/1991 Pfeiffer et al.
5,052,483 A 10/1991 Hudson
5,059,043 A 10/1991 Kuhne
5,064,004 A 11/1991 Lundel
5,079,837 A 1/1992 Vanselow
5,083,608 A 1/1992 Abdrakhmanov et al.
5,093,015 A 3/1992 Oldiges
5,095,991 A 3/1992 Milberger
5,097,710 A 3/1992 Palynchuk
5,101,653 A 4/1992 Hermes et al.
5,105,888 A 4/1992 Pollock et al.
5,107,221 A 4/1992 N'Guyen et al.
5,119,661 A 6/1992 Abdrakhmanov et al.
5,134,891 A 8/1992 Canevet
5,150,755 A 9/1992 Cassel et al.
5,156,043 A 10/1992 Ose
5,156,213 A 10/1992 George et al.
5,156,223 A 10/1992 Hipp
5,174,340 A 12/1992 Peterson et al.
5,174,376 A 12/1992 Singeetham
5,181,571 A 1/1993 Mueller et al.
5,195,583 A 3/1993 Toon et al.
5,197,553 A 3/1993 Leturno
5,209,600 A 5/1993 Koster
5,226,492 A 7/1993 Solaeche P. et al.
5,242,017 A 9/1993 Hailey
5,249,628 A 10/1993 Surjaatmadia
5,253,713 A 10/1993 Gregg et al.
RE34,467 E 12/1993 Reeves
5,275,242 A 1/1994 Payne
5,282,508 A 2/1994 Ellingsen et al.
5,286,393 A 2/1994 Oldiges et al.
5,306,101 A 4/1994 Rockower et al.
5,309,621 A 5/1994 O'Donnell et al.
5,314,014 A 5/1994 Tucker
5,314,209 A 5/1994 Kuhne
5,318,122 A 6/1994 Murray et al.
5,318,131 A 6/1994 Baker
5,325,923 A 7/1994 Surjaatmadja et al.
5,326,137 A 7/1994 Lorenz et al.
5,327,964 A 7/1994 O'Donnell et al.
5,330,850 A 7/1994 Suzuki et al.
5,332,038 A 7/1994 Tapp et al.
5,332,049 A 7/1994 Tew
5,333,692 A 8/1994 Baugh et al.
5,335,736 A 8/1994 Windsor
5,337,808 A 8/1994 Graham
5,337,823 A 8/1994 Nobileau
5,337,827 A 8/1994 Hromas et al.
5,339,894 A 8/1994 Stotler
5,343,949 A 9/1994 Ross et al.
5,346,007 A 9/1994 Dillon et al.
5,348,087 A 9/1994 Williamson, Jr.
5,348,093 A 9/1994 Wood et al.
5,348,095 A 9/1994 Worrall et al.
5,348,668 A 9/1994 Oldiges et al.
5,351,752 A 10/1994 Wood et al.
5,360,239 A 11/1994 Klementich
5,360,292 A 11/1994 Allen et al.
5,361,836 A 11/1994 Sorem et al.
5,361,843 A 11/1994 Shy et al.
5,366,010 A 11/1994 Zwart
5,366,012 A 11/1994 Lohbeck
5,368,075 A 11/1994 Bäro et al.
5,370,425 A 12/1994 Dougherty et al.
5,375,661 A 12/1994 Daneshy et al.
5,388,648 A 2/1995 Jordan, Jr.
5,390,735 A 2/1995 Williamson, Jr.
5,390,742 A 2/1995 Dines et al.
5,396,957 A 3/1995 Surjaatmadja et al.
5,400,827 A 3/1995 Baro et al.
5,405,171 A 4/1995 Allen et al.
5,411,301 A 5/1995 Moyer et al.
5,413,180 A 5/1995 Ross et al.
5,425,559 A 6/1995 Nobileau
5,426,130 A 6/1995 Thurder et al.
5,431,831 A 7/1995 Vincent
5,435,395 A 7/1995 Connell
5,439,320 A 8/1995 Abrams
5,443,129 A 8/1995 Bailey et al.
5,447,201 A 9/1995 Mohn
5,454,419 A 10/1995 Vloedman
5,456,319 A 10/1995 Schmidt et al.
5,458,194 A 10/1995 Brooks
5,462,120 A 10/1995 Gondouin
5,467,822 A 11/1995 Zwart
5,472,055 A 12/1995 Simson et al.
5,474,334 A 12/1995 Eppink
5,492,173 A 2/1996 Kilgore et al.
5,494,106 A 2/1996 Gueguen et al.
5,507,343 A 4/1996 Carlton et al.
5,511,620 A 4/1996 Baugh et al.
5,524,937 A 6/1996 Sides, III et al.
5,535,824 A 7/1996 Hudson
5,536,422 A 7/1996 Oldiges et al.
5,540,281 A 7/1996 Round
5,554,244 A 9/1996 Ruggles et al.
5,566,772 A 10/1996 Coone et al.
5,567,335 A 10/1996 Baessler et al.

5,576,485 A 11/1996 Serata
5,584,512 A 12/1996 Carstensen
5,606,792 A 3/1997 Schafer
5,611,399 A 3/1997 Richard et al.
5,613,557 A 3/1997 Blount et al.
5,617,918 A 4/1997 Cooksey et al.
5,642,560 A 7/1997 Tabuchi et al.
5,642,781 A 7/1997 Richard
5,662,180 A 9/1997 Coffman et al.
5,664,327 A 9/1997 Swars
5,667,011 A 9/1997 Gill et al.
5,667,252 A 9/1997 Schafer et al.
5,678,609 A 10/1997 Washburn
5,685,369 A 11/1997 Ellis et al.
5,689,871 A 11/1997 Carstensen
5,695,008 A 12/1997 Bertet et al.
5,695,009 A 12/1997 Hipp
5,697,442 A 12/1997 Baldridge
5,697,449 A 12/1997 Hennig et al.
5,718,288 A 2/1998 Bertet et al.
5,738,146 A 4/1998 Abe
5,743,335 A 4/1998 Bussear
5,749,419 A 5/1998 Coronado et al.
5,749,585 A 5/1998 Lembcke
5,755,895 A 5/1998 Tamehiro et al.
5,775,422 A 7/1998 Wong et al.
5,785,120 A 7/1998 Smalley et al.
5,787,933 A 8/1998 Russ et al.
5,791,419 A 8/1998 Valisalo
5,794,702 A 8/1998 Nobileau
5,797,454 A 8/1998 Hipp
5,829,520 A 11/1998 Johnson
5,829,524 A 11/1998 Flanders et al.
5,829,797 A 11/1998 Yamamoto et al.
5,833,001 A 11/1998 Song et al.
5,845,945 A 12/1998 Carstensen
5,849,188 A 12/1998 Voll et al.
5,857,524 A 1/1999 Harris
5,862,866 A 1/1999 Springer
5,875,851 A 3/1999 Vick, Jr. et al.
5,885,941 A 3/1999 Sateva et al.
5,895,079 A 4/1999 Carstensen et al.
5,901,789 A 5/1999 Donnelly et al.
5,918,677 A 7/1999 Head
5,924,745 A 7/1999 Campbell
5,931,511 A 8/1999 DeLange et al.
5,933,945 A 8/1999 Thomeer et al.
5,944,100 A 8/1999 Hipp
5,944,107 A 8/1999 Ohmer
5,944,108 A 8/1999 Baugh et al.
5,951,207 A 9/1999 Chen
5,957,195 A 9/1999 Bailey et al.
5,964,288 A 10/1999 Leighton et al.
5,971,443 A 10/1999 Noel et al.
5,975,587 A 11/1999 Wood et al.
5,979,560 A 11/1999 Nobileau
5,984,369 A 11/1999 Crook et al.
5,984,568 A 11/1999 Lohbeck
6,009,611 A 1/2000 Adams et al.
6,012,521 A 1/2000 Zunkel et al.
6,012,522 A 1/2000 Donnelly et al.
6,012,523 A 1/2000 Campbell et al.
6,012,874 A 1/2000 Groneck et al.
6,015,012 A 1/2000 Reddick
6,017,168 A 1/2000 Fraser et al.
6,021,850 A 2/2000 Woo et al.
6,024,181 A 2/2000 Richardson et al.
6,027,145 A 2/2000 Tsuru et al.
6,029,748 A 2/2000 Forsyth et al.
6,035,954 A 3/2000 Hipp
6,044,906 A 4/2000 Saltel
6,047,505 A 4/2000 Willow
6,047,774 A 4/2000 Allen
6,050,341 A 4/2000 Metcalf
6,050,346 A 4/2000 Hipp
6,056,059 A 5/2000 Ohmer
6,056,324 A 5/2000 Reimert et al.
6,062,324 A 5/2000 Hipp
6,065,500 A 5/2000 Metcalfe
6,070,671 A 6/2000 Cumming et al.
6,073,332 A 6/2000 Turner
6,073,692 A 6/2000 Wood et al.
6,073,698 A 6/2000 Schultz et al.
6,074,133 A 6/2000 Kelsey
6,078,031 A 6/2000 Bliault et al.
6,079,495 A 6/2000 Ohmer
6,085,838 A 7/2000 Vercaemer et al.
6,089,320 A 7/2000 LaGrange
6,098,717 A 8/2000 Bailey et al.
6,102,119 A 8/2000 Raines
6,109,355 A 8/2000 Reid
6,112,818 A 9/2000 Campbell
6,131,265 A 10/2000 Bird
6,135,208 A 10/2000 Gano et al.
6,138,761 A 10/2000 Freeman et al.
6,142,230 A 11/2000 Smalley et al.
6,155,613 A 12/2000 Quadflieg et al.
6,158,785 A 12/2000 Beaulier et al.
6,158,963 A 12/2000 Hollis
6,167,970 B1 1/2001 Stout
6,182,775 B1 2/2001 Hipp
6,183,013 B1 2/2001 Mackenzie et al.
6,183,573 B1 2/2001 Fujiwara et al.
6,196,336 B1 3/2001 Fincher et al.
6,216,509 B1 4/2001 Lotspaih et al.
6,220,306 B1 4/2001 Omura et al.
6,226,855 B1 5/2001 Maine
6,231,086 B1 5/2001 Tierling
6,237,967 B1 5/2001 Yamamoto et al.
6,250,385 B1 6/2001 Montaron
6,253,846 B1 7/2001 Nazzai et al.
6,253,850 B1 7/2001 Nazzai et al.
6,263,966 B1 7/2001 Haut et al.
6,263,968 B1 7/2001 Freeman et al.
6,263,972 B1 7/2001 Richard et al.
6,267,181 B1 7/2001 Rhein-Knudsen et al.
6,273,634 B1 8/2001 Lohbeck
6,275,556 B1 8/2001 Kinney et al.
6,283,211 B1 9/2001 Vloedman
6,286,558 B1 9/2001 Quigley et al.
6,302,211 B1 10/2001 Nelson et al.
6,311,792 B1 11/2001 Scott et al.
6,315,040 B1 11/2001 Donnelly
6,315,043 B1 11/2001 Farrant et al.
6,318,457 B1 11/2001 Den Boer et al.
6,318,465 B1 11/2001 Coon et al.
6,322,109 B1 11/2001 Campbell et al.
6,325,148 B1 12/2001 Trahan et al.
6,328,113 B1 12/2001 Cook
6,334,351 B1 1/2002 Tsuchiya
6,343,495 B1 2/2002 Cheppe et al.
6,343,657 B1 2/2002 Baugh et al.
6,345,373 B1 2/2002 Chakradhar et al.
6,345,431 B1 2/2002 Greig
6,352,112 B1 3/2002 Mills
6,354,373 B1 3/2002 Vercaemer et al.
6,390,720 B1 5/2002 LeBegue et al.
6,405,761 B1 6/2002 Shimizu et al.
6,406,063 B1 6/2002 Pfeiffer
6,409,175 B1 6/2002 Evans et al.
6,419,025 B1 7/2002 Lohbeck et al.
6,419,026 B1 7/2002 MacKenzie et al.
6,419,033 B1 7/2002 Hahn et al.
6,419,147 B1 7/2002 Daniel
6,425,444 B1 7/2002 Metcalfe et al.
6,431,277 B1 8/2002 Cox et al.

6,443,247 B1 9/2002 Wardley
6,446,724 B2 9/2002 Baugh et al.
6,447,025 B1 9/2002 Smith
6,450,261 B1 9/2002 Baugh
6,454,013 B1 9/2002 Metcalfe
6,454,024 B1 9/2002 Nackerud
6,457,532 B1 10/2002 Simpson
6,457,533 B1 10/2002 Metcalfe
6,457,749 B1 10/2002 Heijnen
6,460,615 B1 10/2002 Heijnen
6,464,008 B1 10/2002 Roddy et al.
6,464,014 B1 10/2002 Bemat
6,470,966 B2 10/2002 Cook et al.
6,470,996 B1 10/2002 Kyle et al.
6,478,092 B2 11/2002 Voll et al.
6,491,108 B1 12/2002 Slup et al.
6,497,289 B1 12/2002 Cook et al.
6,513,243 B1 2/2003 Bignucolo et al.
6,516,887 B2 2/2003 Nguyen et al.
6,517,126 B1 2/2003 Peterson et al.
6,527,049 B2 3/2003 Metcalfe et al.
6,543,545 B1 4/2003 Chatterji et al.
6,543,552 B1 4/2003 Metcalfe et al.
6,550,539 B2 4/2003 Maguire et al.
6,550,821 B2 4/2003 DeLange et al.
6,557,640 B1 5/2003 Cook et al.
6,557,906 B1 5/2003 Carcagno
6,561,227 B2 5/2003 Cook et al.
6,561,279 B2 5/2003 MacKenzie et al.
6,564,875 B1 5/2003 Bullock
6,568,471 B1 5/2003 Cook et al.
6,568,488 B2 5/2003 Wentworth et al.
6,575,240 B1 6/2003 Haut et al.
6,578,630 B2 6/2003 Simpson et al.
6,585,053 B2 7/2003 Coon
6,585,299 B1 7/2003 Quadflieg et al.
6,591,905 B2 7/2003 Coon
6,598,677 B1 7/2003 Baugh et al.
6,598,678 B1 7/2003 Simpson
6,604,763 B1 8/2003 Ring et al.
6,607,220 B2 8/2003 Sivley, IV
6,609,735 B1 8/2003 DeLange et al.
6,619,696 B2 9/2003 Baugh et al.
6,622,797 B2 9/2003 Sivley, IV
6,629,567 B2 10/2003 Lauritzen et al.
6,631,759 B2 10/2003 Cook et al.
6,631,760 B2 10/2003 Cook et al.
6,631,765 B2 10/2003 Baugh et al.
6,631,769 B2 10/2003 Cook et al.
6,634,431 B2 10/2003 Cook et al.
6,640,895 B2 11/2003 Murray
6,640,903 B1 11/2003 Cook et al.
6,648,075 B2 11/2003 Badrak et al.
6,659,509 B2 12/2003 Goto et al.
6,662,876 B2 12/2003 Lauritzen
6,668,937 B1 12/2003 Murray
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,725,917 B2 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,755,447 B2 6/2004 Galle, Jr. et al.
6,758,278 B2 7/2004 Cook et al.
6,772,841 B2 8/2004 Gano
6,796,380 B2 9/2004 Xu
6,814,147 B2 11/2004 Baugh
6,817,633 B2 11/2004 Brill et al.
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 4/2005 Tom et al.
6,892,819 B2 5/2005 Cook et al.
6,902,000 B2 6/2005 Simpson et al.
6,907,652 B1 6/2005 Heijnen
6,923,261 B2 8/2005 Metcalfe et al.
6,935,429 B2 8/2005 Badrack
6,935,430 B2 8/2005 Harrell et al.
6,966,370 B2 11/2005 Cook et al.
6,976,539 B2 12/2005 Metcalfe et al.
6,976,541 B2 12/2005 Brisco et al.
7,000,953 B2 2/2006 Berghaus
7,007,760 B2 3/2006 Lohbeck
7,021,390 B2 4/2006 Cook et al.
7,036,582 B2 5/2006 Cook et al.
7,044,221 B2 5/2006 Cook et al.
7,048,062 B2 5/2006 Ring et al.
7,066,284 B2 6/2006 Wylie et al.
7,077,211 B2 7/2006 Cook et al.
7,077,213 B2 7/2006 Cook et al.
7,086,475 B2 8/2006 Cook
7,100,684 B2 9/2006 Cook et al.
7,100,685 B2 9/2006 Cook et al.
7,108,061 B2 9/2006 Cook et al.
7,108,072 B2 9/2006 Cook et al.
7,121,337 B2 10/2006 Cook et al.
7,121,352 B2 10/2006 Cook et al.
7,124,821 B2 10/2006 Metcalfe et al.
7,124,823 B2 10/2006 Oosterling
7,124,826 B2 10/2006 Simpson
7,146,702 B2 12/2006 Cook et al.
7,147,053 B2 12/2006 Cook et al.
7,159,665 B2 1/2007 Cook et al.
7,159,667 B2 1/2007 Cook et al.
7,168,496 B2 1/2007 Cook et al.
7,168,499 B2 1/2007 Cook et al.
7,172,019 B2 2/2007 Cook et al.
7,172,021 B2 2/2007 Brisco et al.
7,172,024 B2 2/2007 Cook et al.
7,174,964 B2 2/2007 Cook et al.
2001/0002626 A1 6/2001 Frank et al.
2001/0020532 A1 9/2001 Baugh et al.
2001/0045284 A1 11/2001 Simpson et al.
2001/0045289 A1 11/2001 Cook et al.
2001/0047870 A1 12/2001 Cook et al.
2002/0011339 A1 1/2002 Murray
2002/0014339 A1 2/2002 Ross
2002/0020524 A1 2/2002 Gano
2002/0020531 A1 2/2002 Ohmer
2002/0033261 A1 3/2002 Metcalfe
2002/0060068 A1 5/2002 Cook et al.
2002/0062956 A1 5/2002 Murray et al.
2002/0066576 A1 6/2002 Cook et al.
2002/0066578 A1 6/2002 Broome 2002/0070023 A1 6/2002 Turner et al.
2002/0070031 A1 6/2002 Voll et al.
2002/0079101 A1 6/2002 Baugh et al.
2002/0084070 A1 7/2002 Voll et al.
2002/0092654 A1 7/2002 Coronado et al.
2002/0108756 A1 8/2002 Harrall et al.
2002/0139540 A1 10/2002 Lauritzen
2002/0144822 A1 10/2002 Hackworth et al.
2002/0148612 A1 10/2002 Cook et al.
2002/0185274 A1 12/2002 Simpson et al.
2002/0189816 A1 12/2002 Cook et al.
2002/0195252 A1 12/2002 Maguire et al.
2002/0195256 A1 12/2002 Metcalfe et al.
2003/0024708 A1 2/2003 Ring et al.
2003/0024711 A1 2/2003 Simpson et al.
2003/0034177 A1 2/2003 Chitwood et al.
2003/0042022 A1 3/2003 Lauritzen et al.
2003/0047322 A1 3/2003 Maguire et al.
2003/0047323 A1 3/2003 Jackson et al.
2003/0056991 A1 3/2003 Hahn et al.
2003/0066655 A1 4/2003 Cook et al.
2003/0067166 A1 4/2003 Maguire
2003/0075337 A1 4/2003 Sivley, IV
2003/0075338 A1 4/2003 Sivley, IV
2003/0075339 A1 4/2003 Gano et al.
2003/0094277 A1 5/2003 Cook et al.
2003/0094278 A1 5/2003 Cook et al.
2003/0094279 A1 5/2003 Ring et al.
2003/0098154 A1 5/2003 Cook et al.
2003/0098162 A1 5/2003 Cook
2003/0107217 A1 6/2003 Daigle et al.
2003/0111234 A1 6/2003 McClurkin et al.
2003/0116318 A1 6/2003 Metcalfe
2003/0116325 A1 6/2003 Cook et al.
2003/0121558 A1 7/2003 Cook et al.
2003/0121655 A1 7/2003 Lauritzen et al.
2003/0121669 A1 7/2003 Cook et al.
2003/0140673 A1 7/2003 Marr et al.
2003/0150608 A1 8/2003 Smith, Jr. et al.
2003/0168222 A1 9/2003 Maguire et al.
2003/0173090 A1 9/2003 Cook et al.
2003/0192705 A1 10/2003 Cook et al.
2003/0221841 A1 12/2003 Burtner et al.
2003/0222455 A1 12/2003 Cook et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0149431 A1 8/2004 Wylie et al.
2004/0159446 A1 8/2004 Haugen et al.
2004/0174017 A1 9/2004 Brill et al.
2004/0188099 A1 9/2004 Cook et al.
2004/0194278 A1 10/2004 Brill et al.
2004/0194966 A1 10/2004 Zimmerman
2004/0216873 A1 11/2004 Frost, Jr. et al.
2004/0221996 A1 11/2004 Burge
2004/0228679 A1 11/2004 Reavis et al.
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217768 A1 10/2005 Asahi et al.
2005/0217865 A1 10/2005 Ring et al.
2005/0217866 A1 10/2005 Watson et al.
2005/0223535 A1 10/2005 Cook et al.
2005/0224225 A1 10/2005 Cook et al.
2005/0230102 A1 10/2005 Cook et al.
2005/0230103 A1 10/2005 Cook et al.
2005/0230104 A1 10/2005 Cook et al.
2005/0230123 A1 10/2005 Cook et al.
2005/0236159 A1 10/2005 Cook et al.
2005/0236163 A1 10/2005 Cook et al.
2005/0244578 A1 11/2005 Van Egmond et al.
2005/0246883 A1 11/2005 Alliot et al.
2005/0247453 A1 11/2005 Shuster et al.
2005/0265788 A1 12/2005 Renkema
2005/0269107 A1 12/2005 Cook et al.
2006/0027371 A1 2/2006 Gorrara
2006/0032640 A1 2/2006 Costa et al.
2006/0048948 A1 3/2006 Noel
2006/0054330 A1 3/2006 Metcalfe et al.
2006/0065403 A1 3/2006 Watson et al.
2006/0065406 A1 3/2006 Shuster et al.
2006/0096762 A1 5/2006 Brisco
2006/0102360 A1 5/2006 Brisco et al.
2006/0112768 A1 6/2006 Shuster et al.
2006/0113086 A1 6/2006 Costa et al.
2006/0162937 A1 7/2006 Costa et al.
2006/0163460 A1 7/2006 Brisco
2006/0196679 A1 9/2006 Brisco et al.
2006/0207760 A1 9/2006 Watson et al.
2006/0208488 A1 9/2006 Costa
2006/0213668 A1 9/2006 Cook et al.
2006/0219414 A1 10/2006 Shuster
2006/0225892 A1 10/2006 Watson et al.
2006/0243444 A1 11/2006 Brisco
2006/0266527 A1 11/2006 Brisco et al.
2006/0272826 A1 12/2006 Shuster et al.
2007/0012456 A1 1/2007 Cook
2007/0017572 A1 1/2007 Cook
2007/0029095 A1 2/2007 Brisco
2007/0034383 A1 2/2007 Shuster et al.
2007/0039742 A1 2/2007 Costa

FOREIGN PATENT DOCUMENTS

AU 773168 5/2004

| | | | |
|---|---|---|---|
| AU | 770008 | | 7/2004 |
| AU | 770359 | | 7/2004 |
| AU | 771884 | | 8/2004 |
| AU | 776580 | | 1/2005 |
| AU | 780123 | | 3/2005 |
| AU | 2001269810 | | 8/2005 |
| AU | 782901 | | 9/2005 |
| AU | 783245 | | 10/2005 |
| AU | 2001294802 | | 10/2005 |
| AU | 2001283026 | | 7/2006 |
| AU | 2002239857 | | 8/2006 |
| AU | 2001292695 | | 10/2006 |
| CA | 736288 | | 6/1966 |
| CA | 771462 | | 11/1967 |
| CA | 1171310 | | 7/1984 |
| CA | 2292171 | | 6/2000 |
| CA | 2497854 | | 6/2000 |
| CA | 2298139 | | 8/2000 |
| CA | 2234386 | | 3/2003 |
| CA | 2414449 | | 9/2006 |
| CA | 2398001 | | 10/2006 |
| CA | 2289811 | | 1/2007 |
| DE | 174521 | | 4/1953 |
| DE | 2458188 | | 12/1980 |
| DE | 203767 | | 11/1983 |
| DE | 233607 | A1 | 3/1986 |
| DE | 278517 | A1 | 5/1990 |
| EP | 0084940 | A1 | 8/1983 |
| EP | 0272511 | | 12/1987 |
| EP | 0294264 | | 5/1988 |
| EP | 0553566 | A1 | 12/1992 |
| EP | 0633391 | A2 | 1/1995 |
| EP | 0713953 | B1 | 11/1995 |
| EP | 0823534 | | 2/1998 |
| EP | 0881354 | | 12/1998 |
| EP | 0881359 | | 12/1998 |
| EP | 0899420 | | 3/1999 |
| EP | 0937861 | | 8/1999 |
| EP | 0952305 | | 10/1999 |
| EP | 0952306 | | 10/1999 |
| EP | 1141515 | A | 10/2001 |
| EP | 1152120 | A2 | 11/2001 |
| EP | 1152120 | A3 | 11/2001 |
| EP | 1235972 | A | 9/2002 |
| EP | 1555386 | A1 | 7/2005 |
| FR | 1325596 | | 6/1962 |
| FR | 2583398 | A1 | 12/1986 |
| FR | 2717855 | A1 | 9/1995 |
| FR | 2741907 | A1 | 6/1997 |
| FR | 2771133 | A | 5/1999 |
| FR | 2780751 | | 1/2000 |
| FR | 2841626 | A1 | 1/2004 |
| GB | 557823 | | 12/1943 |
| GB | 788150 | | 12/1957 |
| GB | 851096 | | 10/1960 |
| GB | 961750 | | 6/1964 |
| GB | 1000383 | | 10/1965 |
| GB | 1062610 | | 3/1967 |
| GB | 1111536 | | 5/1968 |
| GB | 1448304 | | 9/1976 |
| GB | 1460864 | | 1/1977 |
| GB | 1520552 | A | 8/1978 |
| GB | 1542847 | | 3/1979 |
| GB | 1563740 | | 3/1980 |
| GB | 1582767 | | 1/1981 |
| GB | 2058877 | A | 4/1981 |
| GB | 2108228 | A | 5/1983 |
| GB | 2115860 | A | 9/1983 |
| GB | 2125876 | A | 3/1984 |
| GB | 2211573 | A | 7/1989 |
| GB | 2216926 | A | 10/1989 |
| GB | 2243191 | A | 10/1991 |
| GB | 2256910 | A | 12/1992 |
| GB | 2257184 | A | 6/1993 |
| GB | 2305682 | A | 4/1997 |
| GB | 2325949 | A | 5/1998 |
| GB | 2322655 | A | 9/1998 |
| GB | 2326896 | A | 1/1999 |
| GB | 2329916 | A | 4/1999 |
| GB | 2329918 | A | 4/1999 |
| GB | 2331103 | A | 5/1999 |
| GB | 2336383 | A | 10/1999 |
| GB | 2355738 | A | 4/2000 |
| GB | 2343691 | A | 5/2000 |
| GB | 2344606 | A | 6/2000 |
| GB | 2345308 | A | 7/2000 |
| GB | 2368865 | A | 7/2000 |
| GB | 2346165 | A | 8/2000 |
| GB | 2346632 | A | 8/2000 |
| GB | 2347445 | A | 9/2000 |
| GB | 2347446 | A | 9/2000 |
| GB | 2347950 | A | 9/2000 |
| GB | 2347952 | A | 9/2000 |
| GB | 2348223 | A | 9/2000 |
| GB | 2348657 | A | 10/2000 |
| GB | 2357099 | A | 12/2000 |
| GB | 2356651 | A | 5/2001 |
| GB | 2350137 | B | 8/2001 |
| GB | 2361724 | | 10/2001 |
| GB | 2365898 | A | 2/2002 |
| GB | 2359837 | B | 4/2002 |
| GB | 2370301 | A | 6/2002 |
| GB | 2371064 | A | 7/2002 |
| GB | 2371574 | A | 7/2002 |
| GB | 2373524 | | 9/2002 |
| GB | 2367842 | A | 10/2002 |
| GB | 2374098 | A | 10/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2343691 | B | 5/2003 |
| GB | 2382364 | A | 5/2003 |
| GB | 2382828 | A | 6/2003 |
| GB | 2344606 | B | 8/2003 |
| GB | 2347950 | B | 8/2003 |
| GB | 2380213 | B | 8/2003 |
| GB | 2380214 | B | 8/2003 |
| GB | 2380215 | B | 8/2003 |
| GB | 2348223 | B | 9/2003 |
| GB | 2347952 | B | 10/2003 |
| GB | 2348657 | B | 10/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |

| | | | |
|---|---|---|---|
| GB | 2385622 | B | 10/2003 |
| GB | 2385623 | B | 10/2003 |
| GB | 2387405 | A | 10/2003 |
| GB | 2387861 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2391028 | A | 1/2004 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2391886 | A | 2/2004 |
| GB | 2390628 | B | 3/2004 |
| GB | 2391033 | B | 3/2004 |
| GB | 2392686 | A | 3/2004 |
| GB | 2393199 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2395734 | A | 6/2004 |
| GB | 2396635 | A | 6/2004 |
| GB | 2396639 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2396646 | A | 6/2004 |
| GB | 2373468 | B | 7/2004 |
| GB | 2396869 | A | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2398087 | A | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2398326 | A | 8/2004 |
| GB | 2382367 | B | 9/2004 |
| GB | 2396641 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400393 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2394979 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404402 | A | 2/2005 |
| GB | 2404676 | A | 2/2005 |
| GB | 2404680 | A | 2/2005 |
| GB | 2384807 | C | 3/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2410518 | A | 3/2005 |
| GB | 2406599 | A | 4/2005 |
| GB | 2389597 | B | 5/2005 |
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2414749 | A | 7/2005 |
| GB | 2414750 | A | 7/2005 |
| GB | 2414751 | A | 7/2005 |
| GB | 2398362 | B | 8/2005 |
| GB | 2403970 | B | 8/2005 |
| GB | 2403971 | B | 8/2005 |
| GB | 2403972 | B | 8/2005 |
| GB | 2380503 | B | 10/2005 |

| | | | |
|---|---|---|---|
| GB | 2382828 | B | 10/2005 |
| GB | 2398317 | B | 10/2005 |
| GB | 2398318 | B | 10/2005 |
| GB | 2398319 | B | 10/2005 |
| GB | 2398321 | B | 10/2005 |
| GB | 2398322 | B | 10/2005 |
| GB | 2412681 | A | 10/2005 |
| GB | 2412682 | A | 10/2005 |
| GB | 2413136 | A | 10/2005 |
| GB | 2414493 | A | 11/2005 |
| GB | 2409217 | B | 12/2005 |
| GB | 2410518 | B | 12/2005 |
| GB | 2415003 | A | 12/2005 |
| GB | 2415219 | A | 12/2005 |
| GB | 2395506 | B | 1/2006 |
| GB | 2412681 | B | 1/2006 |
| GB | 2412682 | B | 1/2006 |
| GB | 2415979 | A | 1/2006 |
| GB | 2415983 | A | 1/2006 |
| GB | 2415987 | A | 1/2006 |
| GB | 2415988 | A | 1/2006 |
| GB | 2416177 | A | 1/2006 |
| GB | 2416361 | A | 1/2006 |
| GB | 2416556 | A | 2/2006 |
| GB | 2416794 | A | 2/2006 |
| GB | 2416795 | A | 2/2006 |
| GB | 2417273 | A | 2/2006 |
| GB | 2417275 | A | 2/2006 |
| GB | 2418216 | A | 3/2006 |
| GB | 2418217 | A | 3/2006 |
| GB | 2418690 | A | 4/2006 |
| GB | 2418941 | A | 4/2006 |
| GB | 2418942 | A | 4/2006 |
| GB | 2418943 | A | 4/2006 |
| GB | 2418944 | A | 4/2006 |
| GB | 2419907 | A | 5/2006 |
| GB | 2419913 | A | 5/2006 |
| GB | 2400126 | B | 6/2006 |
| GB | 2414749 | B | 6/2006 |
| GB | 2420810 | A | 6/2006 |
| GB | 2421257 | A | 6/2006 |
| GB | 2421258 | A | 6/2006 |
| GB | 2421259 | A | 6/2006 |
| GB | 2421262 | A | 6/2006 |
| GB | 2421529 | A | 6/2006 |
| GB | 2422164 | A | 7/2006 |
| GB | 2406599 | B | 8/2006 |
| GB | 2418690 | B | 8/2006 |
| GB | 2418944 | B | 8/2006 |
| GB | 2421257 | B | 8/2006 |
| GB | 2421258 | B | 8/2006 |
| GB | 2421259 | B | 8/2006 |
| GB | 2422859 | A | 8/2006 |
| GB | 2422860 | A | 8/2006 |
| GB | 2423317 | A | 8/2006 |
| GB | 2404676 | B | 9/2006 |
| GB | 2414493 | B | 9/2006 |
| GB | 2418941 | B | 9/2006 |
| GB | 2418942 | B | 9/2006 |
| GB | 2418943 | B | 9/2006 |
| GB | 2424077 | A | 9/2006 |
| GB | 2405893 | B | 10/2006 |
| GB | 2417273 | B | 10/2006 |
| GB | 2418216 | B | 10/2006 |
| GB | 2419907 | B | 10/2006 |
| GB | 2422860 | B | 10/2006 |
| GB | 2406125 | B | 11/2006 |
| GB | 2415004 | B | 12/2006 |
| GB | 2422859 | B | 12/2006 |
| GB | 2423317 | B | 12/2006 |
| GB | 2426993 | A | 12/2006 |
| GB | 2427636 | A | 1/2007 |
| GB | 2427885 | A | 1/2007 |
| GB | 2427886 | A | 1/2007 |
| GB | 2408277 | A | 5/2008 |
| ID | P01.012.197/2005 | | 1/2005 |
| ID | 044.392/2005 | | 9/2005 |
| ID | 09.046.2804/2006 | | 8/2006 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| JP | 2001-47161 | | 2/2001 |
| NL | 9001081 | | 12/1991 |
| RO | 113267 | B1 | 5/1998 |
| RU | 1786241 | A1 | 1/1993 |
| RU | 1804543 | A3 | 3/1993 |
| RU | 1810482 | A1 | 4/1993 |
| RU | 1818459 | A1 | 5/1993 |
| RU | 2016345 | C1 | 7/1994 |
| RU | 1295799 | A1 | 2/1995 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |

| | | | |
|---|---|---|---|
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/23007 | A1 | 3/2002 |
| WO | WO02/25059 | A1 | 3/2002 |
| WO | WO02/29199 | A1 | 4/2002 |
| WO | WO02/38343 | A3 | 5/2002 |
| WO | WO02/40825 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/073000 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/095181 | A1 | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/036018 | A2 | 5/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/069115 | A3 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/086675 | A3 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO03/106130 | A3 | 12/2003 |
| WO | WO2004/003337 | A1 | 1/2004 |
| WO | WO2004/009950 | A1 | 1/2004 |
| WO | WO2004/010039 | A2 | 1/2004 |
| WO | WO2004/010039 | A3 | 1/2004 |
| WO | WO2004/011776 | A2 | 2/2004 |
| WO | WO2004/011776 | A3 | 2/2004 |

| | | | |
|---|---|---|---|
| WO | WO2004/018823 | A2 | 3/2004 |
| WO | WO2004/018823 | A3 | 3/2004 |
| WO | WO2004/018824 | A2 | 3/2004 |
| WO | WO2004/018824 | A3 | 3/2004 |
| WO | WO2004/020895 | A2 | 3/2004 |
| WO | WO2004/020895 | A3 | 3/2004 |
| WO | WO2004/023014 | A2 | 3/2004 |
| WO | WO2004/023014 | A3 | 3/2004 |
| WO | WO2004/026017 | A2 | 4/2004 |
| WO | WO2004/026017 | A3 | 4/2004 |
| WO | WO2004/026073 | A2 | 4/2004 |
| WO | WO2004/026073 | A3 | 4/2004 |
| WO | WO2004/026500 | A2 | 4/2004 |
| WO | WO2004/026500 | A3 | 4/2004 |
| WO | WO2004/027200 | A2 | 4/2004 |
| WO | WO2004/027200 | A3 | 4/2004 |
| WO | WO2004/027204 | A2 | 4/2004 |
| WO | WO2004/027204 | A3 | 4/2004 |
| WO | WO2004/027205 | A2 | 4/2004 |
| WO | WO2004/027205 | A3 | 4/2004 |
| WO | WO2004/027392 | A1 | 4/2004 |
| WO | WO2004/027786 | A2 | 4/2004 |
| WO | WO2004/027786 | A3 | 4/2004 |
| WO | WO2004/053434 | A2 | 6/2004 |
| WO | WO2004/053434 | A3 | 6/2004 |
| WO | WO2004/057715 | A2 | 7/2004 |
| WO | WO2004/057715 | A3 | 7/2004 |
| WO | WO2004/067961 | A2 | 8/2004 |
| WO | WO2004/067961 | A3 | 8/2004 |
| WO | WO2004/072436 | A1 | 8/2004 |
| WO | WO2004/074622 | A2 | 9/2004 |
| WO | WO2004/074622 | A3 | 9/2004 |
| WO | WO2004/076798 | A2 | 9/2004 |
| WO | WO2004/076798 | A3 | 9/2004 |
| WO | WO2004/081436 | A2 | 9/2004 |
| WO | WO2004/083591 | A2 | 9/2004 |
| WO | WO2004/083591 | A3 | 9/2004 |
| WO | WO2004/083592 | A2 | 9/2004 |
| WO | WO2004/083592 | A3 | 9/2004 |
| WO | WO2004/083593 | A2 | 9/2004 |
| WO | WO2004/083594 | A2 | 9/2004 |
| WO | WO2004/083594 | A3 | 9/2004 |
| WO | WO2004/085790 | A2 | 10/2004 |
| WO | WO2004/089608 | A2 | 10/2004 |
| WO | WO2004/089608 | A3 | 10/2004 |
| WO | WO2004/092527 | A2 | 10/2004 |
| WO | WO2004/092528 | A2 | 10/2004 |
| WO | WO2004/092528 | A3 | 10/2004 |
| WO | WO2004/092530 | A2 | 10/2004 |
| WO | WO2004/092530 | A3 | 10/2004 |
| WO | WO2004/094766 | A2 | 11/2004 |
| WO | WO2004/094766 | A3 | 11/2004 |
| WO | WO2005/017303 | A2 | 2/2005 |
| WO | WO2005/021921 | A2 | 3/2005 |
| WO | WO2005/021921 | A3 | 3/2005 |
| WO | WO2005/021922 | A2 | 3/2005 |
| WO | WO2005/021922 | A3 | 3/2005 |
| WO | WO2005/024141 | A3 | 3/2005 |
| WO | WO2005/024170 | A2 | 3/2005 |
| WO | WO2005/024170 | A3 | 3/2005 |
| WO | WO2005/024171 | A2 | 3/2005 |
| WO | WO2005/028803 | A2 | 3/2005 |
| WO | WO2005/071212 | A1 | 4/2005 |
| WO | WO2005/079186 | A2 | 9/2005 |
| WO | WO2005/079186 | A3 | 9/2005 |
| WO | WO2005/081803 | A2 | 9/2005 |
| WO | WO2005/086614 | A2 | 9/2005 |
| WO | WO2006/014333 | A2 | 2/2006 |
| WO | WO2006/020723 | A2 | 2/2006 |
| WO | WO2006/020726 | A2 | 2/2006 |
| WO | WO2006/020734 | A2 | 2/2006 |
| WO | WO2006/020809 | A2 | 2/2006 |
| WO | WO2006/020810 | A2 | 2/2006 |
| WO | WO2006/020827 | A2 | 2/2006 |
| WO | WO2006/020827 | A3 | 2/2006 |
| WO | WO2006/020913 | A2 | 2/2006 |
| WO | WO2006/020913 | A3 | 2/2006 |
| WO | WO2006/020960 | A2 | 2/2006 |
| WO | WO2006/033720 | A2 | 3/2006 |
| WO | WO2006/060387 | A3 | 6/2006 |
| WO | WO2006/079072 | A2 | 7/2006 |
| WO | WO2006/020810 | A3 | 8/2006 |
| WO | WO2006/088743 | A2 | 8/2006 |
| WO | WO2006/102171 | A2 | 9/2006 |
| WO | WO2006/102556 | A2 | 9/2006 |
| WO | WO2006/020734 | A3 | 11/2006 |
| WO | WO2006/020810 | A3 | 11/2006 |
| WO | WO2007/014339 | A2 | 2/2007 |

OTHER PUBLICATIONS

Turcotte and Schubert, Geodynamics (1982) John Wiley & Sons, Inc., pp. 9, 432.

Baker Hughes Incorporated, "EXPatch Expandable Cladding System" (2002).

Baker Hughes Incorporated, "EXPress Expandable Screen System".

High-Tech Wells, "World's First Completion Set Inside Expandable Screen" (2003) Gilmer, J.M., Emerson, A.B.

Baker Hughes Incorporated, "Technical Overview Production Enhancement Technology" (Mar. 10, 2003) Geir Owe Egge.

Baker Hughes Incorporated, "FORMlock Expandable Liner Hangers".

Weatherford Completion Systems, "Expandable Sand Screens" (2002).

Expandable Tubular Technology, "EIS Expandable Isolation Sleeve" (Feb. 2003).

Oilfield Catalog; "Jet-Lok Product Application Description" (Aug. 8, 2003).

Power Ultrasonics, "Design and Optimisation of an Ultrasonic Die System For Form" Chris Cheers (1999, 2000).

Research Area—Sheet Metal Forming—Superposition of Vibra; Fraunhofer IWU (2001).

Research Projects;"Analysis of Metal Sheet Formability and It's Factors of Influence" Prof. Dorel Banabic (2003).

www.materialsresources.com, "Low Temperature Bonding of Dissimilar and Hard-to-Bond Materials and Metal-Including . . . " (2004).

www.tribtech.com. "Trib-gel A Chemical Cold Welding Agent" G R Linzell (Sep. 14, 1999).

www.spurind.com, "Galvanic Protection, Metallurgical Bonds, Custom Fabrication—Spur Industries" (2000).

Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).

Surface Technologies Inc., "Improving Tribological Performance of Mechanical Seals by Laser Surface Texturing" Izhak Etsion.

Tribology Transactions "Experimental Investigation of Laser Surface Texturing for Reciprocating Automotive Components" G Ryk, Y Klingerman and I Etsion (2002).

Proceeding of the International Tribology Conference, "Microtexturing of Functional Surfaces for Improving Their Tribological Performance" Henry Haefke, Yvonne Gerbig, Gabriel Dumitru and Valerio Romano (2002).

Sealing Technology, "A laser surface textured hydrostatic mechanical seal" Izhak Etsion and Gregory Halperin (Mar. 2003).

Metalforming Online, "Advanced Laser Texturing Tames Tough Tasks" Harvey Arbuckle.

Tribology Transactions, "A Laser Surface Textured Parallel Thrust Bearing" V. Brizmer, Y. Klingerman and I. Etsion (Mar. 2003).

PT Design, "Scratching the Surface" Todd E. Lizotte (Jun. 1999).

Tribology Transactions, "Friction-Reducing Surface-Texturing in Reciprocating Automotive Components" Aviram Ronen, and Izhak Etsion (2001).

Michigan Metrology "3D Surface Finish Roughness Texture Wear WYKO Veeco" C.A. Brown, PHD; Charles, W.A. Johnsen, S. Chester.
International Search Report, Application PCT/IL00/00245, Sep. 18, 2000.
International Search Report, Application PCT/US00/18635, Nov. 24, 2000.
International Search Report, Application PCT/US00/27645, Dec. 29, 2000.
International Search Report, Application PCT/US00/30022, Mar. 27, 2001.
International Search Report, Application PCT/US01/04753, Jul. 3, 2001.
International Search Report, Application PCT/US01/19014, Nov. 23, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US01/41446, Oct. 30, 2001.
International Search Report, Application PCT/US02/00093, Aug. 6, 2002.
International Search Report, Application PCT/US02/00677, Jul. 17, 2002.
International Search Report, Application PCT/US02/00677, Feb. 24, 2004.
International Search Report, Application PCT/US02/04353, Jun. 24, 2002.
International Search Report, Application PCT/US02/20256, Jan. 3, 2003.
International Search Report, Application PCT/US02/20477; Oct. 31, 2003.
International Search Report, Application PCT/US02/20477; Apr. 6, 2004.
International Search Report, Application PCT/US02/24399; Feb. 27, 2004.
International Examination Report, Application PCT/US02/24399, Aug. 6, 2004.
International Search Report, Application PCT/US02/25608; May 24, 2004.
International Search Report, Application PCT/US02/25727; Feb. 19, 2004.
Examination Report, Application PCT/US02/25727; Jul. 7, 2004.
International Search Report, Application PCT/US02/29856, Dec. 16, 2002.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Examination Report, Application PCT/US02/36267, Jan. 4, 2004.
International Search Report, Application PCT/US02/39418, Mar. 24, 2003.
International Examination Report, Application PCT/US02/39418, Feb. 18, 2005.
International Search Report, Application PCT/US02/39425, May 28, 2004.
International Search Report, Application PCT/US03/00609, May 20, 2004.
International Search Report, Application PCT/US03/04837, May 28, 2004.
International Examination Report, Application PCT/US03/04837, Dec. 9, 2004.
International Search Report, Application PCT/US03/06544, Jun. 9, 2004.
International Search Report, Application PCT/US03/10144; Oct. 31, 2003.
Examination Report, Application PCT/US03/10144; Jul. 7, 2004.
International Search Report, Application PCT/US03/11765; Nov. 13, 2003.
International Examination Report, Application PCT/US03/11765; Dec. 10, 2004.
International Examination Report, Application PCT/US03/11765;; Jan. 25, 2005.
International Search Report, Application PCT/US03/13787; May 28, 2004.
International Examination Report, Application PCT/US03/13787; Mar. 2, 2005.
International Search Report, Application PCT/US03/14153; May 28, 2004.
International Search Report, Application PCT/US03/15020; Jul. 30, 2003.
International Search Report, Application PCT/US03/18530; Jun. 24, 2004.
International Search Report, Application PCT/US03/19993; May 24, 2004.
International Search Report, Application PCT/US03/20694; Nov. 12, 2003.
International Search Report, Application PCT/US03/20870; May 24, 2004.
International Search Report, Application PCT/US03/20870; Sep. 30, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Examination Report, Application PCT/US03/25676, Aug. 17, 2004.
International Search Report, Application PCT/US03/25677; May 21, 2004.
International Examination Report, Application PCT/US03/25677, Aug. 17, 2004.
International Search Report, Application PCT/US03/25707; Jun. 23, 2004.
International Search Report, Application PCT/US03/25715; Apr. 9, 2004.
International Search Report, Application PCT/US03/25716; Jan. 13, 2005.
International Search Report, Application PCT/US03/25742; May 27, 2004.
International Search Report, Application PCT/US03/25742; Dec. 20, 2004.
International Search Report, Application PCT/US03/29460; May 25, 2004.
International Examination Report, Application PCT/US03/29460; Dec. 8, 2004.
International Search Report, Application PCT/US03/25667; Feb. 26, 2004.
International Search Report, Application PCT/US03/29858; Jun. 30, 2003.
International Search Report, Application PCT/US03/29859; May 21, 2004.
International Examination Report, Application PCT/US03/29859, Aug. 16, 2004.
International Search Report, Application PCT/US03/38550; Jun. 15, 2004.
Search Report to Application No. EP 02806451.7; Feb. 9, 2005.
Search Report to Application No. GB 0003251.6, Jul. 13, 2000.
Search Report to Application No. GB 0004282.0, Jul. 31, 2000.
Search Report to Application No. GB 0004282.0 Jan. 15, 2001.
Search and Examination Report to Application No. GB 0004282.0, Jun. 3, 2003.
Search Report to Application No. GB 0004285.3, Jul. 12, 2000.
Search Report to Application No. GB 0004285.3, Jan. 17, 2001.
Search Report to Application No. GB 0004285.3, Jan. 19, 2001.
Search Report to Application No. 0004285.3, Aug. 28, 2002.
Examination Report to Application No. 0004285.3, Mar. 28, 2003.
Examination Report to Application No. GB 0005399.1; Jul. 24, 2000.
Search Report to Application No. GB 0005399.1, Feb. 15, 2001.

Examination Report to Application No. GB 0005399.1; Oct. 14, 2002.
Search Report to Application No. GB 0013661.4, Oct. 20, 2000.
Search Report to Application No. GB 0013661.4, Apr. 17, 2001.
Search Report to Application No. GB 0013661.4, Feb. 19, 2003.
Examination Report to Application No. GB 0013661.4, Nov. 25, 2003.
Search Report to Application No. GB 0013661.4, Oct. 20, 2003.
Examination Report to Application No. GB 0208367.3, Apr. 4, 2003.
Examination Report to Application No. GB 0208367.3, Nov. 4, 2003.
Examination Report to Application No. GB 0208367.3, Nov. 17, 2003.
Examination Report to Application No. GB 0208367.3, Jan. 30, 2004.
Examination Report to Application No. GB 0212443.6, Apr. 10, 2003.
Examination Report to Application No. GB 0216409.3, Feb. 9, 2004.
Search Report to Application No. GB 0219757.2, Nov. 25, 2002.
Search Report to Application No. GB 0219757.2, Jan. 20, 2003.
Examination Report to Application No. GB 0219757.2, May 10, 2004.
Search Report to Application No. GB 0220872.6, Dec. 5, 2002.
Search Report to Application No. GB 0220872.6, Mar. 13, 2003.
Examination Report to Application No. GB 0220872.6, Oct. 29, 2004.
Search Report to Application No. GB 0225505.7, Mar. 5, 2003.
Search and Examination Report to Application No. GB0225505.7, Jul. 1, 2003.
Examination Report to Application No. GB 0225505.7, Oct. 27, 2004.
Examination Report to Application No. GB 0225505.7, Feb. 15, 2005.
Examination Report to Application No. GB 0300085.8, Nov. 28, 2003.
Examination Report to Application No. GB 030086.6, Dec. 1, 2003.
Examination Report to Application No. GB 0306046.4, Sep. 10, 2004.
Search and Examination Report to Application No. GB 0308290.6, Jun. 2, 2003.
Search and Examination Report to Application No. GB 0308293.0, Jun. 2, 2003.
Search and Examination Report to Application No. GB 0308293.0, Jul. 14, 2003.
Search and Examination Report to Application No. GB 0308294.8, Jun. 2, 2003.
Search and Examination Report to Application No. GB 0308294.8, Jul. 14, 2003.
Search and Examination Report to Application No. GB 0308295.5, Jun. 2, 2003.
Search and Examination Report to Application No. GB 0308295.5, Jul. 14, 2003.
Search and Examination Report to Application No. GB 0308296.3, Jun. 2, 2003.
Search and Examination Report to Application No. GB 0308296.3, Jul. 14, 2003.
Search and Examination Report to Application No. GB 0308297.1, Jun. 2, 2003.
Search and Examination Report to Application No. GB 0308297.1, Jul. 2003.
Search and Examination Report to Application No. GB 0308299.7, Jun. 2, 2003.
Search and Examination Report to Application No. GB 0308299.7, Jun. 14, 2003.
Search and Examination Report to Application No. GB 0308302.9, Jun. 2, 2003.
Search and Examination Report to Application No. GB 0308303.7, Jun. 2, 2003.
Search and Examination Report to Application No. GB 0308303.7, Jul. 14, 2003.
Search and Examination Report to Application No. GB 0310090.6, Jun. 24, 2003.
Search and Examination Report to Application No. GB 0310099.7, Jun. 24, 2003.
Search and Examination Report to Application No. GB 0310101.1, Jun. 24, 2003.
Search and Examination Report to Application No. GB 0310104.5, Jun. 24, 2003.
Search and Examination Report to Application No. GB 0310118.5, Jun. 24, 2003.
Search and Examination Report to Application No. GB 0310757.0, Jun. 12, 2003.
Search and Examination Report to Application No. GB 0310759.6, Jun. 12, 2003.
Search and Examination Report to Application No. GB 0310770.3, Jun. 12, 2003.
Search and Examination Report to Application No. GB 0310772.9, Jun. 12, 2003.
Search and Examination Report to Application No. GB 0310785.1, Jun. 12, 2003.
Search and Examination Report to Application No. GB 0310795.0, Jun. 12, 2003.
Search and Examination Report to Application No. GB 0310797.6, Jun. 12, 2003.
Search and Examination Report to Application No. GB 0310799.2, Jun. 12, 2003.
Search and Examination Report to Application No. GB 0310801.6, Jun. 12, 2003.
Search and Examination Report to Application No. GB 0310833.9, Jun. 12, 2003.
Search and Examination Report to Application No. GB 0310836.2, Jun. 12, 2003.
Examination Report to Application No. GB 0310836.2, Aug. 7, 2003.
Examination Report to Application No. GB 0311596.1, May 18, 2004.
Search and Examination Report to Application No. GB 0313406.1, Sep. 3, 2003.
Examination Report to Application No. GB 0314846.7, Jul. 15, 2004.
Search and Examination Report to Application No. GB 0316883.8, Aug. 14, 2003.
Search and Examination Report to Application No. GB 0316883.8, Nov. 25, 2003.
Search and Examination Report to Application No. GB 0316886.1, Aug. 14, 2003.
Search and Examination Report to Application No. GB 0316886.1, Nov. 25, 2003.
Search and Examination Report to Application No. GB 0316887.9, Aug. 14, 2003.
Search and Examination Report to Application No. GB 0316887.9, Nov. 25, 2003.
Search and Examination Report to Application No. GB 0318545.1, Sep. 3, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318550.1, Sep. 3, 2003.
Search and Examination Report to Application No. GB 0320579.6, Dec. 16, 2003.
Search and Examination Report to Application No. GB 0320580.4, Dec. 17, 2003.
Examination Report to Application No. GB 0320747.9, May 25, 2004.
Search and Examination Report to Application No. GB 0323891.2, Dec. 19, 2003.
Search and Examination Report to Application No. GB 0324172.6, Nov. 4, 2003.
Search and Examination Report to Application No. GB 0324174.2, Nov. 4, 2003.
Search and Examination Report to Application No. GB 0325071.9, Nov. 18, 2003.
Examination Report to Application No. GB 0325071.9, Feb. 2, 2004.
Examination Report to Application No. GB 0325072.7, Feb. 5, 2004.
Search and Examination Report to Application No. GB 0325072.7; Dec. 3, 2003.

Examination Report to Application No. GB 0325072.7; Apr. 13, 2004.
Examination Report to Application No. GB 0400018.8; Oct. 29, 2004.
Examination Report to Application No. GB 0400019.6; Oct. 29, 2004.
Search and Examination Report to Application No. GB 0403891.5, Jun. 9, 2004.
Examination Report to Application No. GB 0403891.5, Feb. 14, 2005.
Search and Examination Report to Application No. GB 0403893.1, Jun. 9, 2004.
Search and Examination Report to Application No. GB 0403894.9, Jun. 9, 2004.
Examination Report to Application No. GB 0403894.9, Feb. 15, 2005.
Search and Examination Report to Application No. GB 0403897.2, Jun. 9, 2004.
Search and Examination Report to Application No. GB 0403920.2, Jun. 10, 2004.
Search and Examination Report to Application No. GB 0403921.0, Jun. 10, 2004.
Examination Report to Application No. GB 0403921.0, Feb. 15, 2005.
Search and Examination Report to Application No. GB 0403926.9, Jun. 10, 2004.
Examination Report to Application No. GB 0404796.5; May 20, 2004.
Search and Examination Report to Application No. GB 0404826.0, Apr. 21, 2004.
Search and Examination Report to Application No. GB 0404828.6, Apr. 21, 2004.
Search and Examination Report to Application No. GB 0404830.2, Apr. 21, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404833.6, Aug. 19, 2004.
Search and Examination Report to Application No. GB 0404837.7, May 17, 2004.
Examination Report to Application No. GB 0404837.7, Jul. 12, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406257.6, Jan. 25, 2005.
Examination Report to Application No. GB 0406258.4, May 20, 2004.
Examination Report to Application No. GB 0406258.4; Jan. 12, 2005.
Examination Report to Application No. GB 0408672.4, Jul. 12, 2004.
Examination Report to Application No. GB 0404830.2, Aug. 17, 2004.
Search and Examination Report to Application No. GB 0411698.4, Jun. 30, 2004.
Examination Report to Application No. GB 0411698.4, Jan. 24, 2005.
Search and Examination Report to Application No. GB 0411892.3, Jul. 14, 2004.
Search and Examination Report to Application No. GB 0411893.3, Jul. 14, 2004.
Search and Examination Report to Application No. GB 0411894.9, Jun. 30, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.
Examination Report to Application No. GB 0416625.2 Jan. 20, 2005.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Search Report to Application No. GB 9926449.1, Mar. 27, 2000.
Search Report to Application No. GB 9926449.1, Jul. 4, 2001.
Search Report to Application No. GB 9926449.1, Sep. 5, 2001.
Search Report to Application No. GB 9926450.9, Feb. 28, 2000.
Examination Report to Application No. GB 9926450.9, May 15, 2002.
Examination Report to Application No. GB 9926450.9, Nov. 22, 2002.
Search Report to Application No. GB 9930398.4, Jun. 27, 2000.
Search Report to Application No. Norway 1999 5593, Aug. 20, 2002.
Written Opinion to Application No. PCT/US01/19014; Dec. 10, 2002.
Written Opinion to Application No. PCT/US01/23815; Jul. 25, 2002.
Written Opinion to Application No. PCT/US01/28960; Dec. 2, 2002.
Written Opinion to Application No. PCT/US01/30256; Nov. 11, 2002.

Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Written Opinion to Application No. PCT/US02/25608 Sep. 13, 2004.
Written Opinion to Application No. PCT/US02/25608 Feb. 2, 2005.
Written Opinion to Application No. PCT/US02/25675 Nov. 24, 2004.
Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US03/06544; Feb. 18, 2005.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/29858 Jan. 21, 2004.
Written Opinion to Application No. PCT/US03/38550 Dec. 10, 2004.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
International Preliminary Examination Report, Application PCT/US02/24399, Aug. 6, 2004.
International Preliminary Examination Report, Application PCT/US02/25608, Jun. 1, 2005.
International Preliminary Examination Report, Application PCT/US02/25727, Jul. 7, 2004.
International Preliminary Examination Report PCT/US02/36157, Apr. 14, 2004.
International Preliminary Examination Report, Application PCT/US02/36267, Jan. 4, 2004.
International Preliminary Examination Report, Application PCT/US02/39418, Feb. 18, 2005.
International Preliminary Examination Report, Application PCT/US03/04837, Dec. 9, 2004.
International Preliminary Examination Report, Application PCT/US03/06544, May 10, 2005.
International Preliminary Examination Report, Application PCT/US03/10144, Jul. 7, 2004.
International Preliminary Examination Report, Application PCT/US03/11765, Dec. 10, 2004.
International Preliminary Examination Report, Application PCT/US03/11765, Jan. 25, 2005.
International Preliminary Examination Report, Application PCT/US03/11765, Jul. 18, 2005.
International Preliminary Examination Report, Application PCT/US01/11765, Aug. 15, 2005.
International Preliminary Examination Report, Application PCT/US03/13787, Mar. 2, 2005.
International Preliminary Examination Report, Application PCT/US03/13787, Apr. 7, 2005.
International Preliminary Examination Report, Application PCT/US03/14153, May 12, 2005.
International Preliminary Examination Report, Application PCT/US03/15020, May 9, 2005.
International Preliminary Examination Report, Application PCT/US03/20870, Sep. 30, 2004.
International Preliminary Examination Report, Application PCT/US03/25667, May 25, 2005.
International Preliminary Examination Report, Application PCT/US03/25675, Aug. 30, 2005.
International Preliminary Examination Report, Application PCT/US03/25676, Aug. 17, 2004.
International Preliminary Examination Report, Application PCT/US03/25677, Aug. 17, 2004.
International Preliminary Examination Report, Application PCT/US03/25742, Dec. 20, 2004.
International Preliminary Examination Report, Application PCT/US03/29460, Dec. 8, 2004.
International Preliminary Examination Report, Application PCT/US03/29858, May 23, 2005.
International Preliminary Examination Report, Application PCT/US03/29859, Aug. 16, 2004.
International Preliminary Examination Report, Application PCT/US03/38550, May 23, 2005.
International Preliminary Report on Patentability, Application PCT/US04/02122, May 13, 2005.
International Preliminary Report on Patentability, Application PCT/US04/04740, Apr. 27, 2005.
International Preliminary Report on Patentability, Application PCT/US04/06246, May 5, 2005.
International Preliminary Report on Patentability, Application PCT/US04/08030, Apr. 7, 2005.
International Preliminary Report on Patentability, Application PCT/US04/08030, Jun. 10, 2005.
International Preliminary Report on Patentability, Application PCT/US04/08073, May 9, 2005.
International Preliminary Report on Patentability, Application PCT/US04/008170, Sep. 29, 2005.
International Preliminary Report on Patentability, Application PCT/US04/08171, Sep. 13, 2005.
International Preliminary Report on Patentability, Application PCT/US04/11177, Jun. 9, 2005.
International Preliminary Report on Patentability, Application PCT/US04/28438, Sep. 20, 2005.
Written Opinion to Application No. PCT/US02/39425, Apr. 11, 2005.
Written Opinion to Application No. PCT/US03/25675, Nov. 24, 2004.
Written Opinion to Application No. PCT/US03/25675, May 9, 2005.
Written Opinion to Application No. PCT/US04/08171, May 5, 2005.
Combined Search Report and Written Opinion to Application No. PCT/US04/02122, Feb. 24, 2005.
Combined Search Report and Written Opinion to Application No. PCT/US04/10762, Sep. 1, 2005.
Combined Search Report and Written Opinion to Application No. PCT/US04/28423, Jul. 13, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Blasingame et al., "Solid Expandable Tubular Technology in Mature Basins," *Society of Petroleum Engineers* 2003.
Brass et al., "Water Production Management—PDO's Successful Application of Expandable Technology," *Society of Petroleum Engineers,* 2002.
Brock et al., "An Expanded Horizon," Hart's E&P, Feb. 2000.

Buckler et al., "Expandable Cased-hole Liner Remediates Prolific Gas Well and Minimizes Loss of Production," *Offshore Technology Conference,* 15151.
Bullock, "Advances Grow Expandable Applications," *The American Oil & Gas Reporter,* Sep. 2004.
Cales, "The Development and Applications of Solid Expandable Tubular Technology," *Enventure Global Technology,* Paper 2003-136, 2003.
Cales et al., "Reducing Non-Productive Time Through the Use of Solid Expandable Tubulars: How to Beat the Curve Through Pre-Planning," *Offshore Technology Conference,* 16669, 2004.
Cales et al., "Subsidence Remediation—Extending Well Life Through the Use of Solid Expandable Casing Systems," *AADE Houston Chapter,* Mar. 27, 2001.
Campo et al., "Case Histories—Drilling and Recompletion Applications Using Solid Expandable Tubular Technology," *Society of Petroleum Engineers,* SPE/IADC 72304, 2002.
Carstens et al., "Solid Expandable Tubular Technology: The Value of Planned Installations vs. Contingency,".
Case History, "Eemskanaal—2 Groningen," Enventure Global Technology, Feb. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana," Enventure Global Technology, Feb. 2002.
Case History, "Mississippi Canyon 809 URSA TLP, OSC-G 5868, No. A-12," Enventure Global Technology, Mar. 2004.
Case History, "Unocal Sequoia Mississippi Canyon 941 Well No. 2" Enventure Global Technology, 2005.
Case History, "Yibal 381 Oman," Enventure Global Technology, Feb. 2002.
Cook, "Same Internal Casing Diameter From Surface to TD," *Offshore,* Jul. 2002.
Cottrill, "Expandable Tubulars Close in on the Holy Grail of Drilling," *Upstream,* Jul. 26, 2002.
Daigle et al., "Expandable Tubulars: Field Examples of Application in Well Construction and Remediation," *Society of Petroleum Engineers,* SPE 62958, 2000.
Daneshy, "Technology Strategy Breeds Value," E&P, May 2004.
Data Sheet, "Enventure Cased-Hole Liner (CHL) System" Enventure Global Technology, Dec. 2002.
Data Sheet, "Enventure Openhole Liner (OHL) System" Enventure Global Technology, Dec. 2002.
Data Sheet, "Window Exit Applications OHL Window Exit Expansion" Enventure Global Technology, Jun. 2003.
Dean et al., "Monodiameter Drilling Liner—From Concept to Reality," *Society of Petroleum Engineers,* SPE/IADC 79790, 2003.
Demong et al., "Breakthroughs Using Solid Expandable Tubulars to Construct Extended Reach Wells," *Society of Petroleum Engineers,* IADC/SPE 87209, 2004.
Demong et al., "Casing Design in Complex Wells: The Use of Expandables and Multilateral Technology to Attack the size Reduction Issue".
Demong et al., "Expandable Tubulars Enable Multilaterals Without Compromise on Hole Size," *Offshore,* Jun. 2003.
Demong et al., "Planning the Well Construction Process for the Use of Solid Expandable Casing," *Society of Petroleum Engineers,* SPE 85303, 2003.
Demoulin, "Les Tubes Expansibles Changent La Face Du Forage Petrolier," *L'Usine Nouvelle,* 2878:50-52, 3 Juillet 2003.
Dupal et al., "Realization of the MonoDiameter Well: Evolution of a Game-Changing Technology," *Offshore Technology Conference,* OTC 14312, 2002.
Dupal et al., "Solid Expandable Tubular Technology—A Year of Case Histories in the Drilling Environment," *Society of Petroleum Engineers,* SPE/IADC 67770, 2001.
Dupal et al., "Well Design with Expandable Tubulars Reduces Cost and Increases Success in Deepwater Applications," *Deep Offshore Technology,* 2000.
Duphorne, "Letter Re: Enventure Claims of Baker Infringement of Enventure's Expandable Patents," Apr. 1, 2005.
Enventure Global Technology, Solid Expandable Tubulars are Enabling Technology, *Drilling Contractor,* Mar.-Apr. 2001.
"Enventure Ready to Rejuvinate the North Sea," *Roustabout,* Sep. 2004.
Escobar et al., "Increasing Solid Expandable Tubular Technology Reliability in a Myriad of Downhole Environments," *Society of Petroleum Engineers,* SPE/IADC 81094, 2003.
"Expandable Casing Accesses Remote Reservoirs," *Petroleum Engineer International,* Apr. 1999.
Filippov et al., "Expandable Tubular Solutions," *Society of Petroleum Engineers,* SPE 56500, 1999.
"First ever SET Workshop Held in Aberdeen," *Roustabout,* Oct. 2004.
Fischer, "Expandables and the Dream of the Monodiameter Well: A Status Report", *World Oil,* Jul. 2004.
Fontova, "Solid Expandable Tubulars (SET) Provide Value to Operators Worldwide in a Variety of Applications," *EP Journal of Technology,* Apr. 2005.
Furlow, "Casing Expansion, Test Process Fine Tuned on Ultra-deepwater Well," *Offshore,* Dec. 2000.
Furlow, "Expandable Casing Program Helps Operator Hit TD With Larger Tubulars," *Offshore,* Jan. 2000.
Furlow, "Expandable Solid Casing Reduces Telescope Effect," *Offshore,* Aug. 1998.
Furlow, "Agbada Well Solid Tubulars Expanded Bottom Up, Screens Expanded Top Down," *Offshore,* 2002.
Grant et al., "Deepwater Expandable Openhole Liner Case Histories: Learnings Through Field Applications," *Offshore Technology Conference,* OCT 14218, 2002.
Gusevik et al., "Reaching Deep Reservoir Targets Using Solid Expandable Tubulars" *Society of Petroleum Engineers,* SPE 77612, 2002.
Haut et al., "Meeting Economic Challenges of Deepwater Drilling with Expandable-Tubular Technology," *Deep Offshore Technology Conference,* 1999.
Hull, "Monodiameter Technology Keeps Hole Diameter to TD," *Offshore* Oct. 2002.
"Innovators Chart the Course,".
Langley, "Case Study: Value in Drilling Derived From Application-Specific Technology," Oct. 2004.
Lohoefer et al., "Expandable Liner Hanger Provides Cost-Effective Alternative Solution," *Society of Petroleum Engineers,* IADC/SPE 59151, 2000.
Mack et al., "How in Situ Expansion Affects Casing and Tubing Properties," *World Oil,* Jul. 1999. pp. 69-71.
Mack et al., "In-Situ Expansion of Casing and Tubing—Effect on Mechanical Properties and Resistance to Sulfide Stress Cracking,".
Merritt, "Casing Remediation—Extending Well Life Through the Use of Solid Expandable Casing Systems,".
Merritt et al., "Well Remediation Using Expandable Cased-Hole Liners", *World Oil.,* Jul. 2002.
Merritt et al., "Well Remediation Using Expandble Cased-Hole Liners—Summary of Case Histories".
Moore et al., "Expandable Liner Hangers: Case Histories," *Offshore Technology Conference,* OTC 14313, 2002.
Moore et al., "Field Trial Proves Upgrades to Solid Expandable Tubulars," *Offshore Technology Conference,* OTC 14217, 2002.
News Release, "Shell and Halliburton Agree to Form Company to Develop and Market Expandable Casing Technology," Jun. 3, 1998.
Nor, et at., "Transforming Conventional Wells to Bigbore Completions Using Solid Expandable Tubular Technology," *Offshore Technology Conference,* OTC 14315, 2002.
Patin et al., "Overcoming Well Control Challenges with Solid Expandable Tubular Technology," *Offshore Technology Conference,* OTC 15152, 2003.
Ratliff, "Changing Safety Paradigms in the Oil and Gas Industry," *Society of Petroleum Engineers,* SPE 90828, 2004.
Rivenbark, "Expandable Tubular Technology—Drill Deeper, Farther, More Economically, " Enventure Global Technology.
Rivenbark et al., "Solid Expandable Tubular Technology: The Value of Planned Installation vs. Contingency," *Society of Petroleum Engineers,* SPE 90821, 2004.
Rivenbark et al., "Window Exit Sidetrack Enhancements Through the Use of Solid Expandable Casing," *Society of Petroleum Engineers,* IADC/SPE 88030, 2004.

Roca et al., "Addressing Common Drilling Challenges Using Solid Expandable Tubular Technology," *Society of Petroleum Engineers,* SPE 80446, 2003.
Sanders et al., "Practices for Providing Zonal Isolation in Conjunction with Expandable Casing Jobs—Case Histories," 2003.
Sanders et al., "Three Diverse Applications on Three Continents for a Single Major Operator," *Offshore Technology Conference,* OTC 16667, 2004.
"Set Technology: The Facts" 2004.
Siemers et al., "Development and Field Testing of Solid Expandable Corrosion Resistant Cased-hole Liners to Boost Gas Production in Corrosive Environments," *Offshore Technology Conference,* OTC 15149, 2003.
"Slim Well:Stepping Stone to MonoDiameter," *Hart's E&P,* Jun. 2003.
Smith, "Pipe Dream Reality," *New Technology Magazine,* Dec. 2003.
"Solid Expandable Tubulars," *Hart's E&P,* Mar. 2002.
Sparling et al., "Expanding Oil Field Tubulars Through a Window Demonstrates Value and Provides New Well Construction Option," *Offshore Technology Conference,* OTC 16664, 2004.
Sumrow, "Shell Drills World's First Monodiameter Well in South Texas," *Oil and Gas,* Oct. 21, 2002.
Touboul et al., "New Technologies Combine to Reduce Drilling Cost in Ultradeepwater Applications," *Society of Petroleum Engineers,* SPE 90830, 2004.
Van Noort et al., "Using Solid Expandable Tubulars for Openhole Water Shutoff," *Society of Petroleum Engineers,* SPE 78495, 2002.
Van Noort et al., "Water Production Reduced Using Solid Expandable Tubular Technology to "Clad," in Fractured Carbonate Formation" *Offshore Technology Conference,* OTC 15153, 2003.
Von Flatern, "From Exotic to Routine—the Offshore Quick-step," *Offshore Engineer,* Apr. 2004.
Von Flatern, "Oilfield Service Trio Target Jules Verne Territory," *Offshore Engineer,* Aug. 2001.
Waddell et al., "Advances in Single-diameter Well Technology: The Next Step to Cost-Effective Optimization," *Society of Petroleum Engineers,* SPE 90818, 2004.
Waddell et al., "Installation of Solid Expandable Tubular Systems Through Milled Casing Windows," *Society of Petroleum Engineers,* IADC/SPE 87208, 2004.
Williams, "Straightening the Drilling Curve," *Oil and Gas Investor,* Jan. 2003.
www.Mitchmet.com, "3d Surface Texture Parameters," 2004.
"Expand Your Opportunities." *Enventure*. CD-ROM. Jun. 1999.
"Expand Your Opportunities." *Enventure*. CD-ROM. May 2001.
Search Report to Application No. GB 0415835.8, Mar. 10, 2005.
Search and Examination Report to Application No. GB 0425948.7, Apr. 14, 2005.
Search and Examination Report to Application No. GB 0425951.1, Apr. 14, 2005.
Search and Examination Report to Application No. GB 0425956.0, Apr. 14, 2005.
Search and Examination Report to Application No. GB 0500600.2, Feb. 15, 2005.
Search and Examination Report to Application No. GB 0503470.7, Mar. 21, 2005.
Search and Examination Report to Application No. GB 0505039.8, Jul. 22, 2005.
Search and Examination Report to Application No. GB 0506697.2, May 20, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Examination Report to Application No. GB 0400018.8, May 17, 2005.
Examination Report to Application No. GB 0400019.6, May 19, 2005.
Examination Report to Application No. GB 0400019.6, Sep. 2, 2005.
Examination Report to Application No. GB 0403891.5, Jun. 30, 2005.
Examination Report to Application No. GB 0403893.1, Feb. 14, 2005.
Examination Report to Application No. GB 0403920.2, Feb. 15, 2005.
Examination Report to Application No. GB 0404796.5, Apr. 14, 2005.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0408672.4, Mar. 21, 2005.
Examination Report to Application No. GB 0412533.2, May 20, 2005.
Examination Report to Application No. GB 0428141.6, Sep. 15, 2005.
Examination Report to Application No. GB 0500184.7, Sep. 12, 2005.
Examination Report to Application No. GB 0500600.2, Sep. 6, 2005.
Examination Report to Application No. GB 0501667.0, May 27, 2005.
Examination Report to Application No. GB 0503470.7, Sep. 22, 2005.
Examination Report to Application No. GB 0506699.8, Sep. 21, 2005.
Examination Report to Application No. GB 0507979.3, Jun. 16, 2005.
Mohawk Energy, :Minimizing Drilling Ecoprints Houston, Dec. 16, 2005.
International Preliminary Examination Report, Application PCT/US01/28690, Sep. 4, 2003.
International Preliminary Examination Report, Application PCT/US03/15020 (corrected), Nov. 14, 2004.
International Preliminary Report on Patentability, Application PCT/US04/00631, Mar. 2, 2006.
International Preliminary Report on Patentability, Application PCT/US04/04740, Jun. 27, 2006.
International Preliminary Report on Patentability, Application PCT/US04/10317, Jun. 23, 2006.
International Preliminary Report on Patentability, Application PCT/US04/028428, Mar. 9, 2006.
International Preliminary Report on Patentability, Application PCT/US04/028423, Jun. 19, 2006.
Combined Search Report and Written Opinion to Application No. PCT/US04/00631, Mar. 28, 2005.
Combined Search Report and Written Opinion to Application No. PCT/US04/28831, Dec. 19, 2005.
Combined Search Report and Written Opinion to Application No. PCT/US04/28889, Nov. 14, 2005.
Combined Search Report and Written Opinion to Application No. PCT/US05/28869, Apr. 17, 2006.
Search Report to Application No. GB 0507980.1, Apr. 24, 2006.
Examination Report to Application No. GB 0219757.2, Oct. 31, 2004.
Examination Report to Application No. GB 03701281.2, Jan. 31, 2006.
Examination Report to Application No. GB 0400019.6, Nov. 4, 2005.
Examination Report to Application No. GB 0406257.6, Nov. 9, 2005.

Examination Report to Application No. GB 0406258.4, Dec. 20, 2005.
Examination Report to Application No. GB 0412876.5, Feb. 13, 2006.
Examination Report to Application No. GB 0415835.8, Dec. 23, 2005.
Examination Report to Application No. GB 0422419.2, Nov. 8, 2005.
Examination Report to Application No. GB 0422893.8, Aug. 8, 2005.
Examination Report to Application No. GB 0422893.8, Dec. 15, 2005.
Examination Report to Application No. GB 0425948.7, Nov. 24, 2005.
Examination Report to Application No. GB 0425956.0, Nov. 24, 2005.
Examination Report to Application No. GB 0500275.3, Apr. 5, 2006.
Examination Report to Application No. GB 0501667.0, Jan. 27, 2006.
Examination Report to Application No. GB 0503250.3, Nov. 15, 2005.
Examination Report to Application No. GB 0503250.3, Mar. 2, 2006.
Examination Report to Application No. GB 0506699.8, May 11, 2006.
Examination Report to Application No. GB 0506700.4, May 16, 2006.
Examination Report to Application No. GB 0506702.0, May 11, 2006.
Examination Report to Application No. GB 0507979.3, Jan. 17, 2006.
Examination Report to Application No. GB 0507979.3, Jun. 6, 2006.
Examination Report to Application No. GB 0507980.1, Sep. 29, 2005.
Examination Report to Application No. GB 0509618.5, Feb. 3, 2006.
Examination Report to Application No. GB 0509620.1, Feb. 14, 2006.
Examination Report to Application No. GB 0509627.6, Feb. 3, 2006.
Examination Report to Application No. GB 0509629.2, Feb. 3, 2006.
Examination Report to Application No. GB 0509630.0, Feb. 3, 2006.
Examination Report to Application No. GB 0509630.0, May 11, 2006.
Examination Report to Application No. GB 0509630.0, Jun. 6, 2006.
Examination Report to Application No. GB 0509631.8, Feb. 14, 2006.
Examination Report to Application No. GB 0517448.7, Nov. 9, 2005.
Examination Report to Application No. GB 0518025.2, Oct. 27, 2005.
Examination Report to Application No. GB 0518025.2, May 25, 2006.
Examination Report to Application No. GB 0518039.3, Nov. 29, 2005.
Examination Report to Application No. GB 0518252.2, Oct. 28, 2005.
Examination Report to Application No. GB 0518252.2, May 25, 2006.
Examination Report to Application No. GB 0518799.2, Nov. 9, 2005.
Examination Report to Application No. GB 0518799.2, Jun. 14, 2006.
Examination Report to Application No. GB 0518893.3, Dec. 16, 2005.
Examination Report to Application No. GB 0519989.8, Mar. 8, 2006.
Examination Report to Application No. GB 0521024.0, Dec. 22, 2005.
Examination Report to Application No. GB 0522050.4, Dec. 13, 2005.
Examination Report to Application No. GB 0602877.3, Mar. 20, 2006.
Examination Report to Application No. GB 0603576.0, Apr. 5, 2006.
Examination Report to Application No. GB 0603656.0, May 3, 2006.
Examination Report to Application No. GB 0603995.2, Apr. 25, 2006.
Examination Report to Application No. GB 0603996.0, Apr. 27, 2006.
Examination Report to Application No. GB 0604357.4, Apr. 27, 2006.
Examination Report to Application No. GB 0604359.0, Apr. 27, 2006.
Examination Report to Application No. GB 0604360.8, Apr. 26, 2006.
Search and Examination Report to Application No. GB 0412876.5, Sep. 27, 2005.
Search and Examination Report to Application No. GB 0516429.8, Nov. 7, 2005.
Search and Examination Report to Application No. GB 0516430.6, Nov. 8, 2005.
Search and Examination Report to Application No. GB 0516431.4, Nov. 8, 2005.
Search and Examination Report to Application No. GB 0522155.1, Mar. 7, 2006.
Search and Examination Report to Application No. GB 0522892.9 Jan. 5, 2006.
Search and Examination Report to Application No. GB 0523075.0, Jan. 12, 2006.
Search and Examination Report to Application No. GB 0523076.8, Dec. 14, 2005.
Search and Examination Report to Application No. GB 0523078.4, Dec. 13, 2005.
Search and Examination Report to Application No. GB 0523132.9, Jan. 12, 2006.
Search and Examination Report to Application No. GB 0524692.1, Dec. 19, 2005.
Search and Examination Report to Application No. GB 0525768.8, Feb. 3, 2006.
Search and Examination Report to Application No. GB 0525770.4, Feb. 3, 2006.
Search and Examination Report to Application No. GB 0525772.0, Feb. 2, 2006.
Search and Examination Report to Application No. GB 0525774.6, Feb. 2, 2006.
Examination Report to Application No. AU 2003257878, Jan. 19, 2006.
Examination Report to Application No. AU 2003257878, Jan. 30, 2006.
Examination Report to Application No. AU 2003257881, Jan. 19, 2006.
Examination Report to Application No. AU 2003257881, Jan. 30, 2006.
Examination Report to Application No. AU 2004202805, Jun. 14, 2006.
Examination Report to Application No. AU 2004202809, Jun. 14, 2006.
Examination Report to Application No. AU 2004202812, Jun. 14, 2006.
Examination Report to Application No. AU 2004202813, Jun. 14, 2006.
Examination Report to Application No. AU 2004202815, Jun. 14, 2006.
Search Report to Application No. EP 03071281.2; Nov. 7, 2005.
Search Report to Application No. EP 03071281.2; Nov. 14, 2005.
Search Report to Application No. EP 03723674.2; Nov. 22, 2005.
Search Report to Application No. EP 03723674.2; May 2, 2006.
Search Report to Application No. EP 03728326.4; Mar. 13, 2006.
Search Report to Application No. EP 03728326.4; Apr. 24, 2006.
Search Report to Application No. EP 03752486.5; Feb. 8, 2006.
Search Report to Application No. EP 03759400.9; Mar. 3, 2006.
Search Report to Application No. EP 03759400.9; Mar. 24, 2006.
Search Report to Application No. EP 03793078.1; Mar. 21, 2006.
Search Report to Application No. EP 03793078.1; Jun. 16, 2006.
Examination Report to Application No. Norway 2002 1613, May 13, 2006.
Enventure Global Technology, "SET Technology: The Facts," 2004.
Flatern, "Oilfield Service Trio Target Jules Verne Territory," at http://www.oilonline.com.
Harris, "Tube Welding." At http://www.tubenet.org.uk.technical.ewi.html.
"Pipeline Rehabilitation by Sliplining with Polyethylene Pipe" 2006.
Tumey, "Letter: IP Analysis" May 6, 2006.

www.Rigzone.com/news/article.asp?a_id=1755, "Tesco Provides Casing Drilling Operations Update," 2001.
www.Rigzone.com/news/article.asp?a_id=2603, Conoco and Tesco Unveil Revolutionary Drilling Rig 2002.
International Preliminary Report on Patentability, Application PCT/US04/11973, Dec. 26, 2006.
International Preliminary Report on Patentability, Application PCT/US04/28887, Sep. 26, 2006.
International Preliminary Report on Patentability, Application PCT/US04/28889, Aug. 1, 2006.
International Preliminary Report on Patentability, Application PCT/US05/28642. Feb. 22, 2007.
International Preliminary Report on Patentability, Application PCT/US05/28819. Feb. 12, 2007.
Written Opinion to Application No. PCT/US04/29025, Jan. 4, 2007.
Combined Search Report and Written Opinion to Application No. PCT/US04/07711, Nov. 28, 2006.
Combined Search Report and Written Opinion to Application No. PCT/US04/26345, Oct. 5, 2006.
Combined Search Report and Written Opinion to Application No. PCT/US05/28473, Sep. 1, 2006.
Combined Search Report and Written Opinion to Application No. PCT/US05/28642, Jul. 14, 2006.
Combined Search Report and Written Opinion to Application No. PCT/US05/28819, Aug. 3, 2006.
Combined Search Report and Written Opinion to Application No. PCT/US05/28846, Oct. 27, 2006.
Combined Search Report and Written Opinion to Application No. PCT/US06/02449, Oct. 24, 2006.
Combined Search Report and Written Opinion to Application No. PCT/US06/04809, Aug. 29, 2006.
Combined Search Report and Written Opinion to Application No. PCT/US06/09886, Dec. 4, 2006.
Examination Report to Application No. GB 0428141.6, Feb. 21, 2006.
Examination Report to Application No. GB 0428141.6, Jul. 18, 2006.
Examination Report to Application No. GB 0503250.3, Aug. 11, 2006.
Examination Report to Application No. GB 0506702.0, Jul. 24, 2006.
Examination Report to Application No. GB 0517448.7, Jul. 19, 2006.
Examination Report to Application No. GB 0518039.3, Aug. 2, 2006.
Examination Report to Application No. GB 0518893.3, Jul. 28, 2006.
Examination Report to Application No. GB 0518893.3, Jan. 29, 2007.
Examination Report to Application No. GB 0519989.8, Oct. 6, 2006.
Examination Report to Application No. GB 0521931.6, Nov. 8, 2006.
Examination Report to Application No. GB 0522892.9, Aug. 14, 2006.
Examination Report to Application No. GB 0603576.0, Nov. 9, 2006.
Examination Report to Application No. GB 0603656.0, Nov. 10, 2006.
Examination Report to Application No. GB 0609173.0, Feb. 6, 2007.
Search and Examination Report to Application No. GB 0507980.1, Jun. 20, 2006.
Search and Examination Report to Application No. GB 0522049.6, Jul. 13, 2006.
Search and Examination Report to Application No. GB 0522052.0, Aug. 8, 2006.
Search and Examination Report to Application No. GB 0602877.3, Sep. 25, 2006.
Search and Examination Report to Application No. GB 0609173.0, Jul. 19, 2006.
Search and Examination Report to Application No. GB 0613405.0, Nov. 2, 2006.
Search and Examination Report to Application No. GB 0613406.8, Nov. 2, 2006.
Search and Examination Report to Application No. GB 0614415.8, Oct. 26, 2006.
Search and Examination Report to Application No. GB 0621053.0, Dec. 18, 2006.
Search and Examination Report to Application No. GB 0621054.6, Dec. 18, 2006.
Search and Examination Report to Application No. GB 0621055.3, Dec. 18, 2006.
Search and Examination Report to Application No. GB 0621059.5, Dec. 18, 2006.
Search and Examination Report to Application No. GB 06210560.3, Dec. 18, 2006.
Search and Examination Report to Application No. GB 0621062.9, Dec. 18, 2006.
Search and Examination Report to Application No. GB 0624328.1, Feb. 2, 2007.
Examination Report to Application No. AU 2001278196, Sep. 4, 2006.
Examination Report to Application No. EP 03752489.5; Jun. 28, 2006.
Examination Report to Application No. Norway 1999 5593,Feb. 15, 2002.
Examination Report to Application No. Norway 20020070, Jan. 24, 2007.
Examination Report to Application No. Norway 20002876, Sep. 20, 2006.
Examination Report to Application No. Norway 20023885, May 29, 2006.
Examination Report To Application No. Canada 2298139, Nov. 15, 2006.
Examination Report to Application No. Canada 2383231, Feb. 7, 2007.
Examination Report to Application No. Canada 2419806, Jan. 24, 2007.
Examination Report to Application No. Canada 2432030, Jan. 30, 2007.
Examination Report to Application No. Canada 2438807, Jan. 24, 2007.
Examination Report to Application No. Canada 2517524, Jan. 30, 2007.
Examination Report To Application No. CN 02827985.9, Mar. 1, 2007.

312b
312
312a
332
359
314
300

312c
316
54
56
326
326a 320
330a
330
362

338
342
360
350
344
340

312b
312
312a
332
358
314
300
312c 316
54
56
326
326a 360d
320
360c
330a
330
360b
362
360a
338

342
360
350
344
340

APPARATUS FOR RADIALLY EXPANDING AND PLASTICALLY DEFORMING A TUBULAR MEMBER

CROSS-REFERENCE TO RELATED APPLICATIONS

This application is a CIP of U.S. utility patent application Ser. No. 10/418,687, filed on Apr. 18, 2003, which is a continuation of U.S. utility patent application Ser. No. 09/852,026, filed on May 9, 2001, now U.S. Pat. No. 6,561,227 issued May 13, 2003, which is a division of U.S. utility patent application Ser. No. 09/454,139, filed on Dec. 3, 1999, now U.S. Pat. No. 6,497,289 issued Dec. 24, 2002, which claimed the benefit of the filing date of U.S. provisional patent application Ser. No. 60/111,293, filed on Dec. 7, 1998, the disclosures of which are incorporated herein by reference.

This application is related to the following co-pending applications: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov., 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7. 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jun. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S.

patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 2, 2002, which is a divisional of U.S. Pat. No. 6,557,640, which was filed as patent application Ser. No. 09/588, 946, filed on Jun. 7, 2000, which claims priority from provisional application 60/137,998, filed on Jun. 7, 1999, (72) U.S. patent application Ser. No. 10/261,925, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2002, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2002, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 3, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, attorney filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application serial no. PCT/US04/06246, filed on Feb. 26, 2004, (123) PCT patent application Ser. No. PCT/US04/08170, filed on Mar. 15, 2004, (124) PCT patent application Ser. No. PCT/US04/08171, filed on Mar. 15, 2004, (125) PCT patent application Ser. No. PCT/US04/08073, filed on Mar. 18, 2004, (126) PCT patent application Ser. No. PCT/US04/07711, filed on Mar. 11, 2004, (127) PCT patent application Ser. No. PCT/US2004/009434, filed on Mar. 26, 2004, (128) PCT patent application Ser. No. PCT/US2004/010317, filed on Apr. 2, 2004, (129) PCT patent application Ser. No. PCT/US2004/010712, filed on Apr. 7, 2004, (130) PCT patent application Ser. No. PCT/US2004/010762, filed on Apr. 6, 2004, (131) PCT patent application Ser. No. PCT/US2004/011973, filed on Apr. 15, 2004, (132) U.S. provisional patent application Ser. No. 60/495,056, filed on Aug. 14, 2003, (133) U.S. Provisional patent application Ser. No. 60/600,679, filed on Aug. 11, 2004, (134) PCT patent application Ser. No. PCT/US2004/028887, filed on Sep. 7, 2004, (134) PCT patent application Ser. No. PCT/US2004/028888, filed on Sep. 7, 2004, (135) PCT patent application Ser. No. PCT/US2004/029025, filed on Sep. 7, 2004, (136) PCT patent application Ser. No. PCT/US2004/028889, filed on Sep. 7, 2004, (138) PCT patent application Ser. No. PCT/US2004/028831, filed on Sep. 7, 2004, (139) U.S. Provisional patent application Ser. No. 60/631,703, filed on Nov. 30, 2004, the disclosures of which are incorporated herein by reference.

BACKGROUND OF THE INVENTION

This invention relates generally to oil and gas exploration, and in particular to forming and repairing wellbore casings to facilitate oil and gas exploration.

SUMMARY OF THE INVENTION

According to one aspect of the present invention, an apparatus for radially expanding and plastically deforming an expandable tubular member is provided that includes a first tubular support defining an internal passage and one or more radial passages; a tubular expansion cone coupled to the first tubular support and comprising an external expansion surface wherein the tubular expansion cone and the first tubular support are adapted to extend within the expandable tubular member so that the expandable tubular member is coupled to the external expansion surface of the tubular expansion cone; a second tubular support coupled to the first tubular support and defining an internal passage; a third tubular support coupled to the second tubular support so that the third tubular support at least partially extends within the second tubular support; and a fourth tubular support coupled to the second tubular support so that the second tubular support at least partially extends within the fourth tubular support; wherein the tubular expansion cone and the first, second, third and fourth tubular supports are movable relative to the expandable tubular member when the first tubular support and the tubular expansion cone extend within the expandable tubular member.

According to another aspect another aspect of the present invention, an apparatus for radially expanding and plastically deforming an expandable tubular member is provided that includes a first tubular support defining an internal passage and one or more radial passages; one or more rupture discs coupled to and positioned within corresponding radial passages of the first tubular support; a tubular expansion cone coupled to the first tubular support and comprising an external expansion surface; the expandable tubular member coupled to the external expansion surface of the tubular expansion cone and defining an internal passage; a second tubular support at least partially extending within the first tubular support and defining an internal passage; and an annular region at least partially defined by the internal surface of first tubular support and the external surface of the second tubular support wherein the internal passage of the second tubular support is in fluid communication with the annular region; wherein, when the one or more rupture discs rupture, the internal passage of the second tubular support is in fluid communication with the internal passage of the expandable tubular member via the annular region and the one or more radial passages of the first tubular support.

According to another aspect of the present invention, a system is provided that includes a tubular member defining an internal passage and adapted to extend within a preexisting structure; and means for radially expanding and plastically deforming the tubular member within the preexisting structure, the means comprising a shoe coupled to the tubular member, the shoe comprising an annular portion at least partially extending into the internal passage of the tubular member and defining an internal passage and a plug seat having an internal shoulder; and a plug element adapted to extend into the internal passage of the annular portion, the plug element defining an increased-diameter portion adapted to sealingly engage the internal shoulder of the plug seat, the plug element comprising a first sealing element extending in an annular channel formed in an external surface of the plug element and adapted to sealingly engage the plug seat; and a second sealing element in a spaced relation from the first sealing element and adapted to sealingly engage the plug seat.

According to another aspect of the present invention, a system is provided that includes a tubular member adapted to extend within a preexisting structure; and means for radially expanding and plastically deforming the tubular member within the preexisting structure; wherein the means comprises a shoe coupled to the tubular member, the shoe comprising a first component composed of a first material having a first material hardness, and a second component coupled to the first component and composed of a second material having a second material hardness.

According to another aspect of the present invention, an apparatus for radially expanding and plastically deforming an expandable tubular member is provided that includes a first tubular support defining an internal passage and one or more radial passages having countersunk portions; a tubular expansion cone coupled to the first tubular support and comprising an external expansion surface; the expandable tubular member coupled to the external expansion surface of the tubular expansion cone and defining an internal passage; one or more rupture discs coupled to and positioned within corresponding radial passages of the first tubular support wherein each of the one or more rupture discs is in the form of an annular body member defining an internal passage and comprises a shoulder defined at an end portion of the annular body member and contacting a wall defined by the countersunk portion of the corresponding radial passage; a threaded connection formed in the external surface of the annular body member and extending within the corresponding radial passage to couple the annular body member to the corresponding radial passage; a sealing element extending around the annular body member and sealingly engaging a surface of the corresponding radial passage, the sealing element axially positioned between the shoulder and the threaded connection; and a rupture element disposed in the internal passage of the annular body member wherein, when the rupture element ruptures, the internal passage of the first tubular support is in fluid communication with the internal passage of the expandable tubular member via the corresponding radial passage.

According to another aspect of the present invention, an apparatus for radially expanding and plastically deforming an expandable tubular member is provided that includes a first tubular support defining an internal passage and one or more radial passages; a tubular expansion cone coupled to the first tubular support and comprising an external expansion surface wherein the tubular expansion cone and the first tubular support are adapted to extend within the expandable tubular member and are moveable relative thereto; a second tubular support coupled to the first tubular support and defining an internal passage; a third tubular support coupled to the second tubular support so that the third tubular support at least partially extends within the second tubular support; and a sealing element comprising: an elastomeric element extending in a first annular channel formed in the external surface of the third tubular support wherein the elastomeric element sealingly engages the internal surface of the second tubular support, and a retainer extending in a second annular channel formed in the elastomeric element and biased against one or more walls of the second annular channel to retain the elastomeric element within the first annular channel.

According to another aspect of the present invention, an apparatus for radially expanding and plastically deforming an expandable tubular member is provided that includes a first tubular support; a tubular expansion cone coupled to the first tubular support and comprising an external expansion surface; the expandable tubular member coupled to the external expansion surface of the tubular expansion cone wherein the expandable tubular member comprises a first portion and a second portion wherein the inside diameter of the first portion is less than the inside diameter of the second portion, and wherein a dimension is defined between an end of the expandable tubular member corresponding to an end of the first portion and an end of the external expansion surface of the tubular expansion cone having a circumference substantially corresponding to the inside diameter of the second portion; a shoe defining one or more internal passages coupled to the second portion of the expandable tubular member; and means for maintaining the value of the dimension substantially constant when the length of the expandable tubular member is reduced.

According to another aspect of the present invention, a method of radially expanding and plastically deforming an expandable tubular member within a preexisting structure is provided that includes coupling a tubular expansion cone to a first tubular support; coupling a second tubular support to the first tubular support; coupling a third tubular support to the second tubular support so that the third tubular support at least partially extends within the second tubular support; and coupling a fourth tubular support to the second tubular support so that the second tubular support at least partially extends within the fourth tubular support; wherein the tubular expansion cone and the first, second, third and fourth tubular supports are movable relative to the expandable tubular member.

According to another aspect of the present invention, a method of radially expanding and plastically deforming an expandable tubular member within a preexisting structure is provided that includes coupling one or more rupture discs to and positioning the one or more rupture discs within corresponding one or more radial passages defined by a first tubular support; coupling a tubular expansion cone to the first tubular support so that an external expansion surface of the tubular expansion cone is coupled to the expandable tubular member wherein the expandable tubular member defines an internal passage; extending a second tubular support defining an internal passage within the first tubular support so that an annular region is defined by the external surface of the second tubular support and the internal surface of the first tubular support wherein the annular region is in fluid communication with the internal passage of the second tubular support; and displacing the tubular expansion cone and the first tubular support relative to the expandable tubular member wherein the step of displacing comprises permitting fluidic-material flow from the internal passage of the second tubular support and to the internal passage of the expandable tubular member.

According to another aspect of the present invention, a method is provided that includes inserting an expandable tubular member into a preexisting structure; and radially expanding and plastically deforming the expandable tubular member within the preexisting structure wherein the step of radially expanding and plastically deforming comprises coupling a shoe defining at least one internal passage and a plug seat to the expandable tubular member; and sealingly engaging a plug element with the plug seat so that fluidic-material flow through the at least one internal passage of the shoe is blocked, the step of sealingly engaging the plug element with the plug seat comprising sealingly engaging an increased-diameter portion of the plug element with an internal shoulder defined by the plug seat; sealingly engaging a first sealing element extending in an annular channel formed in an external surface of the plug element with the plug seat; and sealingly engaging a second sealing element in a spaced relation from the first sealing element with the plug seat.

DETAILED DESCRIPTION OF THE ILLUSTRATIVE EMBODIMENTS

Figure 1:
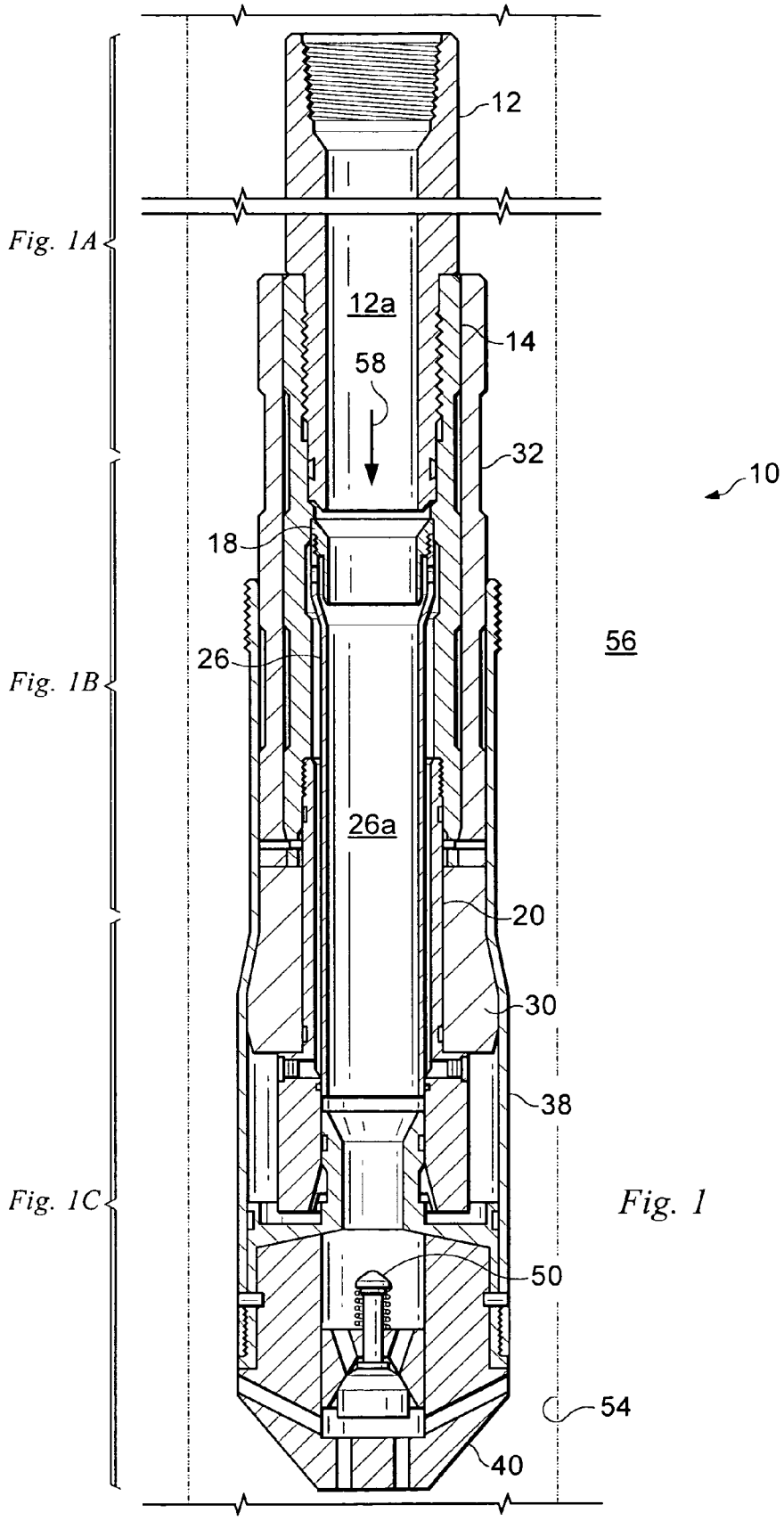
FIGS. 1, 1*a*, 1*b* and 1*c* are fragmentary cross-sectional illustrations of an embodiment of an apparatus for radially expanding and plastically deforming a tubular member during the placement of the apparatus within a wellbore.
Figure 1A:
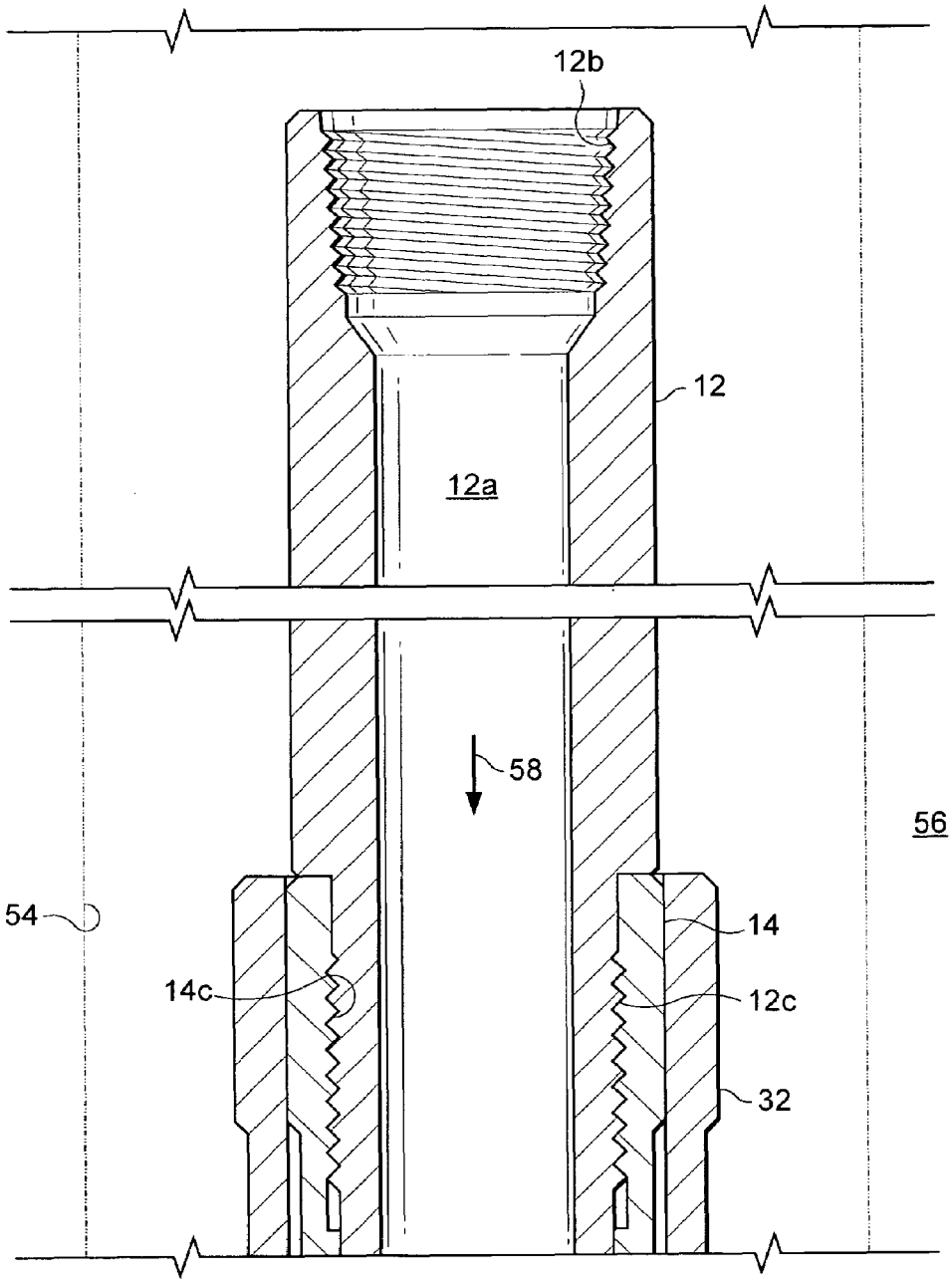
Figure 1B:
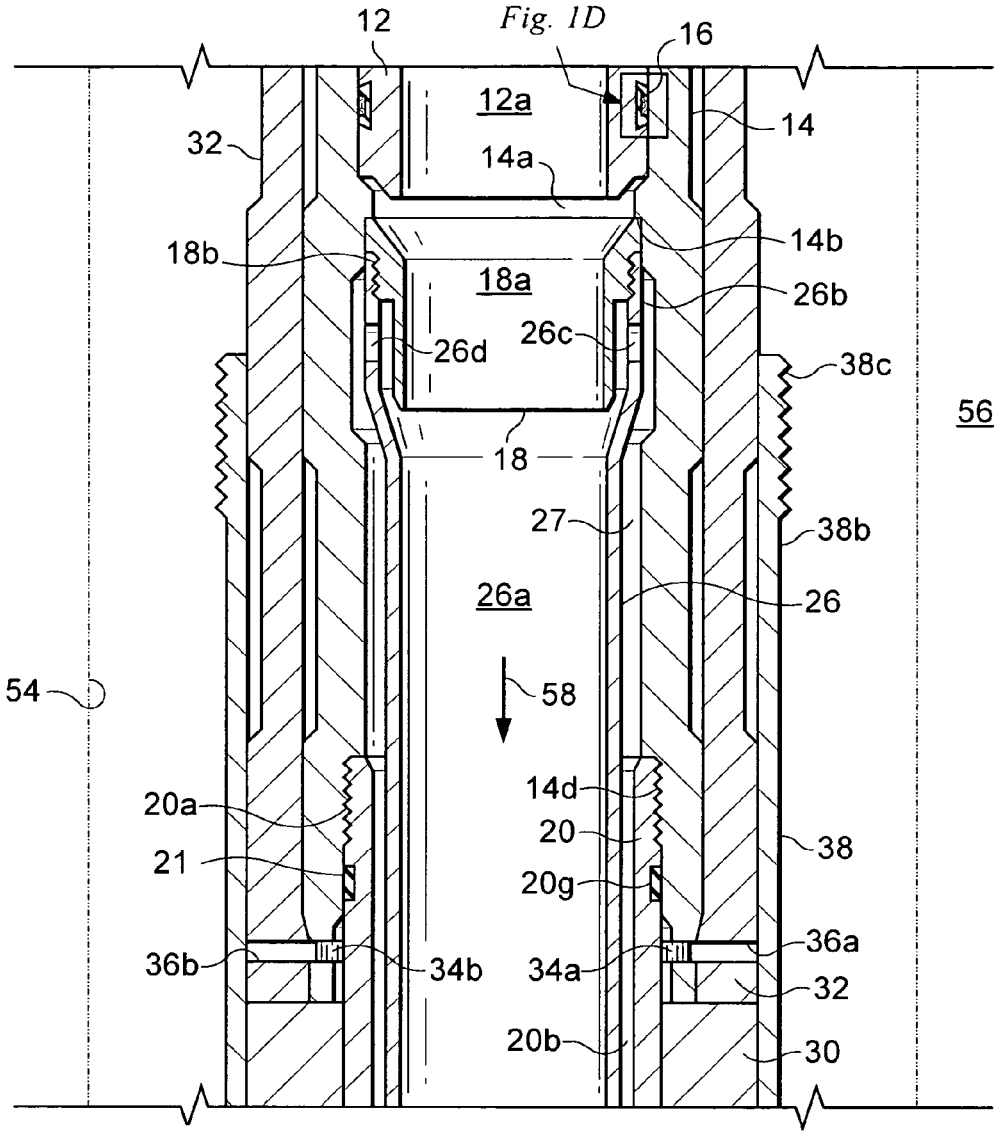
Figure 1D:
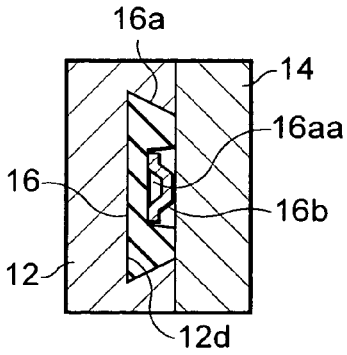
FIGS. 1*d* and 1*e* are enlarged views of portions of the apparatus of FIGS. 1, 1*a*, 1*b* and 1*c*.
Figure 1E:
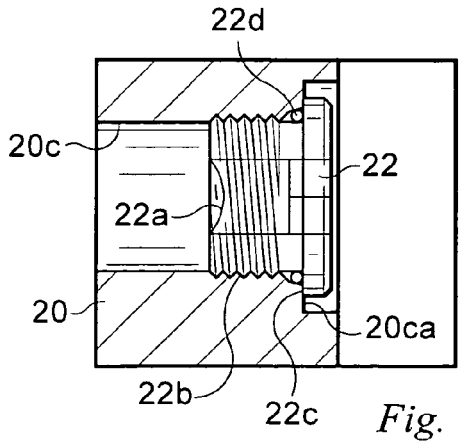
Figure 1C:
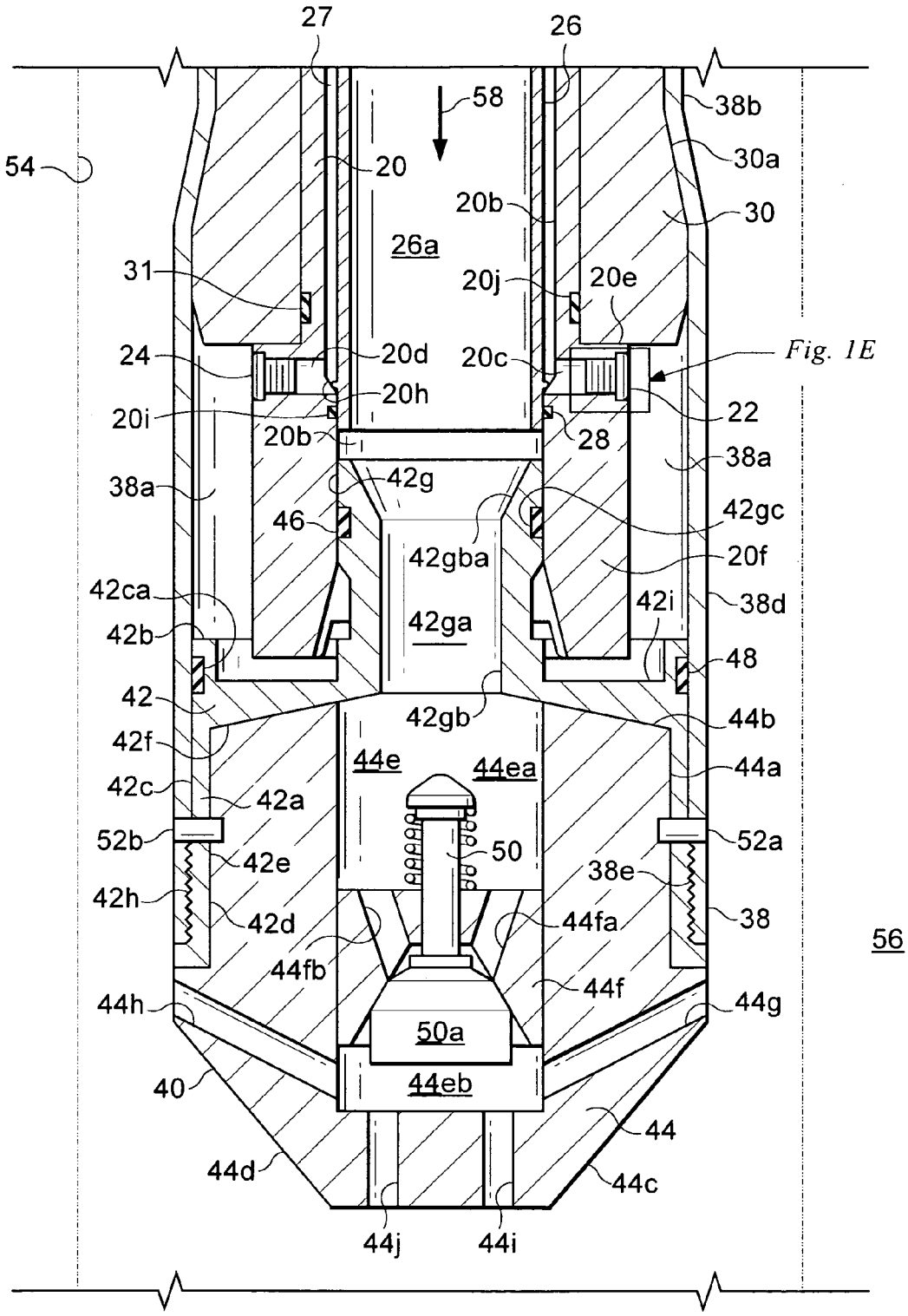
Figure 2:
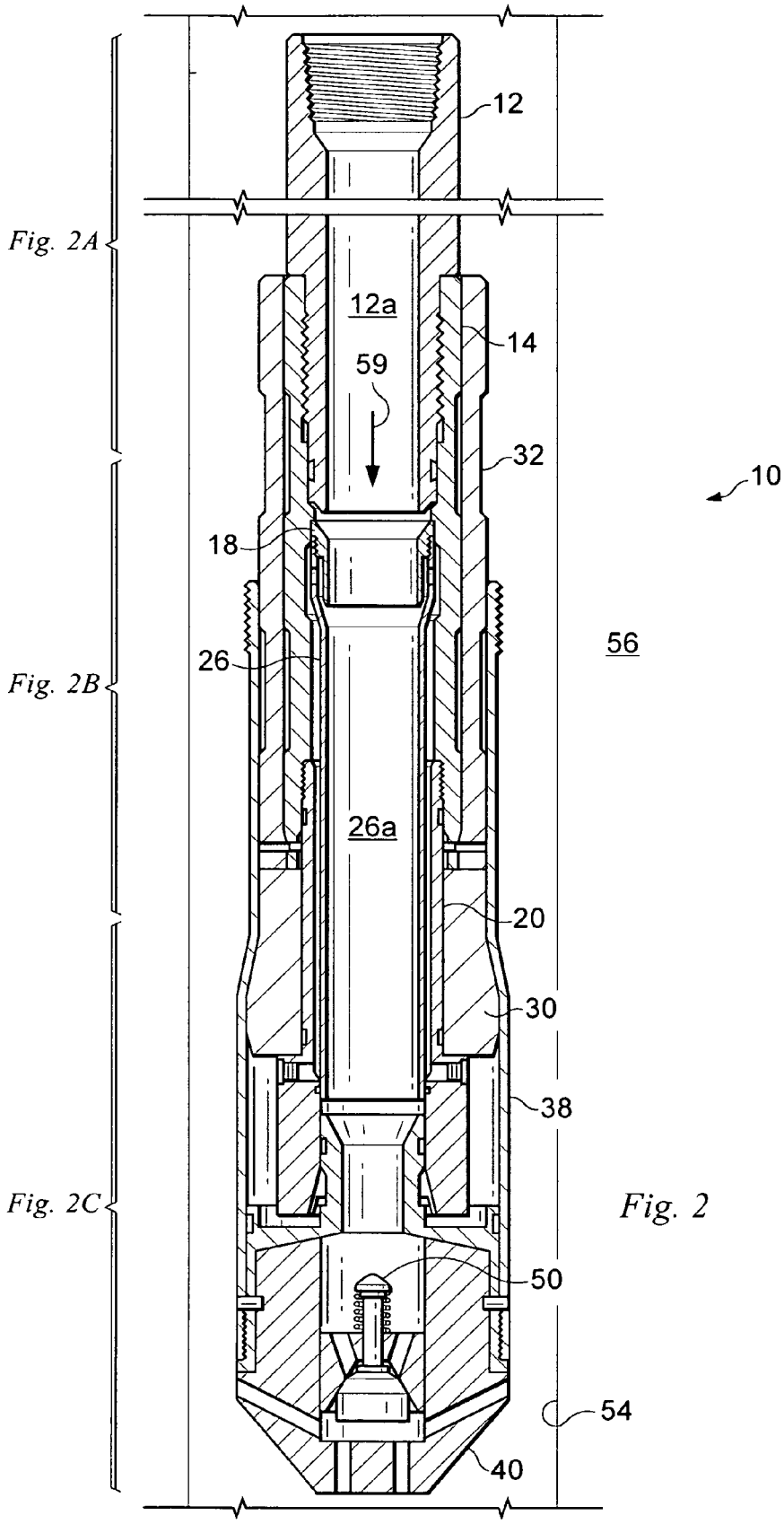
FIGS. 2, 2*a*, 2*b* and 2*c* are fragmentary cross-sectional illustrations of the apparatus of FIGS. 1, 1*a*, 1*b* and 1*c* during the injection of a hardenable fluidic sealing material into an annulus between the exterior of the apparatus and the wellbore.
Figure 2A:
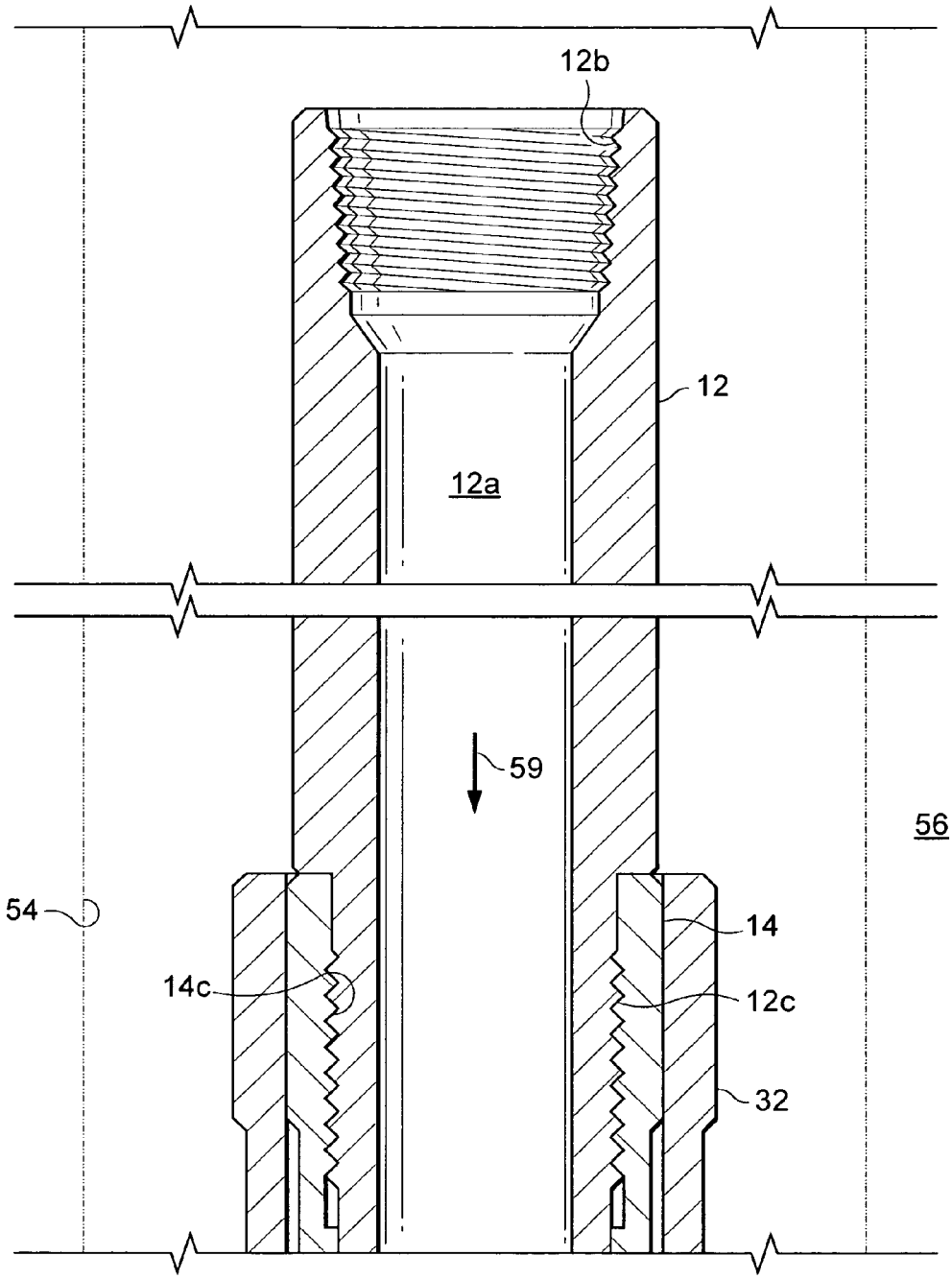
Figure 2B:
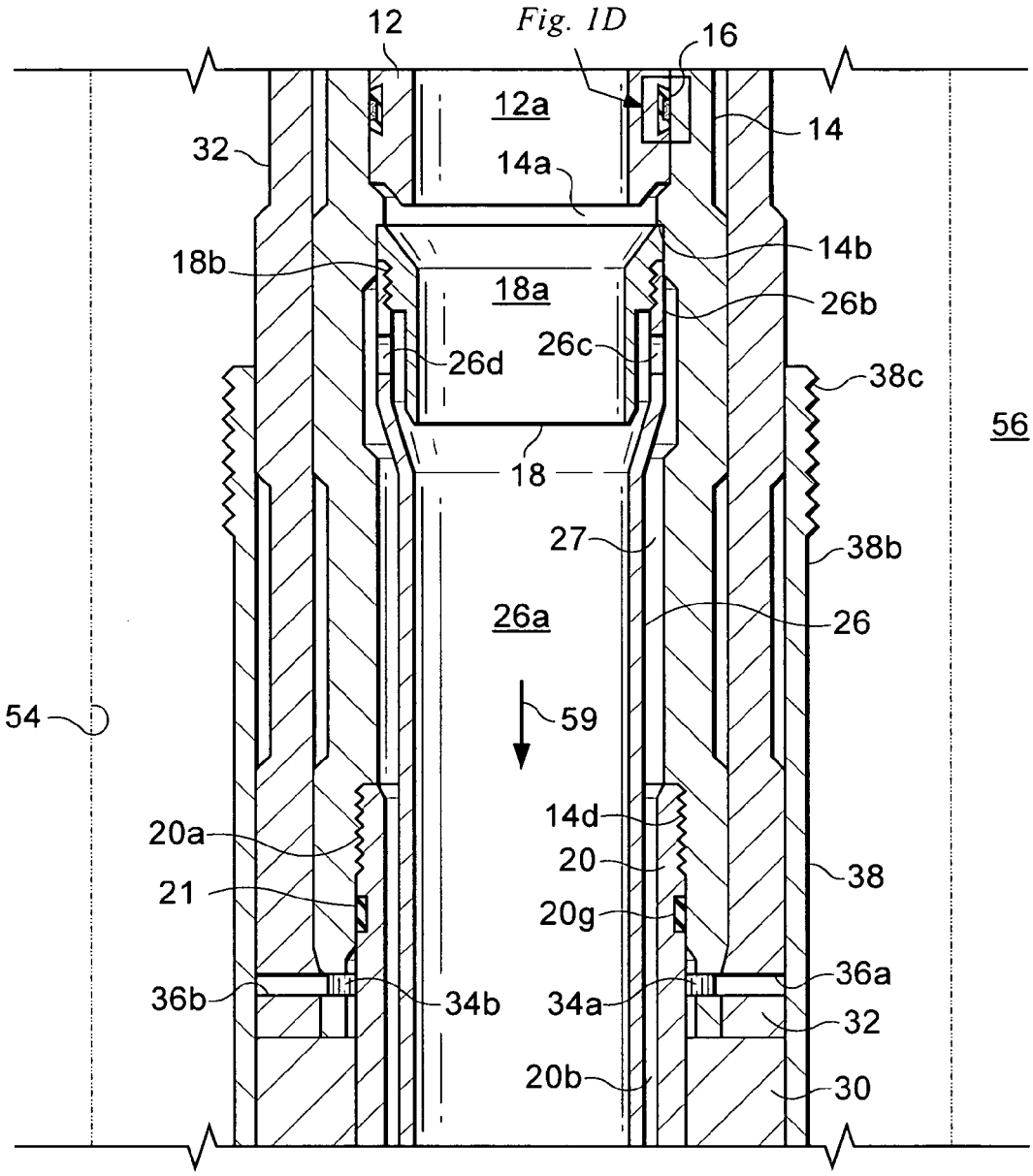
Figure 2C:
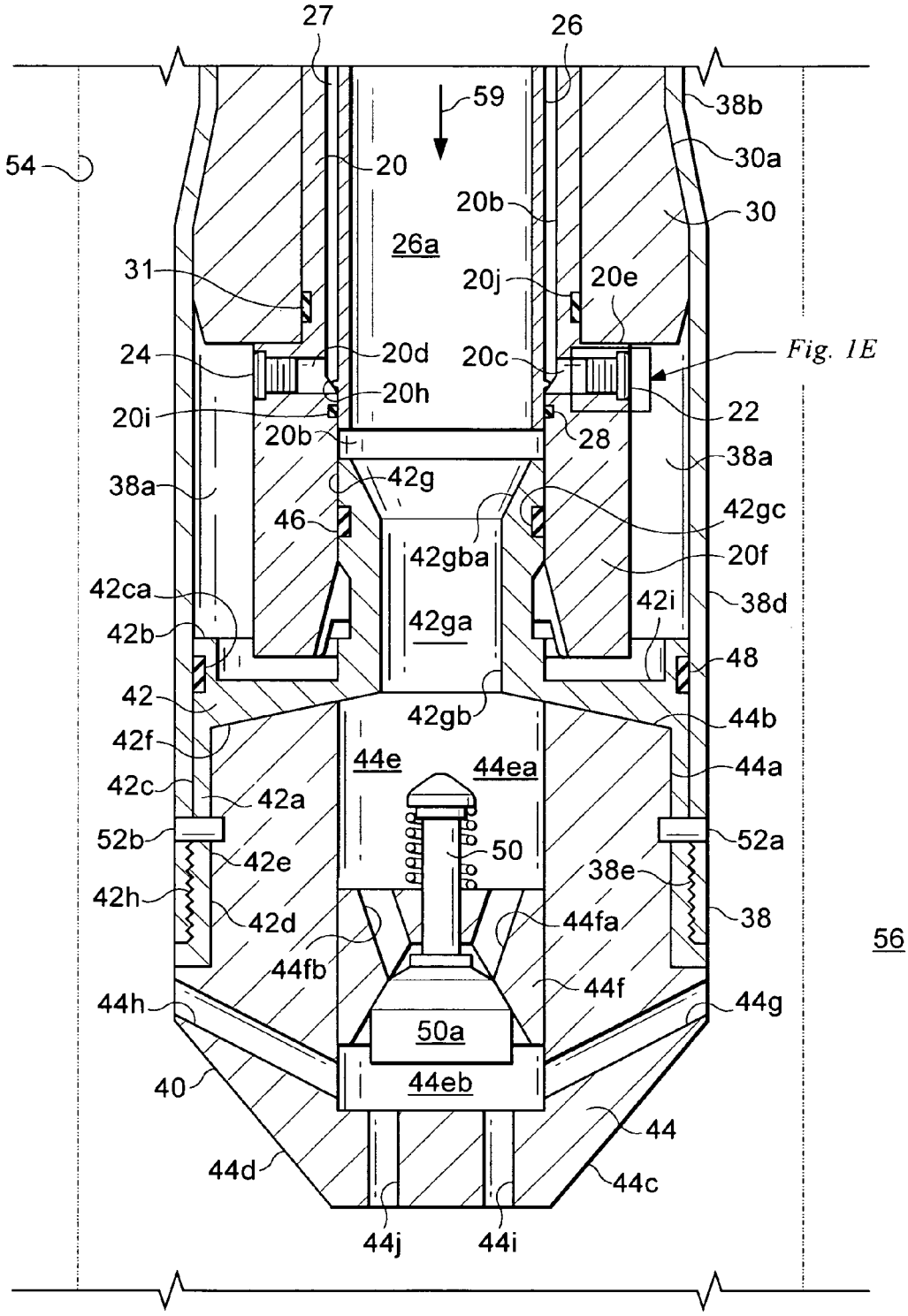

Referring to FIGS. 1, 1*a*, 1*b*, 1*c*, 1*d* and 1*e*, an exemplary embodiment of an apparatus 10 for radially expanding and plastically deforming a tubular member includes a tubular support 12 that defines an internal passage 12*a*, and includes a threaded connection 12*b* at one end and a threaded connection 12*c* at the other end. In an exemplary embodiment, during operation of the apparatus 10, a threaded end of a conventional tubular support member (not shown) that defines an internal passage such as, for example, a tubular string in the form of coiled tubing, jointed tubing, or the like, may be coupled to the threaded connection 12*b* of the tubular support member 12.

An end of a tubular support 14 that defines an internal passage 14*a* having a variable inside diameter, and includes a shoulder 14*b* and threaded connections 14*c* and 14*d*, is coupled to the other end of the tubular support 12. A sealing element such as a crimp seal 16 sealingly engages the internal surface of the tubular support 14. The crimp seal 16 includes an elastomeric element 16*a* (FIG. 1*d*) having a generally trapezoidally-shaped cross-section and disposed in an annular channel 12*d* formed in the external surface of the tubular support 12. A retainer 16*b* extends in an annular channel 16*aa* formed in the elastomeric element 16*a*, and is biased against the walls of the channel, thereby substantially eliminating the possibility of the crimp seal 16 falling out of the channel 12*d* during the operation of the apparatus 10, discussed below. It is understood that the crimp seal 16 may be a high-temperature crimp seal.

A coupler 18 that defines an internal passage 18*a*, and includes a threaded connection 18*b*, is disposed in the internal passage 14*a* and is coupled to the tubular support 14, contacting the shoulder 14*b*.

A threaded connection 20*a* of an end of a tubular support 20 that defines an internal passage 20*b* and radial passages 20*c* and 20*d*, and includes an external flange 20*e*, and includes a plurality of circumferentially-spaced high-torque lugs 20*f* at the other end is coupled to the threaded connection 14*d* of the other end of the tubular support 14. In an exemplary embodiment, the tubular support 20 includes four circumferentially-spaced high-torque lugs 20*f*. A sealing element 21 extends in an annular channel 20*g* formed in the external surface of the tubular support 20 and sealingly engages the internal surface of the tubular support 14. An internal shoulder 20*h* of the tubular support 20 is defined between the radial passages 20*c* and 20*d* and the high-torque lugs 20*f*.

Rupture discs 22 and 24 are received and mounted within the radial passages 20*c* and 20*d*, respectively, of the tubular support 20. The rupture disc 22 (FIG. 1*e*) is generally in the form of an annular body member and includes a rupture element 22*a* disposed in an internal passage defined by the annular body member, and a threaded connection 22*b* that is coupled to the radial passage 20*c*. In an exemplary embodiment, the threaded connection 22*b* may be in the form of a straight-thread connection. A shoulder 22*c* defined by an end portion of the annular body member contacts a wall of a countersunk portion 20*ca* of the radial passage 20*c*, and a sealing element such as an o-ring 22*d* is disposed between the shoulder 22*c* and the threaded connection 22*b*, extending around the annular body member and sealingly engaging a surface of the radial passage 20*c*. Thus, the seal provided by the o-ring 22*d* is supported by the contact between the shoulder 22*c* and the wall of the countersunk portion 20*ca*. The rupture disc 24 and its mounting within the radial passage 20*d* is identical to the rupture disc 22 and its mounting within the radial passage 20*c*, and therefore neither the rupture disc 24 nor its mounting will be described in detail.

An end of a tubular support 26 that defines an internal passage 26*a* and an increased-diameter portion 26*b* is coupled to the threaded connection 18*b* of the coupler 18 and extends within the internal passages 14*a* and 20*b*, engaging the internal shoulder 20*h* of the tubular support 20 and thereby coupling the tubular support 26 and the coupler 18 to the tubular support 20. The coupler 18 partially extends within the portion of the internal passage 26*a* corresponding to the increased-diameter portion 26*b* of the tubular support 26. An annular region 27 is defined by the external surface of the tubular support 26 and the internal surfaces of the tubular supports 14 and 20.

Radial passages 26*c* and 26*d* are formed through the wall of the tubular support 26, in the vicinity of the coupler 18, so that the internal passage 26*a* is in fluid communication with the annular region 27. A sealing element 28 extends in an annular channel 20*i* formed in the internal surface of the tubular support 20 and sealingly engages the external surface of the tubular support 26. A tubular expansion cone 30 that includes a tapered external expansion surface 30*a* is coupled to the external surface of the tubular support 20, circumferentially extending around the tubular support 20 so that an end of the tubular expansion cone abuts the external flange 20*e*. A sealing element 31 extends in an annular channel 20*j* formed in the external surface of the tubular support 20 and sealingly engages the internal surface of the tubular expansion cone 30.

A tubular support 32 is coupled to the tubular support 14 so that the tubular support 14 extends within the tubular support 32 and so that an end of the tubular support 32 is substantially flush with an end of the tubular support 14. The other end of the tubular support 32 abuts the other end of the tubular expansion cone 30. Set screws 34*a* and 34*b* extend through and threadably engage radial passages 36*a* and 36*b*, respectively, that are formed through the tubular supports 14 and 32. The distal ends of the set screws 34*a* and 34*b* contact and apply pressure against the external surface of the tubular support 20, thereby reducing the possibility of decoupling and/or relative movement between two or more of the tubular supports 14, 20 and 32 and parts coupled and/or engaged thereto during the operation of the apparatus 10, discussed below.

An expandable tubular member 38 that defines an internal passage 38*a* for receiving the tubular supports 14, 20, 26 and 32 and the coupler 18 mates with and is supported by the external expansion surface 30*a* of the tubular expansion cone 30. The expandable tubular member 38 includes an upper portion 38*b* having a smaller inside diameter and a threaded connection 38*c*, and further includes a lower portion 38*d* having a larger inside diameter and a threaded connection 38*e*. It is understood that another expandable tubular member may be coupled to the expandable tubular member 38 via the threaded connection 38*c*, and yet another expandable tubular member may be coupled to the former in a similar manner and so on, thereby forming a string of expandable tubular members having a continuous internal passage.

A nose or shoe 40 is coupled to the lower portion 38*d* of the expandable tubular member 38 via a threaded connection 38*e*. The shoe 40 includes an upper component 42 composed of a material having a material hardness, and a lower component 44 coupled to the upper component and composed of another material having another material hardness. In an exemplary embodiment, the material hardness of the material of the lower component 44 may be less than the material hardness of the material of the upper component 42. In an exemplary embodiment, the upper component 42 may be composed of an aluminum alloy and the lower component 44 may be composed of a composite material. In another exemplary embodiment, the upper component 42 may be composed of an aluminum alloy and the lower component 44 may be composed of a concrete material. It is understood that the upper component 42 and the lower component 44 may each be composed of a wide variety of materials.

A casing 42*a* of the upper component 42 defines external surfaces 42*b* and 42*c* and a cavity 42*d* having internal surfaces 42*e* and 42*f*. An annular portion 42*g* extends in an upward direction from the external surface 42*b*, defining an internal passage 42*ga* and a plug seat 42*gb* including a lead-in angled surface 42*gba*. A threaded connection 42*h* is coupled to the threaded connection 38*e*. Circumferentially-spaced lug pockets 42*i* for receiving the lugs 20*f* of the tubular support 20 are formed in the external surface 42*b*, thereby enabling torque loads or other types or combinations of loads to be transmitted between the tubular support 20 and the shoe 40 at any point during operation of the apparatus 10, discussed below, and/or for any conventional reason before, during or after the operation of the apparatus. In an exemplary embodiment, a quantity of eight circumferentially-spaced lug pockets 42*i* may be formed in the external surface 42*b*.

A sealing element 46 extends in an annular groove 42*gc* formed in the external surface of the annular portion 42*g* and sealingly engages the tubular support 20. A sealing element 48 extends in an annular groove 42*ca* formed in the external surface 42*c* and sealingly engages the internal surface of the expandable tubular member 38.

The lower component 44 is disposed in the cavity 42*d* and coupled to the upper component 42. External surfaces 44*a* and 44*b* are defined and are mated against the internal surfaces 42*e* and 42*f*, respectively. It is understood that the lower component 44 may be coupled to the upper component 42 via one or more threaded engagements, adhesives, friction or other conventional coupling techniques, or any combination thereof, so that torque loads or other types or combinations of loads may be easily transferred between the components. It is further understood that internal ribs (not shown) may extend from the internal surface 42*e* and/or 42*f* in order to facilitate the transmission of loads between the upper component 42 and the lower component 44.

Although tapered surfaces 44*c* and 44*d* are defined by the lower component 44, it is understood that the portion of the lower component extending below the upper component 42 may be substantially cylindrical.

An internal passage 44*e* is formed in the lower component 44, and a valve seat portion 44*f* of the lower component is disposed in the internal passage, extending from the internal walls therefrom and dividing the internal passage into sub-passages 44*ea* and 44*eb*. Passages 44*fa* and 44*fb* are formed through the valve seat portion 44*f*. Passages 44*g*, 44*h*, 44*i* and 44*j* are formed through the lower component 44, fluidically connecting the sub-passage 44*eb* to the environment outside of the apparatus 10.

A one-way poppet valve 50 is movably coupled to the valve seat portion 44*f* of the lower component 44 of the shoe 40, and includes a valve element 50*a* for controllably sealing the passages 44*fa* and 44*fb*. In an exemplary embodiment, the one-way poppet valve 50 only permits fluidic materials to be exhausted from the apparatus 10.

Shear pins 52*a* and 52*b* extend through the expandable tubular member 38 and the upper component 42, and into the lower component 44 to lock the shoe 40 to the expandable tubular member. In an exemplary embodiment, the shear pins 52*a* and 52*b* may be in the form of knurled drive-in shear pins, in which case it is understood that the shear pins can be easily installed and removed with a conventional tool such as, for example, a slide hammer.

During operation, with continuing reference to FIGS. 1, 1*a*, 1*b*, 1*c*, 1*d* and 1*e*, the apparatus 10 is positioned within a preexisting structure such as, for example, a wellbore 54 that transverses a subterranean formation 56. In an exemplary embodiment, during or after the positioning of the apparatus 10 within the wellbore 54, fluidic material 58 may be circulated through and out of the apparatus into the wellbore through the internal passages 12*a*, 14*a*, 18*a*, 26*a*, 20*b*, 42*ga*, 44*e*, 44*fa*, 44*fb*, 44*g*, 44*h*, 44*i* and 44*j*.

In an exemplary embodiment, movement of the tubular supports 12, 14, 20, 26 and 32, the coupler 18, and the tubular expansion cone 30, relative to the expandable tubular member 38, the shoe 40 and the valve 50, is possible in either an upward or downward direction as long as there is a gap between the distal ends of the lugs 20*f* and the bottom surfaces of the corresponding lug pockets 42*i* of the upper component 42 of the shoe 40. For example, when the apparatus 10 encounters a resistance during placement in the wellbore 54 such as, for example, the shoe 40 becoming jammed or stuck in the wellbore 54, the tubular supports 12,14, 20, 26 and 32, the coupler 18, and the tubular expansion cone 30 may move downward, relative to the expandable tubular member 38, the shoe 40 and the valve 50, until the distal ends of the lugs 20*f* contact the bottom surfaces of the corresponding lug pockets 42*i*. At this point, torque loads or other types or combinations of loads may be applied to the apparatus 10 in any conventional manner in an effort to free the apparatus 10 from the aforementioned resistance. It is understood that the degree of movement of the tubular supports 12, 14, 20, 26 and 32, the coupler 18, and the tubular expansion cone 30 may also be limited by the gap between the distal end of the tubular support 26 and the distal end of the annular portion 42*g* of the upper component 42 of the shoe 40.

In an exemplary embodiment, as illustrated in FIGS. 2, 2*a*, 2*b* and 2*c*, with continuing reference to FIGS. 1, 1*a*, 1*b*, 1*c*, 1*d* and 1*e*, the apparatus 10 may be placed in the desired position within the wellbore 54 such as, for example, the apparatus may be set down onto the bottom of the wellbore. At this point, a hardenable fluidic sealing material 59 such as, for example, cement, may be injected into the apparatus 10 through the internal passages 12*a*, 14*a*, 18*a*, 26*a*, 20*b*, 42*ga*, 44*e*, 44*fa*, 44*fb*, 44*g*, 44*h*, 44*i* and 44*j*, and into the annulus defined between the external surface of the expandable tubular member 38 and the internal surface of the wellbore 54. As a result, an annular body of the hardenable fluidic sealing material 59 is formed within the annulus between the external surface of the expandable tubular member 38 and the internal surface of the wellbore 54.

Figures 3, 3A:
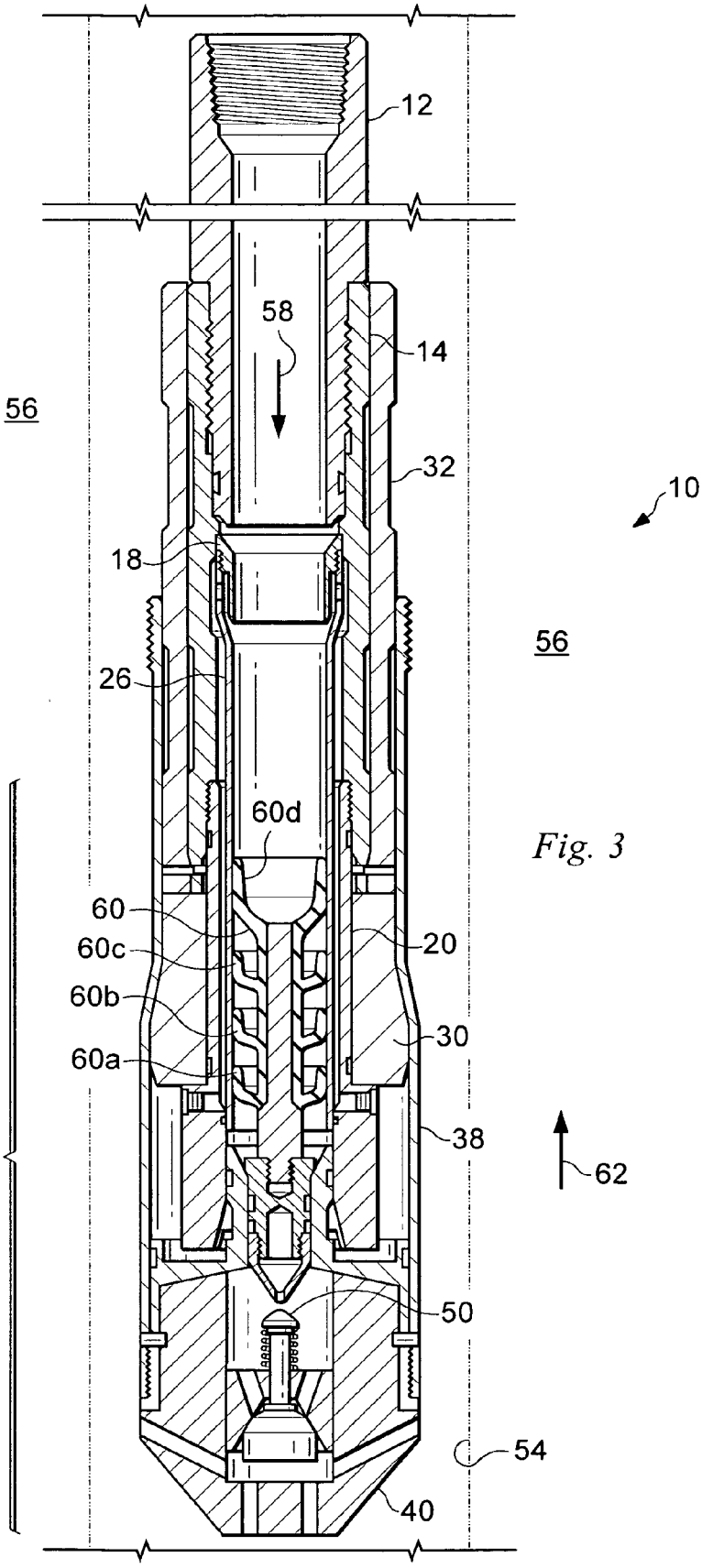
FIGS. 3 and 3*a* is a cross-sectional illustration of the apparatus of FIGS. 1, 1*a*, 1*b* and 1*c* and an enlarged view of a portion thereof, respectively, during the radial expansion and plastic deformation of the tubular member.
Figure 3A:
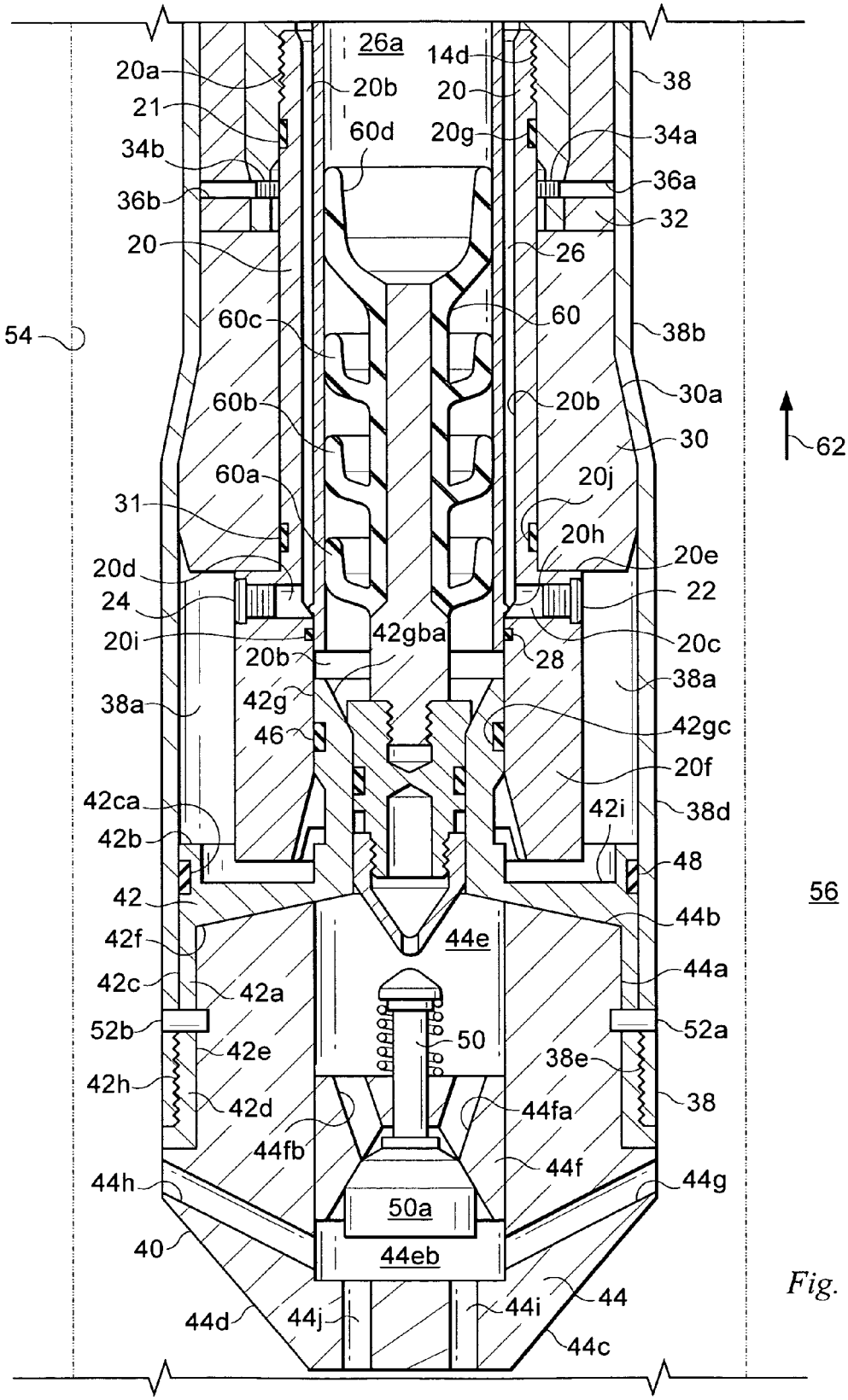

In an exemplary embodiment, as illustrated in FIGS. 3 and 3*a*, with continuing reference to FIGS. 1, 1*a*, 1*b*, 1*c*, 1*d*, 1*e*, 2, 2*a*, 2*b* and 2*c*, during operation of the apparatus 10, a plug element 60 having wipers 60*a*, 60*b*, 60*c* and 60*d* may be injected into the apparatus, along with the fluidic material 58 and through the passages 12*a*, 14*a*, 18*a*, 26*a*, 20*b* and 42*ga*, until the plug element 60 is seated in the plug seat 42*gb*. At this point, the plug element 60 sealingly engages the plug seat 42*gb*, and the wipers 60*a*, 60*b*, 60*c* and 60*d* sealingly engage the internal surface of the tubular support 26. As a result, any flow of fluidic material through the internal passages 26*a* and 20*b* is blocked. It is understood that the plug element 60 may be injected into the apparatus 10 before, during or after the above-described circulation of the fluidic material 58 through and out of the apparatus.

Continued injection of the fluidic material 58 into the apparatus 10, following the seating of the plug element 60 in the plug seat 42*gb*, pressurizes the internal passage 26*a* of the tubular support 26. This pressurization causes the fluidic material 58 in the internal passage 26*a* to flow through the radial passages 26*c* and 26*d* of the tubular support 26, and to flow axially through the annular region 27 until reaching the rupture discs 22 and 24. When the pressurization reaches a predetermined pressure value, the rupture elements 22*a* and 24*a* of the rupture discs 22 and 24, respectively, are ruptured. Thus, the radial passages 20*c* and 20*d* of the tubular support 20 are opened so that the annular region 27 is in fluid communication with the internal passage 38*a* of the expandable tubular member 38.

As a result, the fluidic material 58 flows through the radial passages 20*c* and 20*d*, thereby pressurizing the portion of the internal passage 38*a* that is below the tubular expansion cone 30. Due to this pressurization, the tubular supports 12, 14, 20, 26 and 32, the coupler 18, and the tubular expansion cone 30 are displaced in an upward direction 62, relative to the expandable tubular member 38, the shoe 40, the valve 50 and the plug element 60, thereby radially expanding and plastically deforming the expandable tubular member 38.

Figure 4:
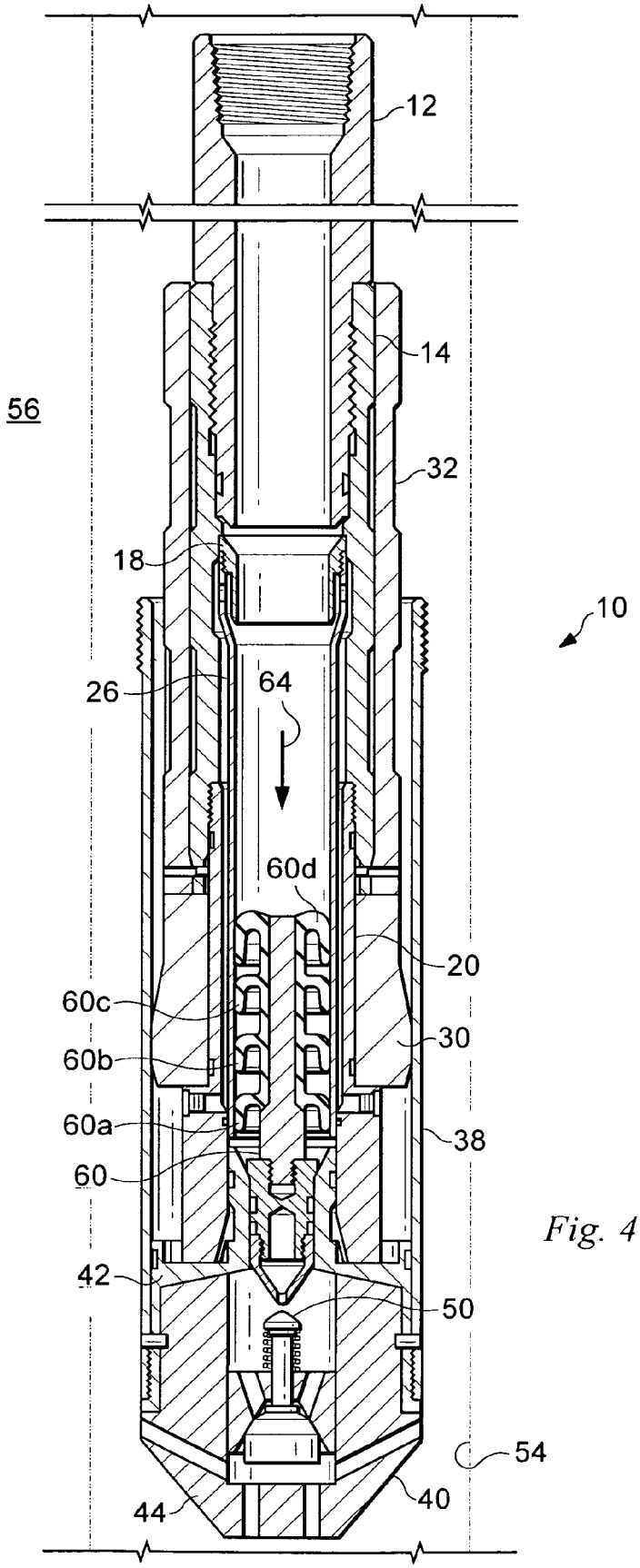
FIG. 4 is a cross-sectional illustration of the apparatus of FIGS. 1, 1*a*, 1*b* and 1*c* after the radial expansion and plastic deformation of the tubular member, and after the reinsertion of a portion of the apparatus into the radially-expanded and plastically-deformed tubular member.
Figure 5:
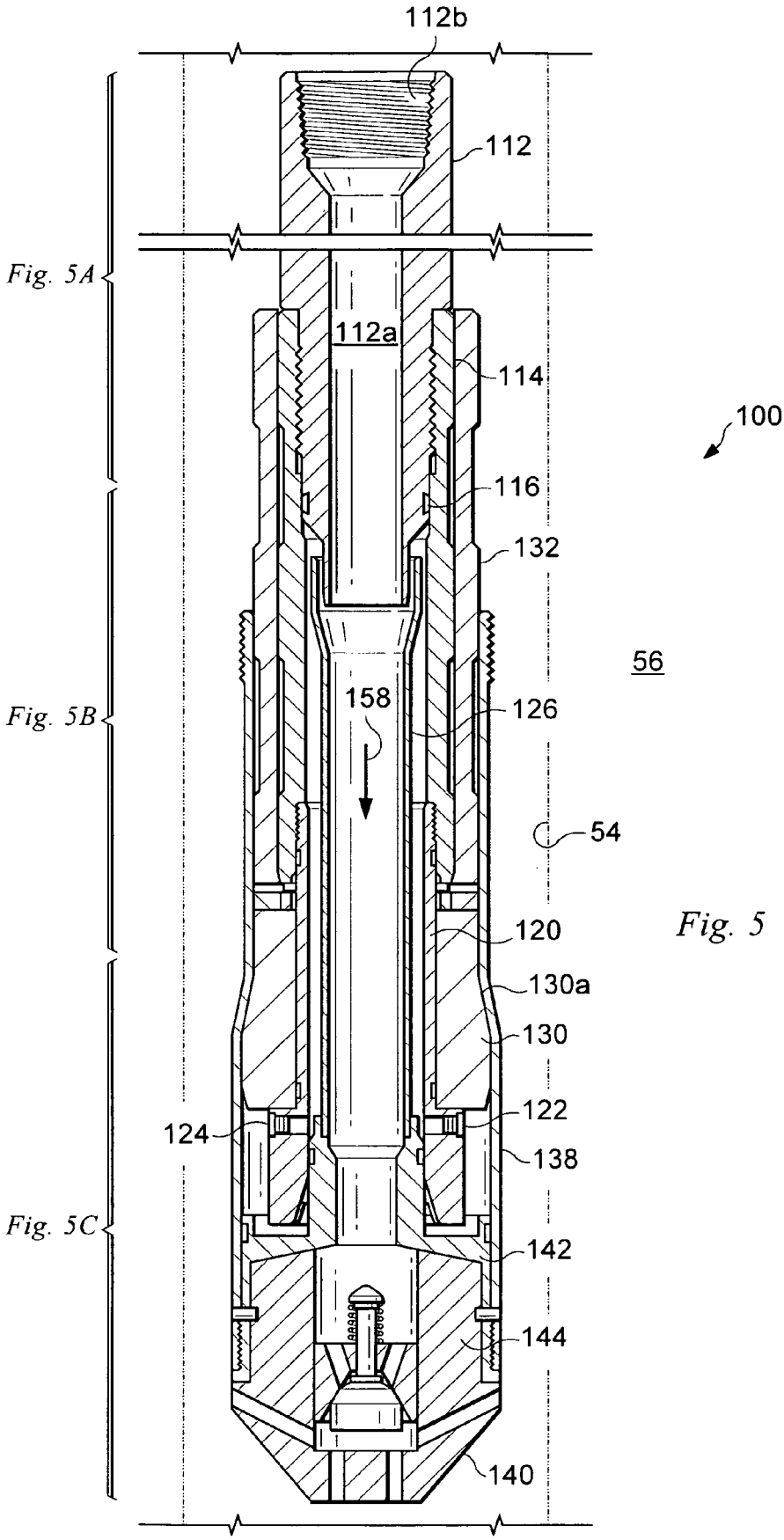
FIGS. 5, 5*a*, 5*b* and 5*c* are fragmentary cross-sectional illustrations of an embodiment of an apparatus for radially expanding and plastically deforming a tubular member during the placement of the apparatus within a wellbore.
Figure 5A:
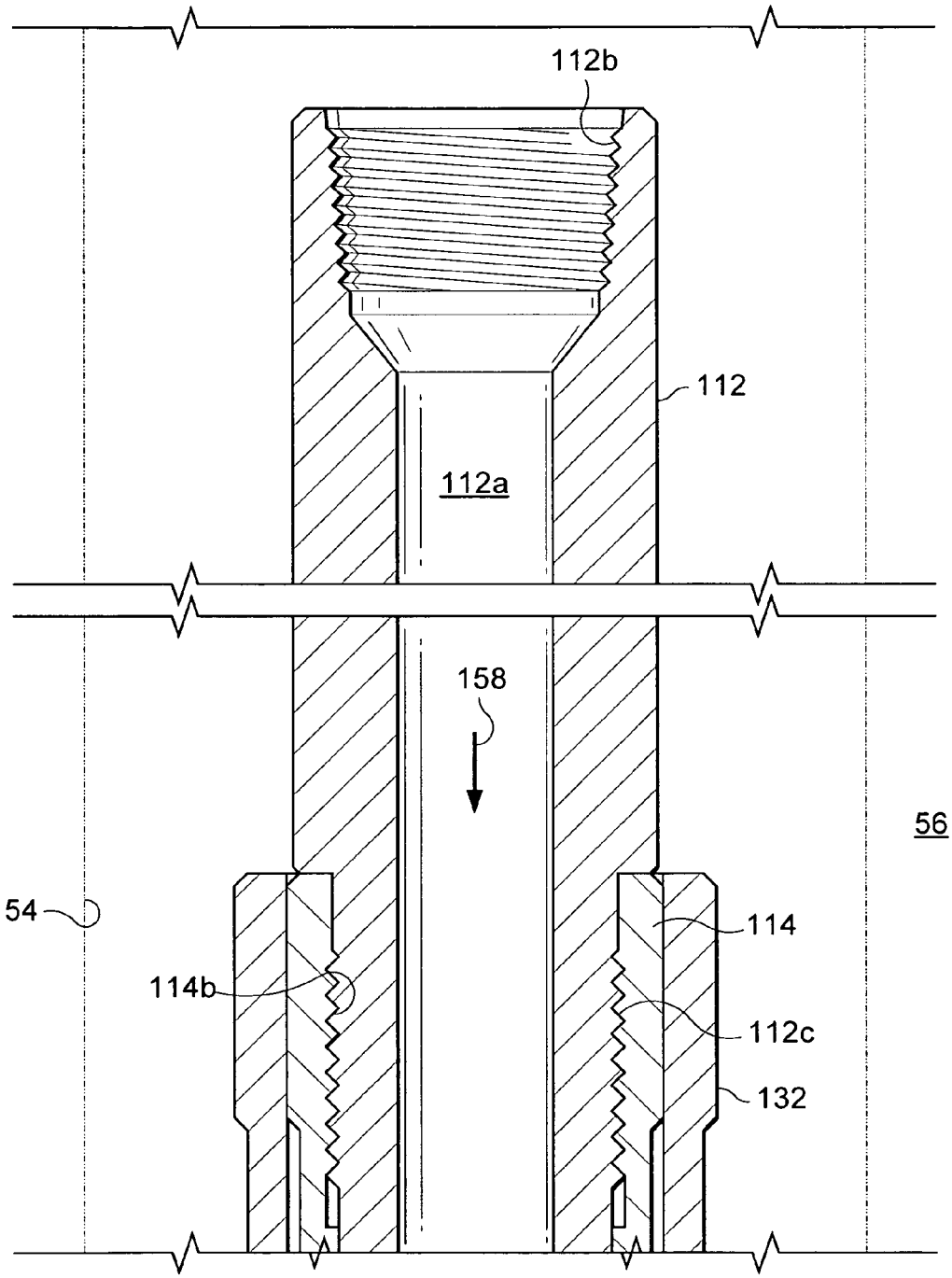
Figure 5B:
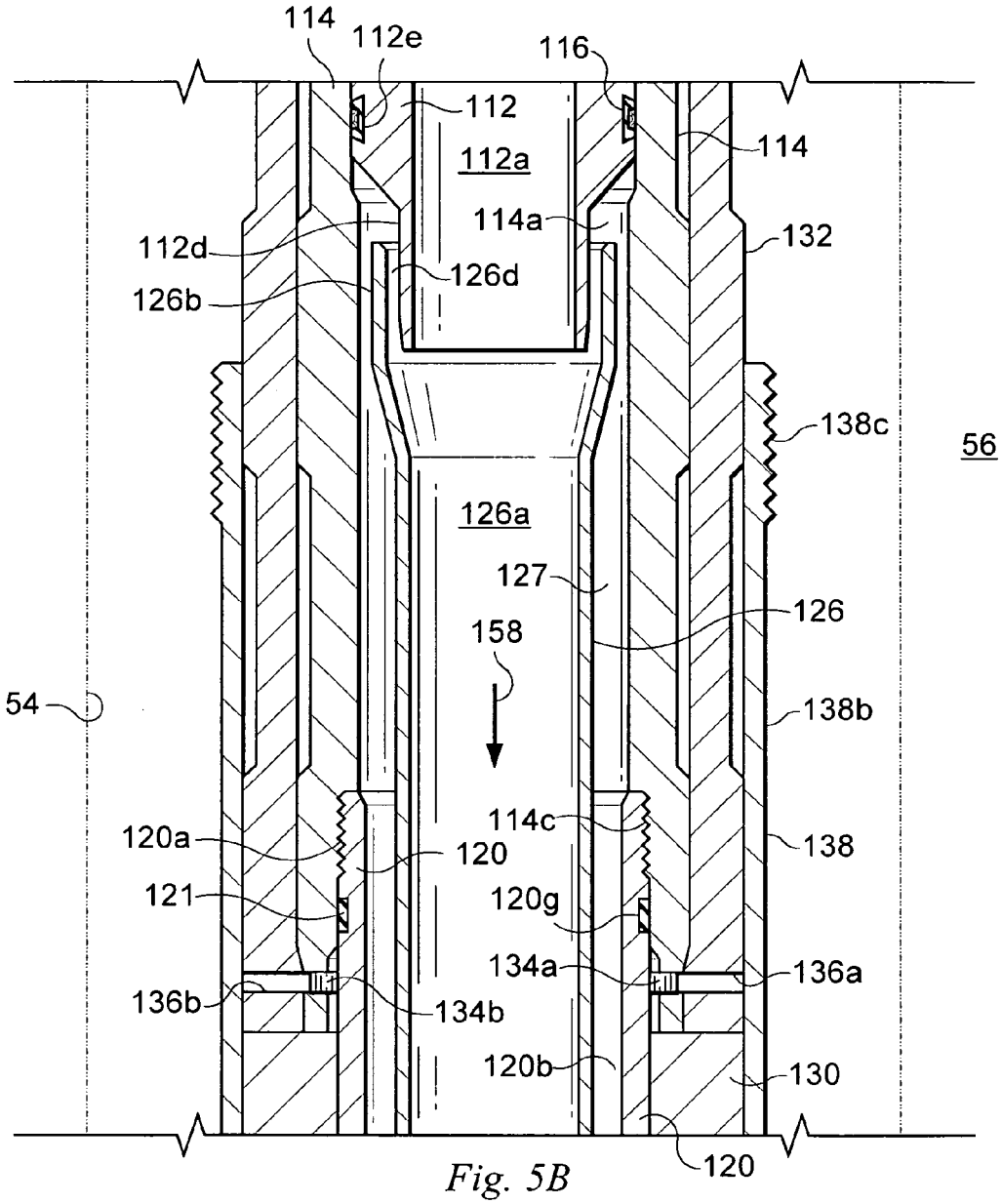
Figure 5C:
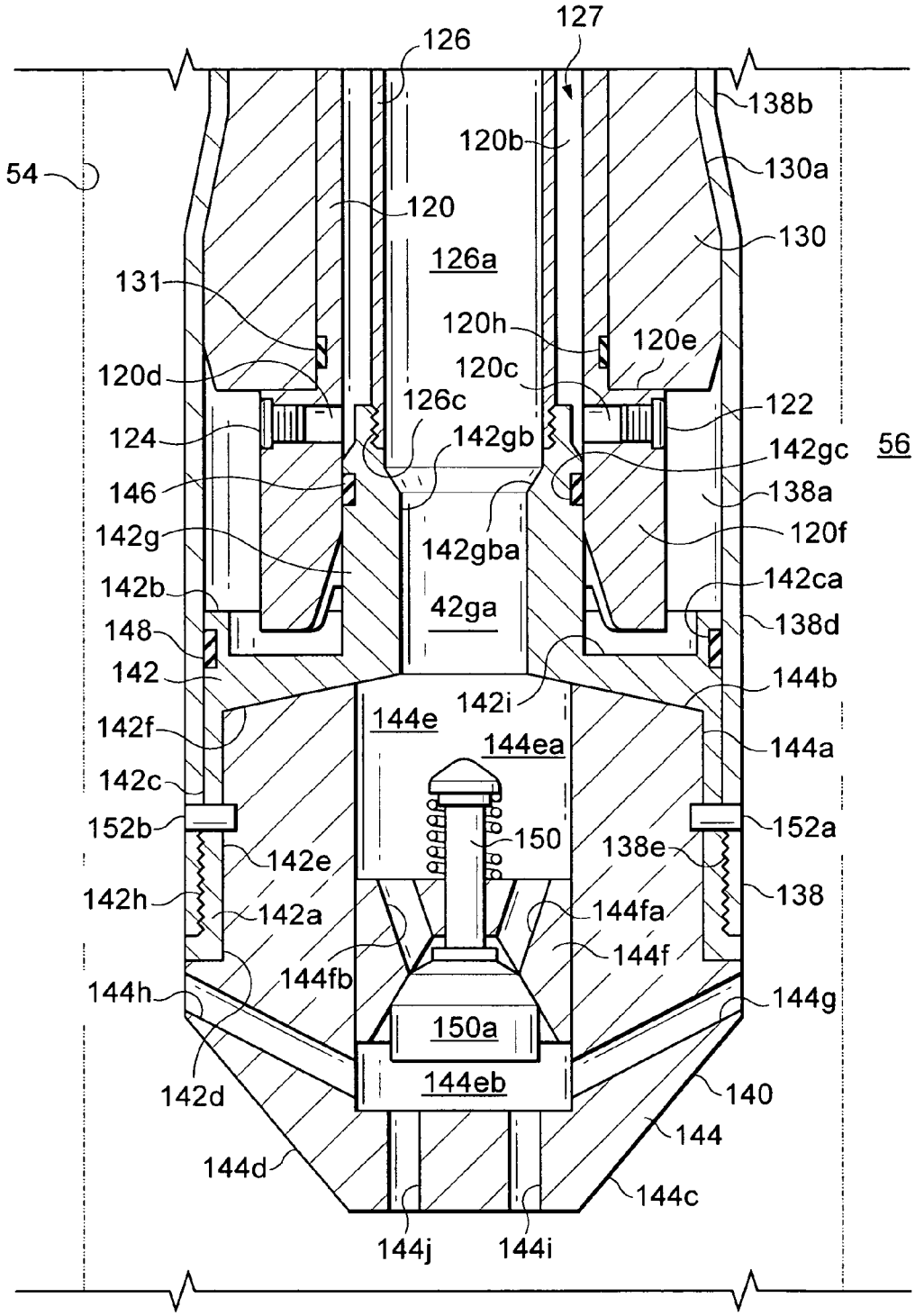
Figure 6:
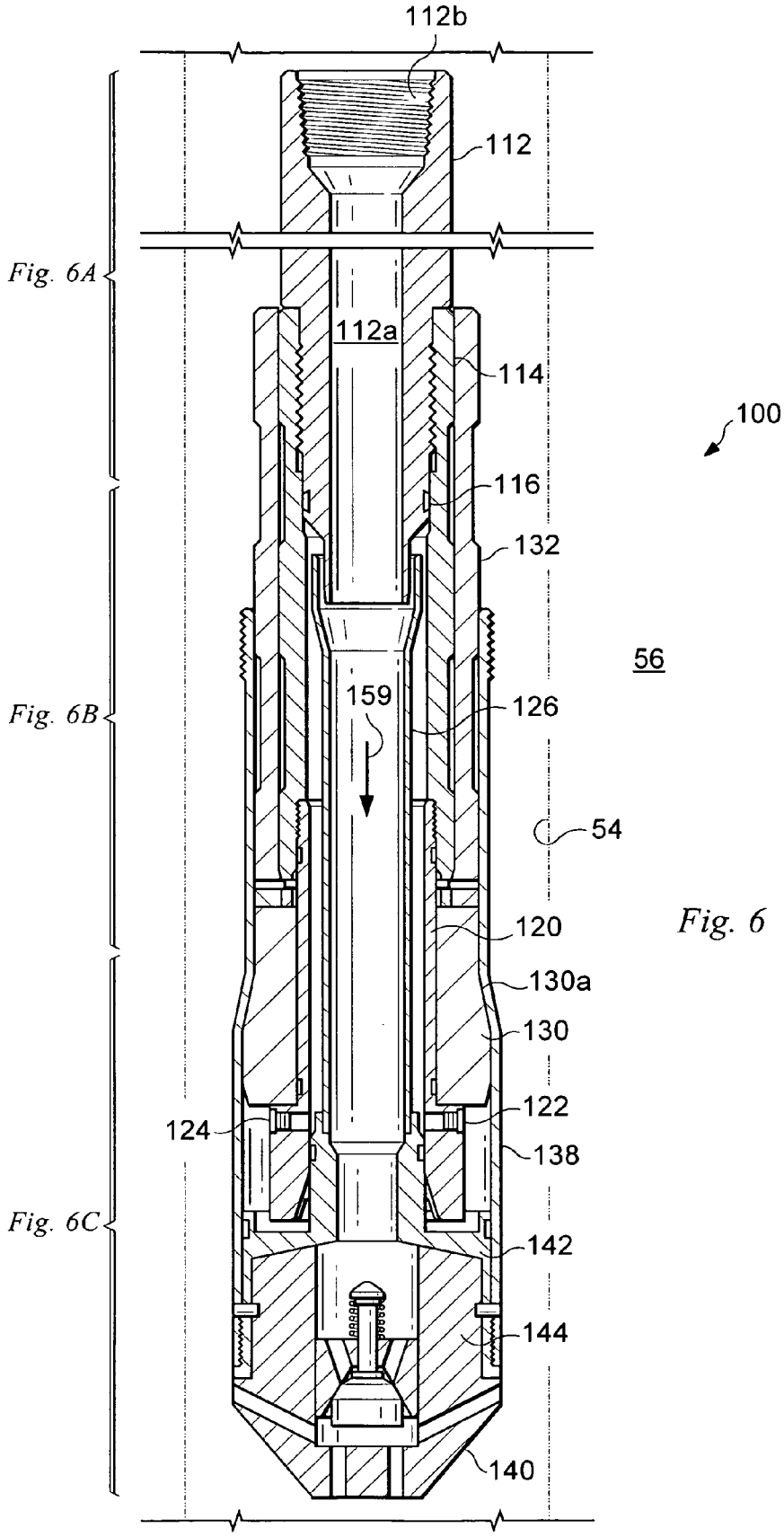
FIGS. 6, 6*a*, 6*b* and 6*c* are fragmentary cross-sectional illustrations of the apparatus of FIGS. 5, 5*a*, 5*b* and 5*c* during the injection of a hardenable fluidic sealing material into an annulus between the exterior of the apparatus and the wellbore.
Figure 6A:
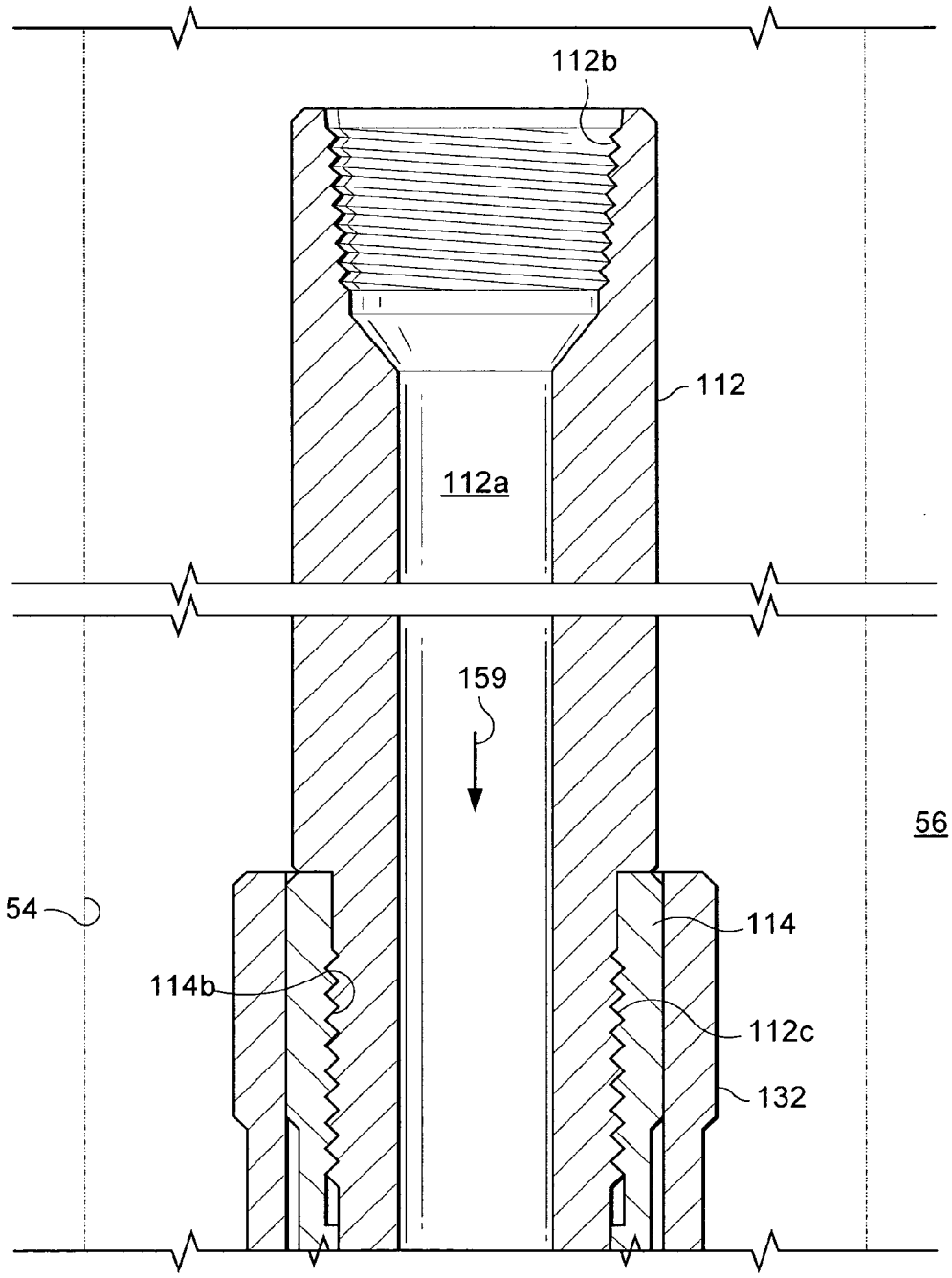
Figure 6B:
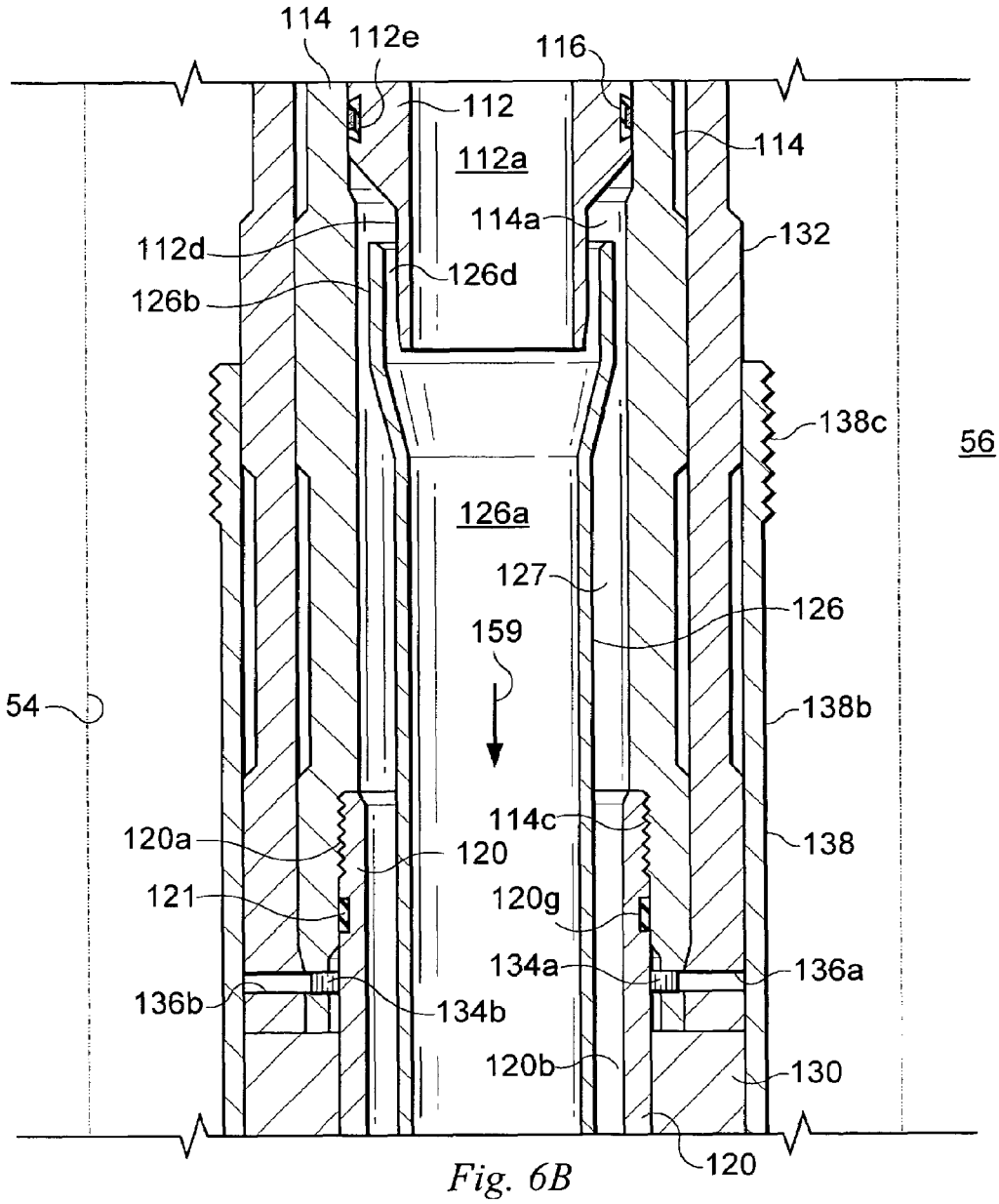
Figure 6C:
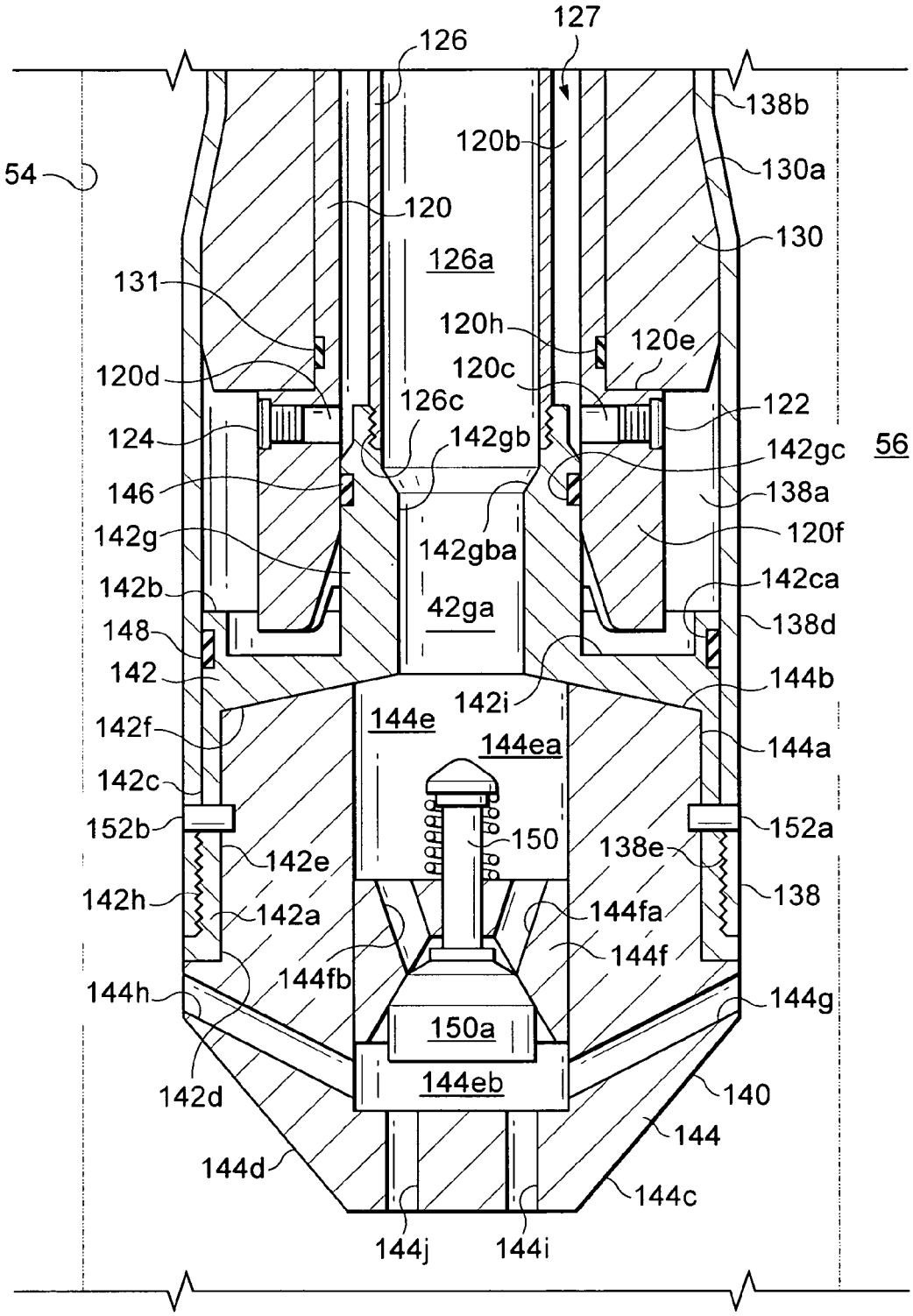

In an exemplary embodiment, as illustrated in FIG. 4, during operation of the apparatus 10, after radially expanding and plastically deforming the expandable tubular member 38, the tubular supports 12, 14, 20, 26 and 32, the coupler 18, and the tubular expansion cone 30 may be reinserted into the expandable tubular member 38, and displaced in a downward direction 64, relative to the expandable tubular member 38, the shoe 40, the valve 50 and the plug element 60, and for any conventional reason, until the distal ends of the lugs 20*f* contact the bottom surfaces of the corresponding lug pockets 42*i*. Due to the downward movement of the tubular support 26 in the direction 64 and relative to the plug element 60, the wipers 60*a*, 60*b*, 60*c* and 60*d* of the plug element are bent downwards and sealingly engage the internal surface of the tubular support 26.

It is understood that, after radially expanding and plastically deforming the expandable tubular member 38, the shoe 40 may be drilled out in any conventional manner for any conventional reason such as, for example, continuing with the next drilling operation. It is further understood that, due to the lower component 44 of the shoe 40 having a lower material hardness, the drill-out time for the shoe may be reduced.

In several exemplary embodiments, it is understood that one or more of the operational steps in each embodiment may be omitted.

Referring to FIGS. 5, 5*a*, 5*b* and 5*c*, an exemplary embodiment of an apparatus 100 for radially expanding and plastically deforming a tubular member includes a tubular support 112 that defines an internal passage 1 12*a*, and includes a threaded connection 112*b* at one end, a threaded connection 112*c* and a reduced-diameter portion 112*d* at the other end. In an exemplary embodiment, during operation of the apparatus 100, a threaded end of a conventional tubular support member (not shown) that defines an internal passage such as, for example, a tubular string in the form of coiled tubing, jointed tubing, or the like, may be coupled to the threaded connection 112*b* of the tubular support member 112.

An end of a tubular support 114 that defines an internal passage 114*a* having a variable inside diameter, and includes threaded connections 114*b* and 114*c*, is coupled to the other end of the tubular support 112. A crimp seal 116 is disposed in an annular channel 112*e* formed in the external surface of the tubular support 112 and sealingly engages the wall of the internal passage 114*a*. The crimp seal 116 is identical to the crimp seal 16 of the embodiment of FIGS. 1, 1*a*, 1*b*, 1*c*, 1*d* and 1*e* and therefore will not be described in detail. It is understood that the crimp seal 116 may be a high-temperature crimp seal.

A threaded connection 120*a* of an end of a tubular support 120 that defines an internal passage 120*b* and radial passages 120*c* and 120*d*, and includes an external flange 120*e*, and includes a plurality of circumferentially-spaced high-torque lugs 120*f* at the other end, is coupled to the threaded connection 114*c* of the other end of the tubular support 114. In an exemplary embodiment, the tubular support 120 includes four circumferentially-spaced high-torque lugs 120*f*. A sealing element 121 extends in an annular channel 120*g* formed in the external surface of the tubular support 120 and sealingly engages the internal surface of the tubular support 114.

Rupture discs 122 and 124 are received and mounted within the radial passages 120*c* and 120*d*, respectively, of the tubular support 120. The rupture discs 122 and 124 are substantially similar to the rupture discs 22 and 24, respectively, of the embodiment of FIGS. 1, 1*a*, 1*b*, 1*c*, 1*d* and 1*e* and therefore will not be described in detail.

An end of a tubular support 126 that defines an internal passage 126*a* and an increased-diameter portion 126*b*, and includes a threaded connection 126*c*, extends within the internal passages 114*a* and 120*b* so that the reduced-diameter portion 112*d* of the tubular support 112 extends within the increased-diameter portion 126*b*, thereby defining an annular region 126*d* between the external surface of the reduced-diameter portion and the internal surface of the increased-diameter portion. An annular region 127 is defined by the external surface of the tubular support 126 and the internal surfaces of the tubular supports 114 and 120. Thus, the internal passage 126*a* is in fluid communication with the annular region 127 via the annular region 126*d*.

A tubular expansion cone 130 that includes a tapered external expansion surface 130*a* is coupled to the external surface of the tubular support 120, circumferentially extending around the tubular support 120 so that an end of the tubular expansion cone abuts the external flange 120*e*. A sealing element 131 extends in an annular channel 120*h* formed in the external surface of the tubular support 120 and sealingly engages the internal surface of the tubular expansion cone 130.

A tubular support 132 is coupled to the tubular support 114 so that the tubular support 114 extends within the tubular support 132 and so that an end of the tubular support 132 is substantially flush with an end of the tubular support 114. The other end of the tubular support 132 abuts the other end of the tubular expansion cone 130. Set screws 134*a* and 134*b* extend through and threadably engage radial passages 136*a* and 136*b*, respectively, that are formed through the tubular supports 114 and 132. The distal ends of the set screws 134*a* and 134*b* contact and apply pressure against the external surface of the tubular support 120, thereby reducing the possibility of decoupling and/or relative movement between two or more of the tubular supports 114, 120 and 132 and parts coupled and/or engaged thereto during the operation of the apparatus 100, discussed below.

An expandable tubular member 138 that defines an internal passage 138*a* for receiving the tubular supports 114, 120, 126 and 132 mates with and is supported by the external expansion surface 130*a* of the tubular expansion cone 130. The expandable tubular member 138 includes an upper portion 138*b* having a smaller inside diameter and a threaded connection 138*c*, and further includes a lower portion 138*d* having a larger inside diameter and a threaded connection 138*e*. It is understood that another expandable tubular member may be coupled to the expandable tubular member 138 via the threaded connection 138*c*, and yet another expandable tubular member may be coupled to the former in a similar manner and so on, thereby forming a string of expandable tubular members having a continuous internal passage.

A nose or shoe 140 is coupled to the lower portion 138*d* of the expandable tubular member 138 via a threaded connection 138*e*. The shoe 140 includes an upper component 142 composed of a material having a material hardness, and a lower component 144 coupled to the upper component and composed of another material having another material hardness. In an exemplary embodiment, the material hardness of the material of the lower component 144 may be less than the material hardness of the material of the upper component 142. In an exemplary embodiment, the upper component 142 may be composed of an aluminum alloy and the lower component 144 may be composed of a composite material. In another exemplary embodiment, the upper component 142 may be composed of an aluminum alloy and the lower component 144 may be composed of a concrete material. It is understood that the upper component 142 and the lower component 144 may each be composed of a wide variety of materials.

A casing 142*a* of the upper component 142 defines external surfaces 142*b* and 142*c* and a cavity 142*d* having internal surfaces 142*e* and 142*f*. An annular portion 142*g* extends in an upward direction from the external surface 142*b*. The annular portion 142*g* is coupled to the tubular support 126 via the threaded connection 126*c*, and defines an internal passage 142*ga* and a plug seat 142*gb* including a lead-in angled surface 142*gba*. A threaded connection 142*h* is coupled to the threaded connection 138*e*. Circumferentially-spaced lug pockets 142*i* for receiving the lugs 120*f* of the tubular support 120 are formed in the external surface 142*b*, thereby enabling torque loads or other types or combinations of loads to be transmitted between the tubular support 120 and the shoe 140 at any point during operation of the apparatus 100, discussed below, and/or for any conventional reason before, during or after the operation of the apparatus. In an exemplary embodiment, a quantity of eight circumferentially-spaced lug pockets 142*i* may be formed in the external surface 142*b*.

A sealing element 146 extends in an annular groove 142*gc* formed in the external surface of the annular portion142*g* and sealingly engages the tubular support 120. A sealing element 148 extends in an annular groove 142*ca* in the external surface 142*c* and sealingly engages the internal surface of the expandable tubular member 138.

The lower component 144 is disposed in the cavity 142*d* and coupled to the upper component 142. External surfaces 144*a* and 144*b* are defined and are mated against the internal surfaces 142*e* and 142*f*, respectively. It is understood that the lower component 144 may be coupled to the upper component 142 via one or more threaded engagements, adhesives, friction or other conventional coupling techniques, or any combination thereof, so that torque loads or other types or combinations of loads may be easily transferred between the components. It is further understood that internal ribs (not shown) may extend from the internal surface 142*e* and/or 142*f* in order to facilitate the transmission of loads between the upper component 142 and the lower component 144.

Although tapered surfaces 144*c* and 144*d* are defined by the lower component 144, it is understood that the portion of the lower component extending below the upper component 142 may be substantially cylindrical.

An internal passage 144*e* is formed in the lower component 144, and a valve seat portion 144*f* of the lower component is disposed in the internal passage, extending from the internal walls therefrom and dividing the internal passage into sub-passages 144*ea* and 144*eb*. Passages 144*fa* and 144*fb* are formed through the valve seat portion 144*f*. Passages 144*g*, 144*h*, 144*i* and 144*j* are formed through the lower component 144, fluidically connecting the sub-passage 144*eb* to the environment outside of the apparatus 100.

A one-way poppet valve 150 is movably coupled to the valve seat portion 144*f* of the lower component 144 of the shoe 140, and includes a valve element 150*a* for controllably sealing the passages 144*fa* and 144*fb*. In an exemplary embodiment, the one-way poppet valve 150 only permits fluidic materials to be exhausted from the apparatus 100.

Shear pins 152*a* and 152*b* extend through the expandable tubular member 138 and the upper component 142, and into the lower component 144 to lock the shoe 140 to the expandable tubular member. In an exemplary embodiment, the shear pins 152*a* and 152*b* may be in the form of knurled drive-in shear pins, in which case it is understood that the shear pins can be easily installed and removed with a conventional tool such as, for example, a slide hammer.

During operation, with continuing reference to FIGS. 5, 5*a*, 5*b* and 5*c*, the apparatus 100 is positioned within a pre-existing structure such as, for example, the wellbore 54 that transverses the subterranean formation 56. In an exemplary embodiment, during or after the positioning of the apparatus 100 within the wellbore 54, fluidic material 158 may be circulated through and out of the apparatus into the wellbore through the internal passages 112*a*, 126*a*, 142*ga*, 144*e*, 144*fa*, 144*fb*, 144*g*, 144*h*, 144*i* and 144*j*.

In an exemplary embodiment, movement of the tubular supports 112, 114, 120 and 132 and the tubular expansion cone 130, relative to the tubular support 126, the expandable tubular member 138, the shoe 140 and the valve 150, is possible in either an upward or downward direction as long as there is a gap between the distal ends of the lugs 120*f* and the bottom surfaces of the corresponding lug pockets 142*i* of the upper component 142 of the shoe 140. For example, when the apparatus 100 encounters a resistance during placement in the wellbore 54 such as, for example, the shoe 140 becoming jammed or stuck in the wellbore 54, the tubular supports 112, 114, 120 and 132 and the tubular expansion cone 30 may move downward, relative to the tubular support 126, the expandable tubular member 138, the shoe 140 and the valve 150, until the distal ends of the lugs 120*f* contact the bottom surfaces of the corresponding lug pockets 142*i*. At this point, torque loads or other types or combinations of loads may be applied to the apparatus 100 in any conventional manner in an effort to free the apparatus 100 from the aforementioned resistance. It is understood that the degree of movement of the tubular supports 112, 114, 120 and 132 and the tubular expansion cone 130 may also be limited by the gap between the end of the tubular support 126 adjacent the increased-diameter portion 126*b* and the transition region of the tubular support 112 between the reduced-diameter portion 112*d* and the remainder of the tubular support 112, and/or by the degree of extension of the reduced-diameter portion 112 into the tubular support 126.

In an exemplary embodiment, as illustrated in FIGS. 6, 6*a*, 6*b* and 6*c*, with continuing reference to FIGS. 5, 5*a*, 5*b* and 5*c*, the apparatus 100 may be placed in the desired position within the wellbore 54 such as, for example, the apparatus may be set down onto the bottom of the wellbore. At this point, a hardenable fluidic sealing material 159 such as, for example, cement, may be injected into the apparatus 100 through the internal passages 112*a*, 126*a*, 142*ga*, 144*e*, 144*fa*, 144*fb*, 144*g*, 144*h*, 144*i* and 144*j*, and into the annulus defined between the external surface of the expandable tubular member 138 and the internal surface of the wellbore 54. As a result, an annular body of the hardenable fluidic sealing material 159 is formed within the annulus between the external surface of the expandable tubular member 138 and the internal surface of the wellbore 54.

Figure 7:
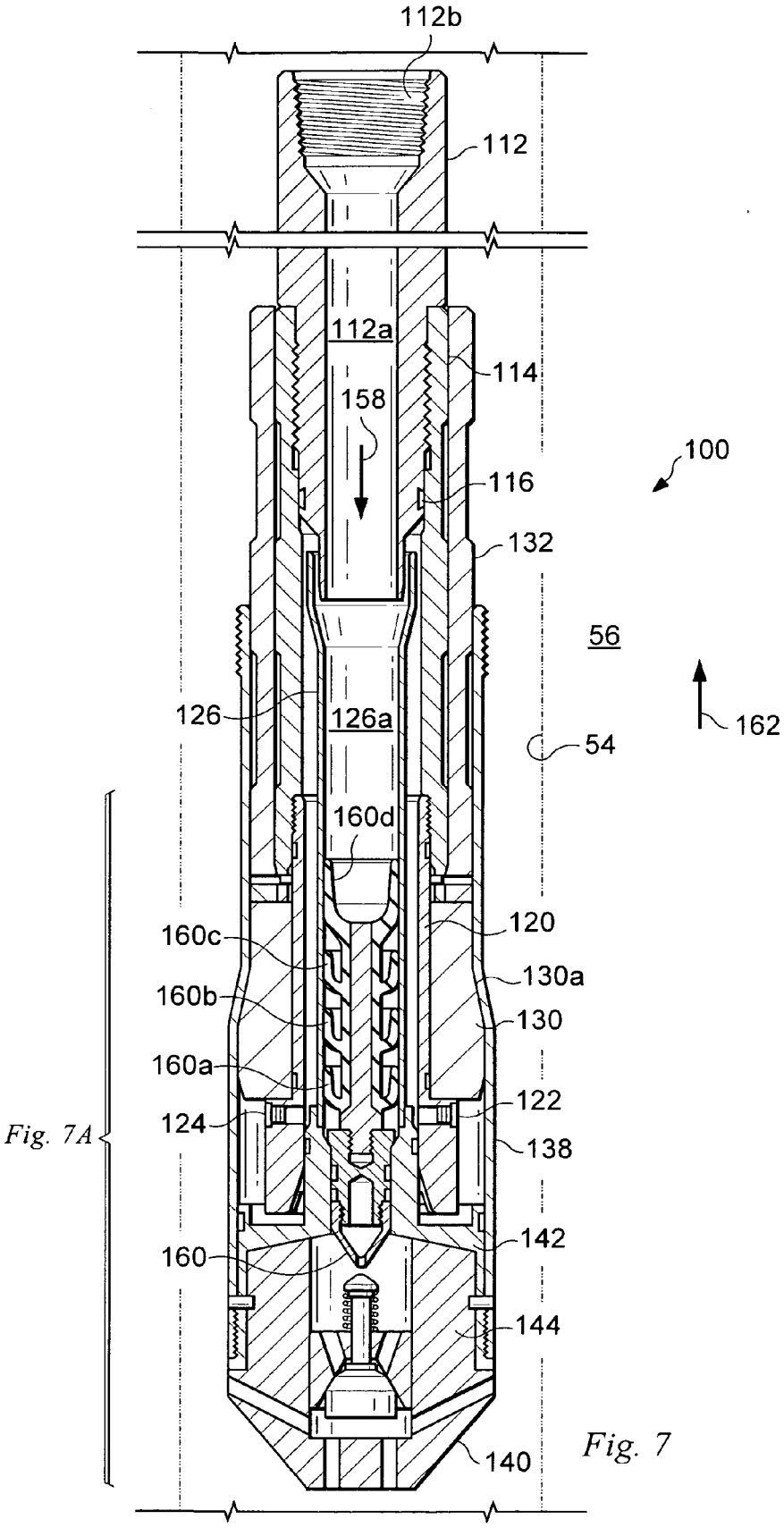
FIGS. 7 and 7*a* is a cross-sectional illustration of the apparatus of FIGS. 5, 5*a*, 5*b* and 5*c* and an enlarged view of a portion thereof, respectively, during the radial expansion and plastic deformation of the tubular member.
Figure 7A:
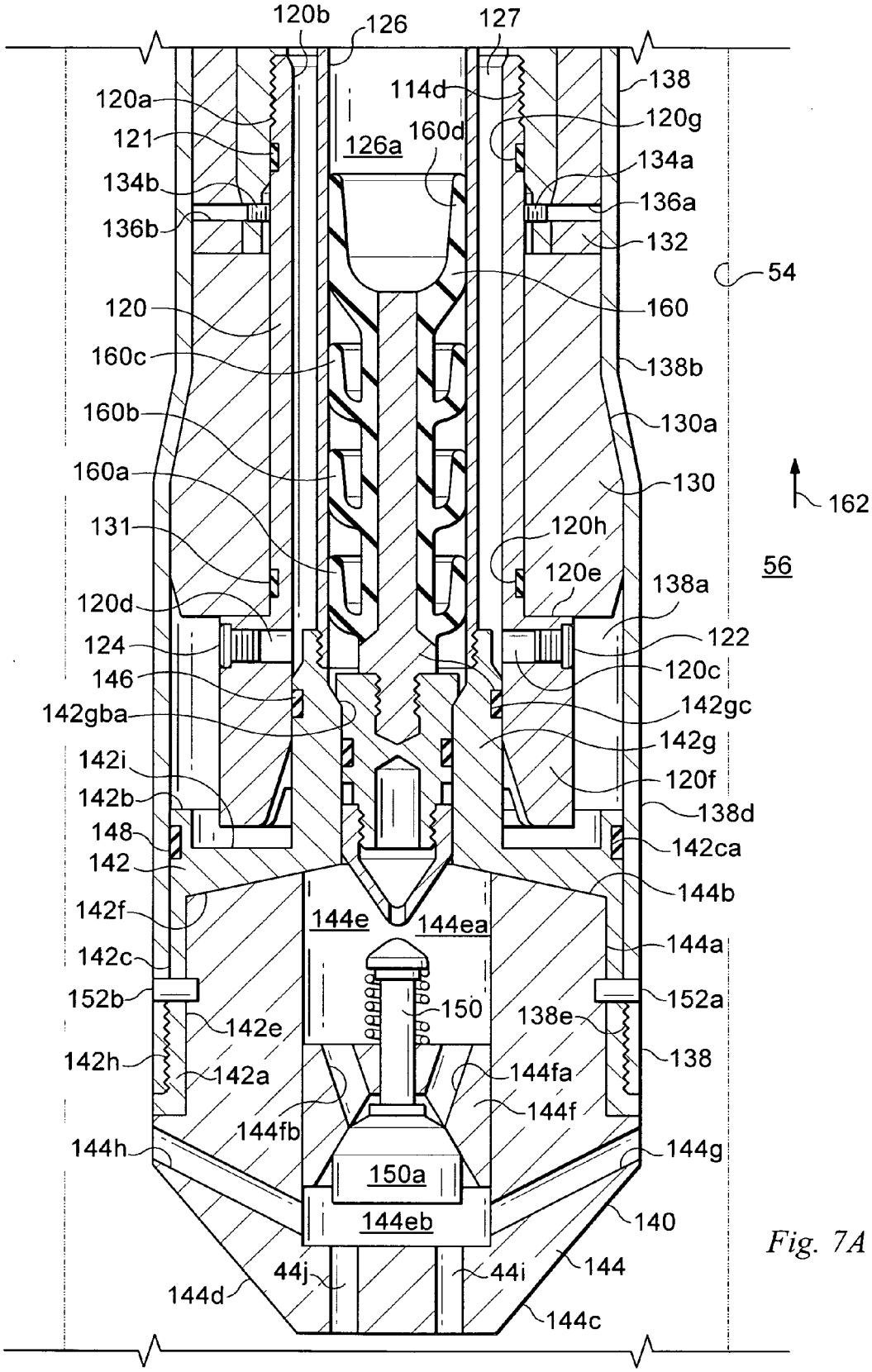

In an exemplary embodiment, as illustrated in FIGS. 7 and 7*a*, with continuing reference to FIGS. 5, 5*a*, 5*b*, 5*c*, 6, 6*a*, 6*b* and 6*c*, during operation of the apparatus 100, a plug element 160 having wipers 160*a*, 160*b*, 160*c* and 160*d* may be injected into the apparatus, along with the fluidic material 158 and through the passages 112*a*, 126*a* and 142*ga*, until the plug element 160 is seated in the plug seat 142*gb*. At this point, the plug element 160 sealingly engages the plug seat 142*gb*, and the wipers 160*a*, 160*b*, 160*c* and 160*d* sealingly engage the internal surface of the tubular support 126. As a result, any flow of fluidic material through the internal passages 126*a* is blocked. It is understood that the plug element 160 may be injected into the apparatus 100 before, during or after the above-described circulation of the fluidic material 158 through and out of the apparatus.

Continued injection of the fluidic material 158 into the apparatus 100, following the seating of the plug element 160 in the plug seat 142*gb*, pressurizes the internal passage 126*a* of the tubular support 126. This pressurization causes the fluidic material 158 in the internal passage 126*a* to flow into the annular region 127 via the annular region 126*d*, and axially through the annular region 127 until reaching the rupture discs 122 and 124. The rupture discs 122 and 124 rupture when the pressurization reaches a predetermined pressure value. Thus, the radial passages 120*c* and 120*d* of the tubular support 120 are opened so that the annular region 127 is in fluid communication with the internal passage 138*a* of the expandable tubular member 138.

As a result, the fluidic material 158 flows through the radial passages 120*c* and 120*d*, thereby pressurizing the portion of the internal passage 138*a* that is below the tubular expansion cone 130. Due to this pressurization, the tubular supports 112, 114, 120 and 132, and the tubular expansion cone 130, are displaced in an upward direction 162, relative to the tubular support 126, the expandable tubular member 138, the shoe 140, the valve 150 and the plug element 160, thereby radially expanding and plastically deforming the expandable tubular member 138.

It is understood that, during operation of the apparatus 100, after radially expanding and plastically deforming the expandable tubular member 138, the tubular supports 112, 114, 120 and 132 and the tubular expansion cone 130 may be reinserted into the expandable tubular member 138, and displaced in a downward direction, relative to the tubular support 126, the expandable tubular member 138, the shoe 140, the valve 150 and the plug element 160, and for any conventional reason, until the distal ends of the lugs 120*f* contact the bottom surfaces of the corresponding lug pockets 142*i*.

It is further understood that, after radially expanding and plastically deforming the expandable tubular member 138, the shoe 140 may be drilled out in any conventional manner for any conventional reason such as, for example, continuing with the next drilling operation. It is further understood that, due to the lower component 144 of the shoe 140 having a lower material hardness, the drill-out time for the shoe may be reduced.

In several exemplary embodiments, it is understood that one or more of the operational steps in each embodiment may be omitted.

Figure 8:
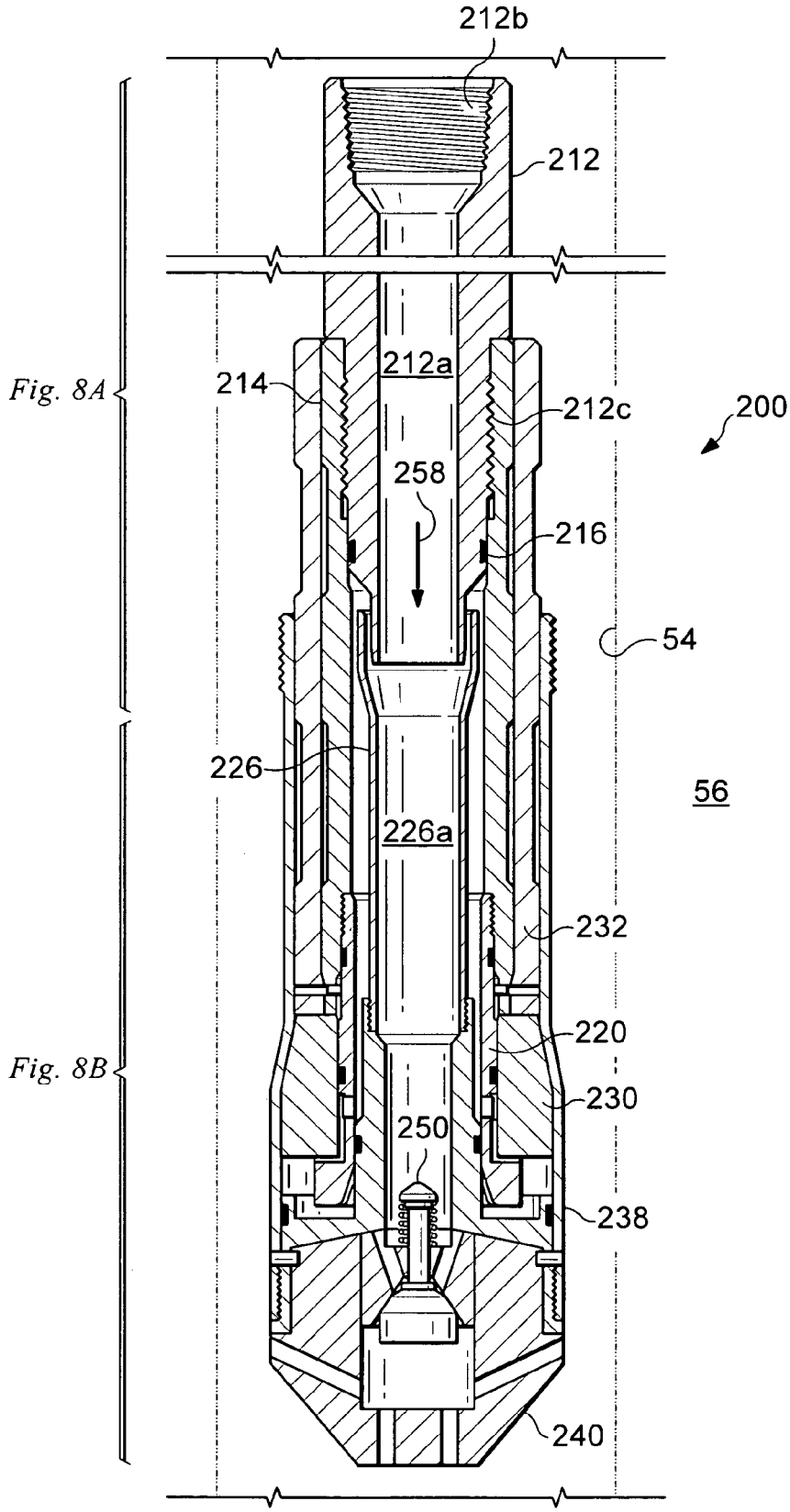
FIGS. 8, 8*a* and 8*b* are fragmentary cross-sectional illustrations of an embodiment of an apparatus for radially expanding and plastically deforming a tubular member during the placement of the apparatus within a wellbore.
Figure 8A:
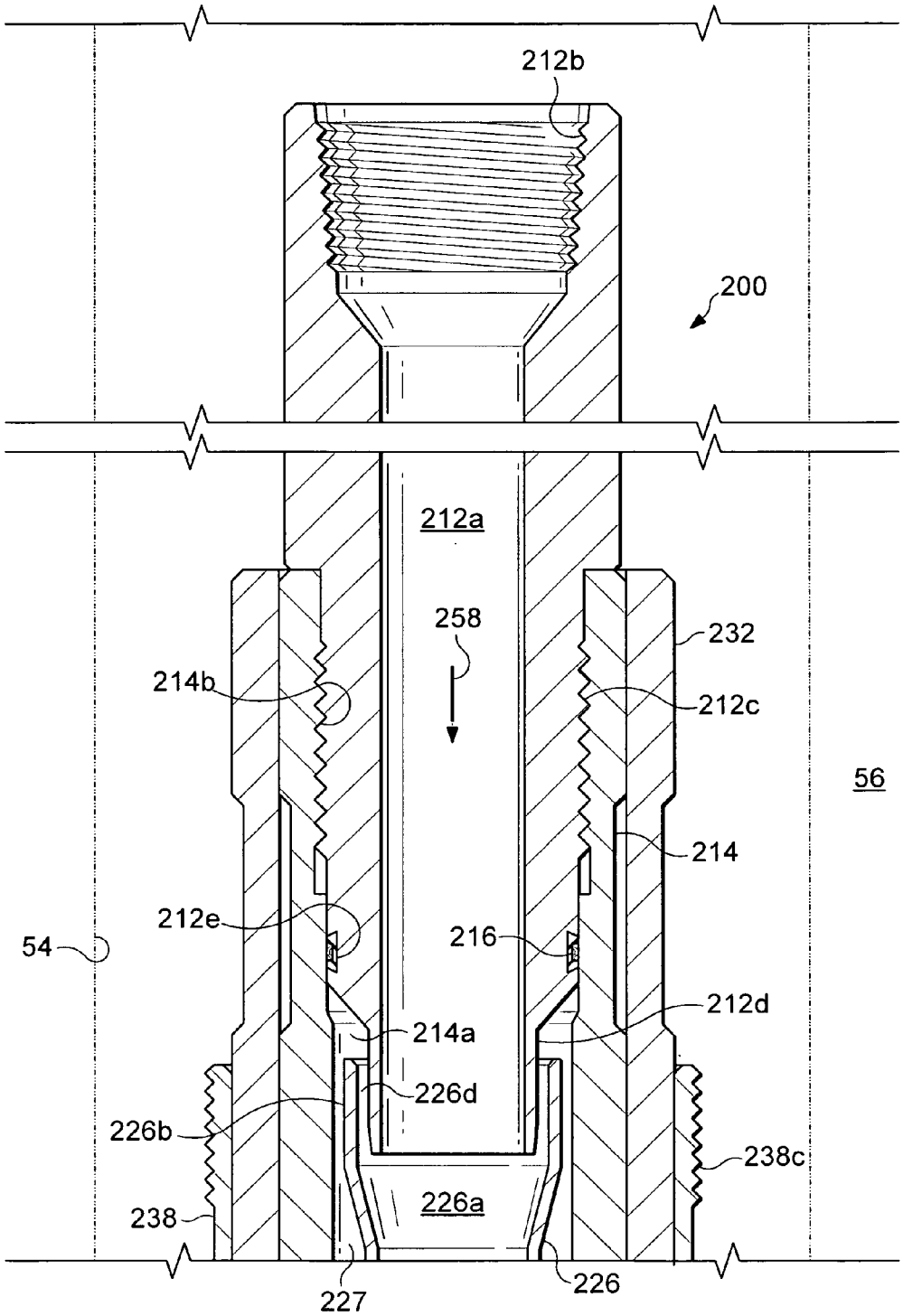
Figure 8B:
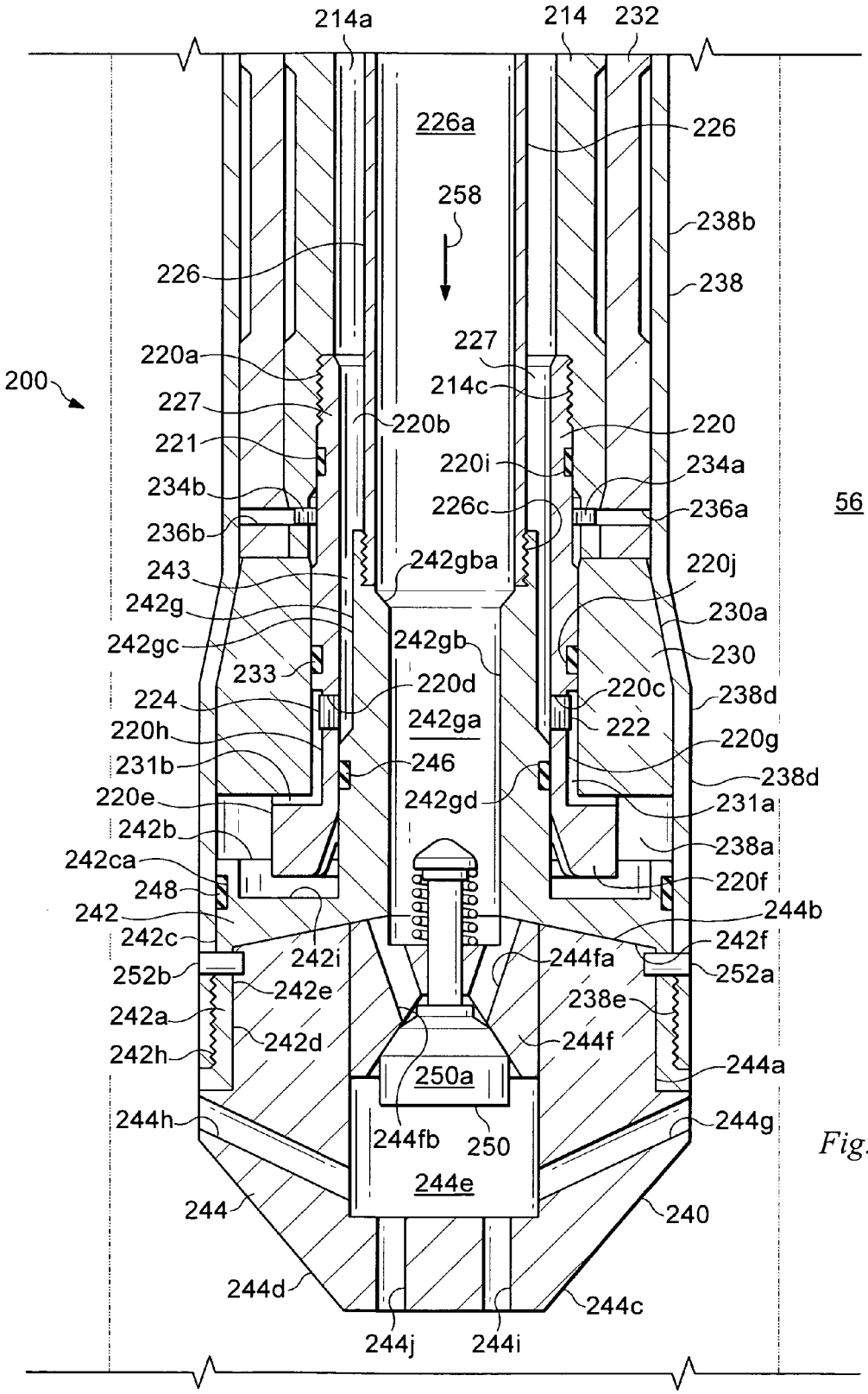

Referring to FIGS. 8, 8*a* and 8*b*, an exemplary embodiment of an apparatus 200 for radially expanding and plastically deforming a tubular member includes a tubular support 212 that defines an internal passage 212*a*, and includes a threaded connection 212*b* at one end, a threaded connection 212*c* and a reduced-diameter portion 212*d* at the other end. In an exemplary embodiment, during operation of the apparatus 200, a threaded end of a conventional tubular support member (not shown) that defines an internal passage such as, for example, a tubular string in the form of coiled tubing, jointed tubing, or the like, may be coupled to the threaded connection 212*b* of the tubular support member 212.

An end of a tubular support 214 that defines an internal passage 214*a* and includes threaded connections 214*b* and 214*c*, is coupled to the other end of the tubular support 212. A crimp seal 216 is disposed in an annular channel 212*e* formed in the external surface of the tubular support 212 and sealingly engages the wall of the internal passage 214*a*. The crimp seal 216 is identical to the crimp seal 16 of the embodiment of FIGS. 1, 1*a*, 1*b*, 1*c*, 1*d* and 1*e* and therefore will not be described in detail. It is understood that the crimp seal 216 may be a high-temperature crimp seal.

A threaded connection 220*a* of an end of a tubular support 220 that defines an internal passage 220*b* and radial passages 220*c* and 220*d*, and includes an external flange 220*e*, and includes a plurality of circumferentially-spaced high-torque lugs 220*f* at the other end, is coupled to the threaded connection 214*c* of the other end of the tubular support 214. In an exemplary embodiment, the tubular support 220 includes four circumferentially-spaced high-torque lugs 220*f*. Circumferentially-spaced cavities 220*g* and 220*h* are formed in the external surface of the tubular support 220 in the vicinity of the radial passages 220*c* and 220*d*, respectively, and extend from the radial passages to the external flange 220*e*. A sealing element 221 extends in an annular channel 220*i* formed in the external surface of the tubular support 220 and sealingly engages the internal surface of the tubular support 214.

Rupture discs 222 and 224 are received and mounted within the radial passages 220*c* and 220*d*, respectively, of the tubular support 220. The rupture discs 222 and 224 are substantially similar to the rupture discs 22 and 24, respectively, of the embodiment of FIGS. 1,1*a*, 1*b*, 1*c*, 1*d* and 1*e* and therefore will not be described in detail.

An end of a tubular support 226 that defines an internal passage 226*a* and an increased-diameter portion 226*b*, and includes a threaded connection 226*c*, extends within the internal passages 214*a* and 220*b* so that the reduced-diameter portion 212*d* of the tubular support 212 extends within the increased-diameter portion 226*b*, thereby defining an annular region 226*d* between the external surface of the reduced-diameter portion and the internal surface of the increased-diameter portion. An annular region 227 is defined by the external surface of the tubular support 226 and the internal surfaces of the tubular supports 214 and 220. Thus, the internal passage 226*a* is in fluid communication with the annular region 227 via the annular region 226*d*.

A tubular expansion cone 230 that includes a tapered external expansion surface 230*a* is coupled to the external surface of the tubular support 220, circumferentially extending around the tubular support 220 so that an end of the tubular expansion cone abuts the external flange 220*e* (abutment not shown in FIGS. 8 and 8*b* due to the cavities 220*g* and 220*h*). Internal passages 231*a* and 231*b* are defined by the external surfaces of the tubular support 220 that are defined by the cavities 220*g* and 220*h*, respectively. The internal passages 231*a* and 231*b* are further defined by the internal surface of, and the end of, the tubular expansion cone 230.

A tubular support 232 is coupled to the tubular support 214 so that the tubular support 214 extends within the tubular support 232 and so that an end of the tubular support 232 is substantially flush with an end of the tubular support 214. The other end of the tubular support 232 abuts the other end of the tubular expansion cone 230. A sealing element 233 extends in an annular channel 220*j* formed in the external surface of the tubular support 220 and sealingly engages the internal surface of the tubular expansion cone 230. Set screws 234*a* and 234*b* extend through and threadably engage radial passages 236*a* and 236*b*, respectively, that are formed through the tubular supports 214 and 232. The distal ends of the set screws 234*a* and 234*b* contact and apply pressure against the external surface of the tubular support 220, thereby reducing the possibility of decoupling and/or relative movement between two or more of the tubular supports 214, 220 and 232 and parts coupled and/or engaged thereto during the operation of the apparatus 200, discussed below.

An expandable tubular member 238 that defines an internal passage 238*a* for receiving the tubular supports 214, 220, 226 and 232 mates with and is supported by the external expansion surface 230*a* of the tubular expansion cone 230. The expandable tubular member 238 includes an upper portion 238*b* having a smaller inside diameter and a threaded connection 238*c*, and further includes a lower portion 238*d* having a larger inside diameter and a threaded connection 238*e*. It is understood that another expandable tubular member may be coupled to the expandable tubular member 238 via the threaded connection 238*c*, and yet another expandable tubular member may be coupled to the former in a similar manner and so on, thereby forming a string of expandable tubular members having a continuous internal passage.

A nose or shoe 240 is coupled to the lower portion 238*d* of the expandable tubular member 238 via the threaded connection 238*e*. The shoe 240 includes an upper component 242 composed of a material having a material hardness, and a lower component 244 coupled to the upper component and composed of another material having another material hardness. In an exemplary embodiment, the material hardness of the material of the lower component 244 may be less than the material hardness of the material of the upper component 242. In an exemplary embodiment, the upper component 242 may be composed of an aluminum alloy and the lower component 244 may be composed of a composite material. In another exemplary embodiment, the upper component 242 may be composed of an aluminum alloy and the lower component 244 may be composed of a concrete material. It is understood that the upper component 242 and the lower component 244 may each be composed of a wide variety of materials.

A casing 242*a* of the upper component 242 defines external surfaces 242*b* and 242*c* and a cavity 242*d* having internal surfaces 242*e* and 242*f*. An annular portion 242*g* extends in an upward direction from the external surface 242*b*. The annular portion 242*g* is coupled to the tubular support 226 via the threaded connection 226*c*, and defines an internal passage 242*ga* and a plug seat 242*gb* including a lead-in angled surface 242*gba*, and includes a reduced-diameter portion 242*gc* . An annular region 243 is defined by the external surface of the reduced-diameter portion 242*gc* of the annular portion 242*g* and the internal surface of the tubular support 220. The annular regions 227 and 243 are concentrically aligned and are in fluid communication with each other. Thus, the internal passage 226*a* of the tubular support 226 is in fluid communication with the annular region 243 via the annular regions 226*d* and 227.

A threaded connection 242*h* is coupled to the threaded connection 238*e*. Circumferentially-spaced lug pockets 242*i* for receiving the lugs 220*f* of the tubular support 220 are formed in the external surface 242*b*, thereby enabling torque loads or other types or combinations of loads to be transmitted between the tubular support 220 and the shoe 240 at any point during operation of the apparatus 200, discussed below, and/or for any conventional reason before, during or after the operation of the apparatus. In an exemplary embodiment, a quantity of eight circumferentially-spaced lug pockets 242*i* may be formed in the external surface 242*b*.

A sealing element 246 extends in an annular groove 242*gd* formed in the external surface of the annular portion 242*g* and sealingly engages the internal surface of the tubular support 220. A sealing element 248 extends in an annular groove 242*ca* in the external surface 242*c* and sealingly engages the internal surface of the expandable tubular member 238.

The lower component 244 is disposed in the cavity 242*d* and coupled to the upper component 242. External surfaces 244*a* and 244*b* are defined and are mated against the internal surfaces 242*e* and 242*f*, respectively. It is understood that the lower component 244 may be coupled to the upper component 242 via one or more threaded engagements, adhesives, friction or other conventional coupling techniques, or any combination thereof, so that torque loads or other types or combinations of loads may be easily transferred between the components. It is further understood that internal ribs (not shown) may extend from the internal surface 242*e* and/or 242*f* in order to facilitate the transmission of loads between the upper component 242 and the lower component 244.

Although tapered surfaces 244*c* and 244*d* are defined by the lower component 244, it is understood that the portion of the lower component extending below the upper component 242 may be substantially cylindrical.

A cavity 244*e* is formed in the lower component 244, and a valve seat portion 244*f* of the lower component is disposed in the cavity, extending from the internal walls therefrom. Passages 244*fa* and 244*fb* are formed through the valve seat portion 244*f*, fluidically connecting the internal passage 242*ga* to the cavity 244*e*. Passages 244*g*, 244*h*, 244*i* and 244*j* are formed through the lower component 244, fluidically connecting the cavity 244*e* to the environment outside of the apparatus 200.

A one-way poppet valve 250 is movably coupled to the valve seat portion 244*f* of the lower component 244 of the shoe 240, and includes a valve element 250*a* for controllably sealing the passages 244*fa* and 244*fb*. In an exemplary embodiment, the one-way poppet valve 250 only permits fluidic materials to be exhausted from the apparatus 200.

Shear pins 252*a* and 252*b* extend through the expandable tubular member 238 and the upper component 242, and into the lower component 244 to lock the shoe 240 to the expandable tubular member. In an exemplary embodiment, the shear pins 252*a* and 252*b* may extend through the threaded connections 238*e* and 242*h*. In an exemplary embodiment, the shear pins 252*a* and 252*b* may be in the form of knurled drive-in shear pins, in which case it is understood that the shear pins can be easily installed and removed with a conventional tool such as, for example, a slide hammer.

During operation, with continuing reference to FIGS. 8, 8*a* and 8*b*, the apparatus 200 is positioned within a preexisting structure such as, for example, the wellbore 54 that transverses the subterranean formation 56. In an exemplary embodiment, during or after the positioning of the apparatus 200 within the wellbore 54, fluidic material 258 may be circulated through and out of the apparatus into the wellbore through the internal passages 212*a*, 226*a*, 242*ga*, 244*fa* and 244*fb*, the cavity 244*e* and the internal passages 244*g*, 244*h*, 244*i* and 244*j*.

In an exemplary embodiment, movement of the tubular supports 212, 214, 220 and 232 and the tubular expansion cone 230, relative to the tubular support 226, the expandable tubular member 238, the shoe 240 and the valve 250, is possible in either an upward or downward direction as long as there is a gap between the distal ends of the lugs 220*f* and the bottom surfaces of the corresponding lug pockets 242*i* of the upper component 242 of the shoe 240. For example, when the apparatus 200 encounters a resistance during placement in the wellbore 54 such as, for example, the shoe 240 becoming jammed or stuck in the wellbore 54, the tubular supports 212, 214, 220 and 232 and the tubular expansion cone 230 may move downward, relative to the tubular support 226, the expandable tubular member 238, the shoe 240 and the valve 250, until the distal ends of the lugs 220*f* contact the bottom surfaces of the corresponding lug pockets 242*i*. At this point, torque loads or other types or combinations of loads may be applied to the apparatus 200 in any conventional manner in an effort to free the apparatus 200 from the aforementioned resistance. It is understood that the degree of movement of the tubular supports 212, 214, 220 and 232 and the tubular expansion cone 230 may also be limited by the gap between the end of the tubular support 226 adjacent the increased-diameter portion 226*b* and the transition region of the tubular support 212 between the reduced-diameter portion 212*d* and the remainder of the tubular support 212, and/or by the degree of extension of the reduced-diameter portion 212*d* into the tubular support 226.

Figure 9:
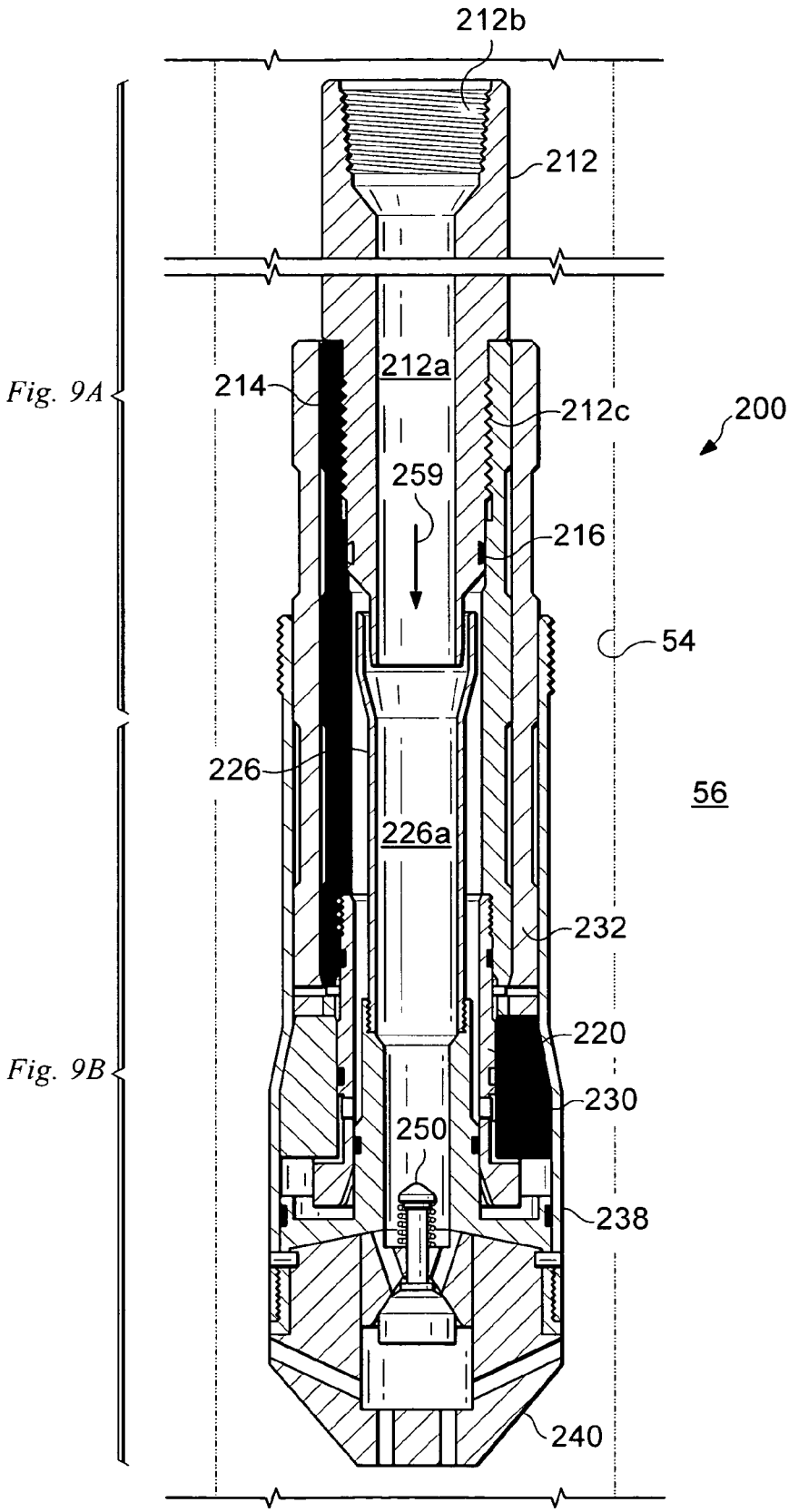
FIGS. 9, 9*a* and 9*b* are fragmentary cross-sectional illustrations of the apparatus of FIGS. 8, 8*a* and 8*b* during the injection of a hardenable fluidic sealing material into an annulus between the exterior of the apparatus and the wellbore.
Figure 9A:
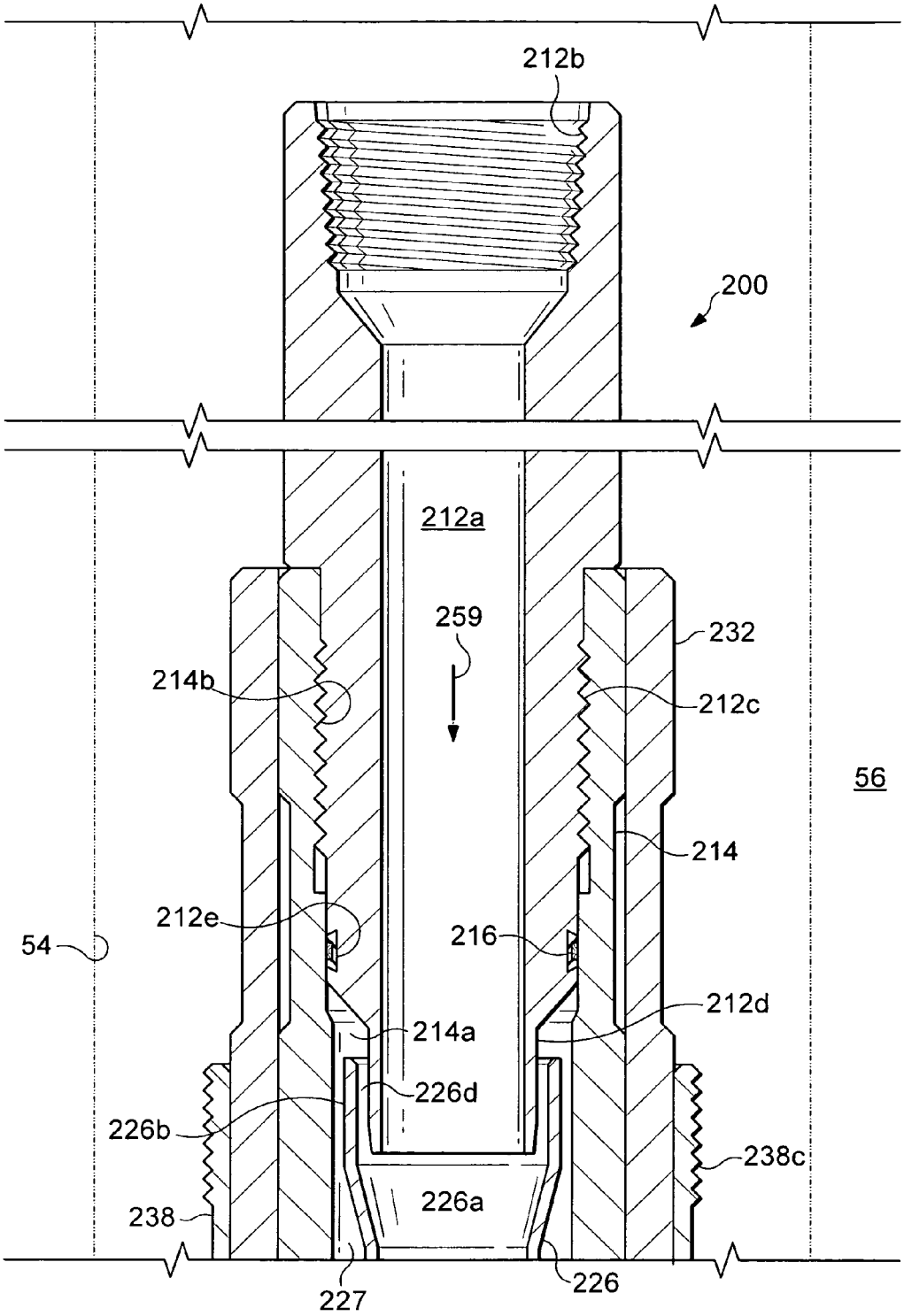
Figure 9B:
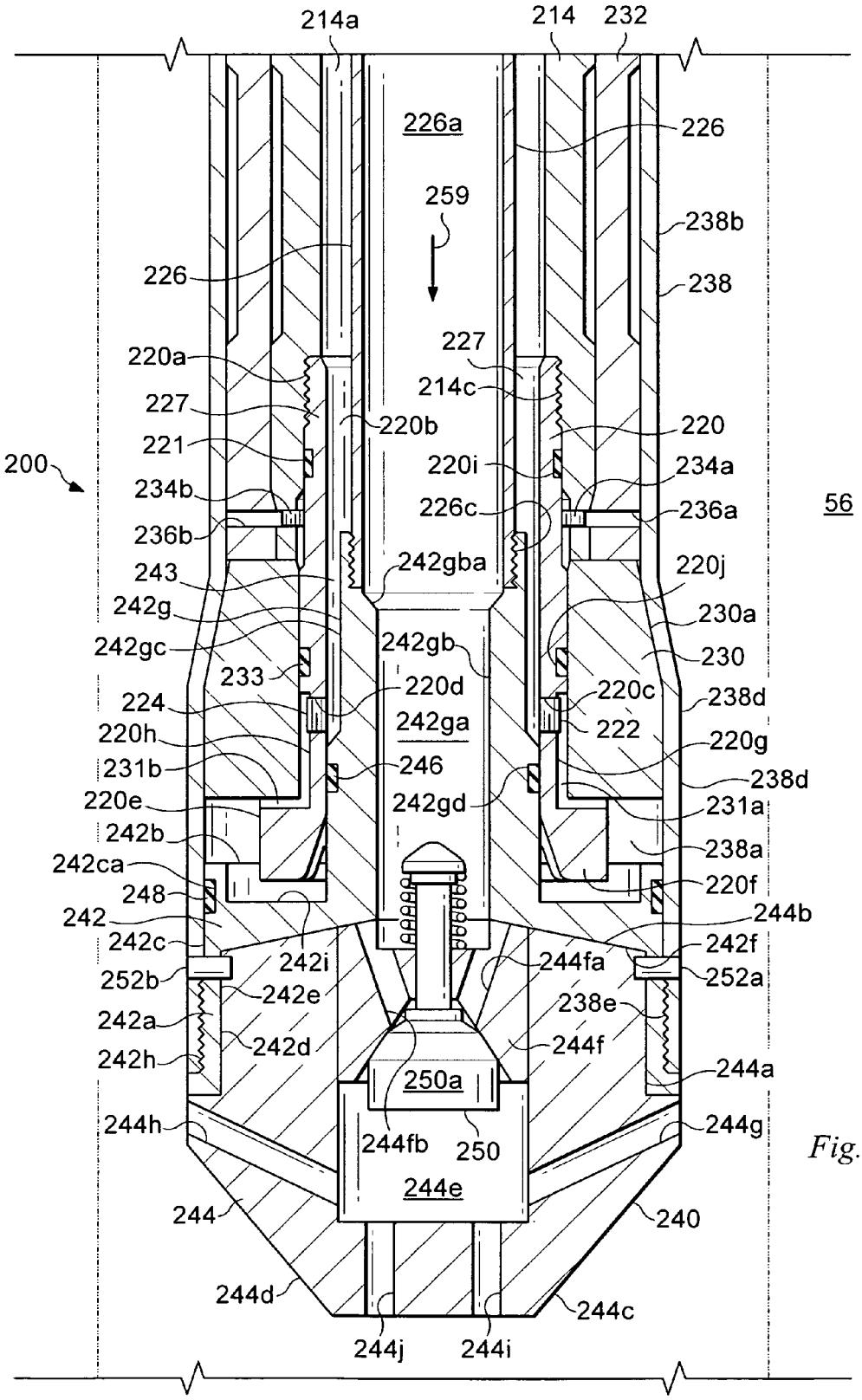

In an exemplary embodiment, as illustrated in FIGS. 9, 9*a* and 9*b*, with continuing reference to FIGS. 8, 8*a* and 8*b*, the apparatus 200 may be placed in the desired position within the wellbore 54 such as, for example, the apparatus may be set down onto the bottom of the wellbore. At this point, a hardenable fluidic sealing material 259 may be injected into the apparatus 200 through the internal passages 212*a*, 226*a*, 242*ga*, 244*fa* and 244*fb*, the cavity 244*e* and the internal passages 244*g*, 244*h*, 244*i* and 244*j*, and into the annulus defined between the external surface of the expandable tubular member 238 and the internal surface of the wellbore 54. As a result, an annular body of the hardenable fluidic sealing material 259 such as, for example, cement, is formed within the annulus between the external surface of the expandable tubular member 238 and the internal surface of the wellbore 54.

Figure 10:
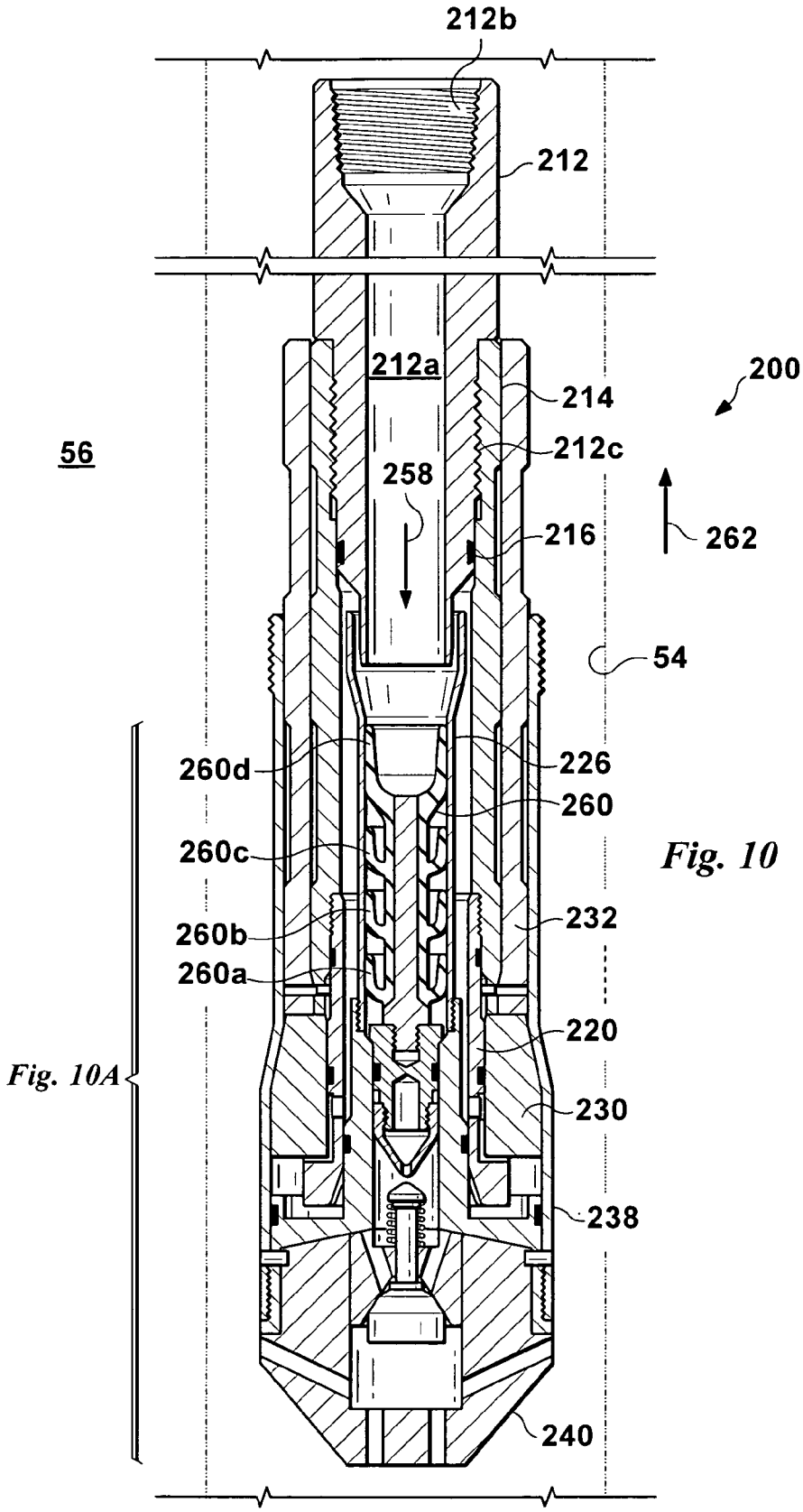
FIGS. 10 and 10*a* is a cross-sectional illustration of the apparatus of FIGS. 8, 8*a* and 8*b* and an enlarged view of a portion thereof, respectively, during the radial expansion and plastic deformation of the tubular member.
Figure 10A:
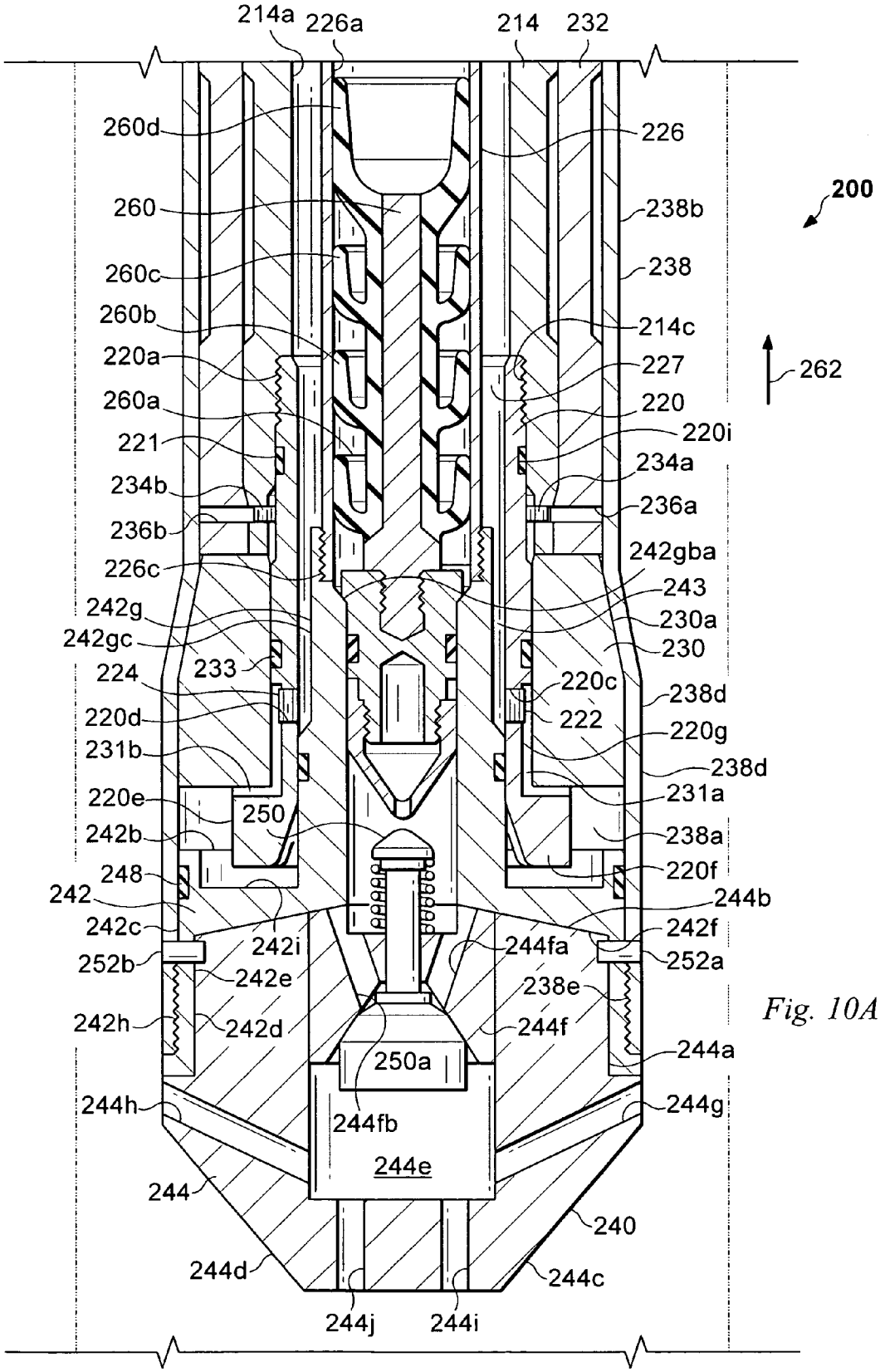

In an exemplary embodiment, as illustrated in FIGS. 10 and 10*a*, with continuing reference to FIGS. 8, 8*a*, 8*b*, 9, 9*a* and 9*b*, during operation of the apparatus 200, a plug element 260 having wipers 260*a*, 260*b*, 260*c* and 260*d* may be injected into the apparatus, along with the fluidic material 258 and through the passages 212*a*, 226*a* and 242*ga*, until the plug element 260 is seated in the plug seat 242*gb*. At this point, the plug element 260 sealingly engages the plug seat 242*gb*, and the wipers 260*a*, 260*b*, 260*c* and 260*d* sealingly engage the internal surface of the tubular support 226. As a result, any flow of fluidic material through the internal passages 226*a* is blocked. It is understood that the plug element 260 may be injected into the apparatus 200 before, during or after the above-described circulation of the fluidic material 258 through and out of the apparatus.

Continued injection of the fluidic material 258 into the apparatus 200, following the seating of the plug element 260 in the plug seat 242*gb*, pressurizes the internal passage 226*a* of the tubular support 226. This pressurization causes the fluidic material 258 in the internal passage 226*a* to flow into the annular region 227 via the annular region 226*d*, and axially through the annular regions 227 and 243 until reaching the rupture discs 222 and 224. The rupture discs 222 and 224 rupture when the pressurization reaches a predetermined pressure value. The radial passages 220*c* and 220*d* are thereby opened and the annular region 243 is in fluid communication with the internal passage 238*a* of the expandable tubular member 238 via the internal passages 231*a* and 231*b* and the radial passages.

As a result, the fluidic material 258 flows through the radial passages 220*c* and 220*d* and the internal passages 231*a* and 231*b*, thereby pressurizing the portion of the internal passage 238*a* that is below the tubular expansion cone 230. Due to this pressurization, the tubular supports 212, 214, 220 and 232, and the tubular expansion cone 230, are displaced in an upward direction 262, relative to the tubular support 226, the expandable tubular member 238, the shoe 240, the valve 250 and the plug element 260, thereby radially expanding and plastically deforming the expandable tubular member 238.

It is understood that, during operation of the apparatus 200, after radially expanding and plastically deforming the expandable tubular member 238, the tubular supports 212, 214, 220 and 232 and the tubular expansion cone 230 may be reinserted into the expandable tubular member 238, and displaced in a downward direction, relative to the tubular support 226, the expandable tubular member 238, the shoe 240, the valve 250 and the plug element 260, and for any conventional reason, until the distal ends of the lugs 220*f* contact the bottom surfaces of the corresponding lug pockets 242*i*.

It is further understood that, after radially expanding and plastically deforming the expandable tubular member 238, the shoe 240 may be drilled out in any conventional manner for any conventional reason such as, for example, continuing with the next drilling operation. It is further understood that, due to the lower component 244 of the shoe 240 having a lower material hardness, the drill-out time for the shoe may be reduced.

In several exemplary embodiments, it is understood that one or more of the operational steps in each embodiment may be omitted.

Figure 11:
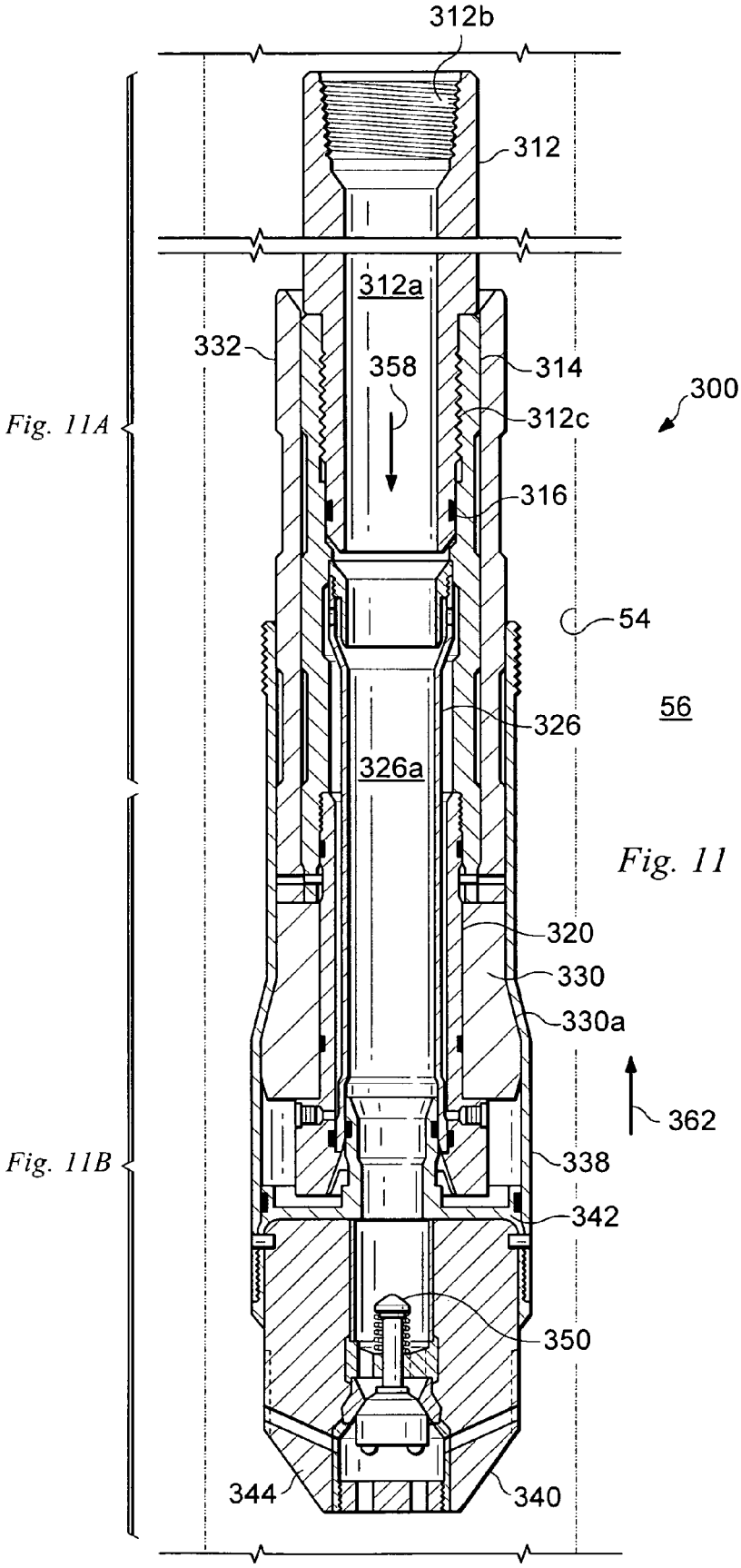
FIGS. 11, 11*a* and 11*b* are fragmentary cross-sectional illustrations of an embodiment of an apparatus for radially expanding and plastically deforming a tubular member during the placement of the apparatus within a wellbore.
Figure 11A:
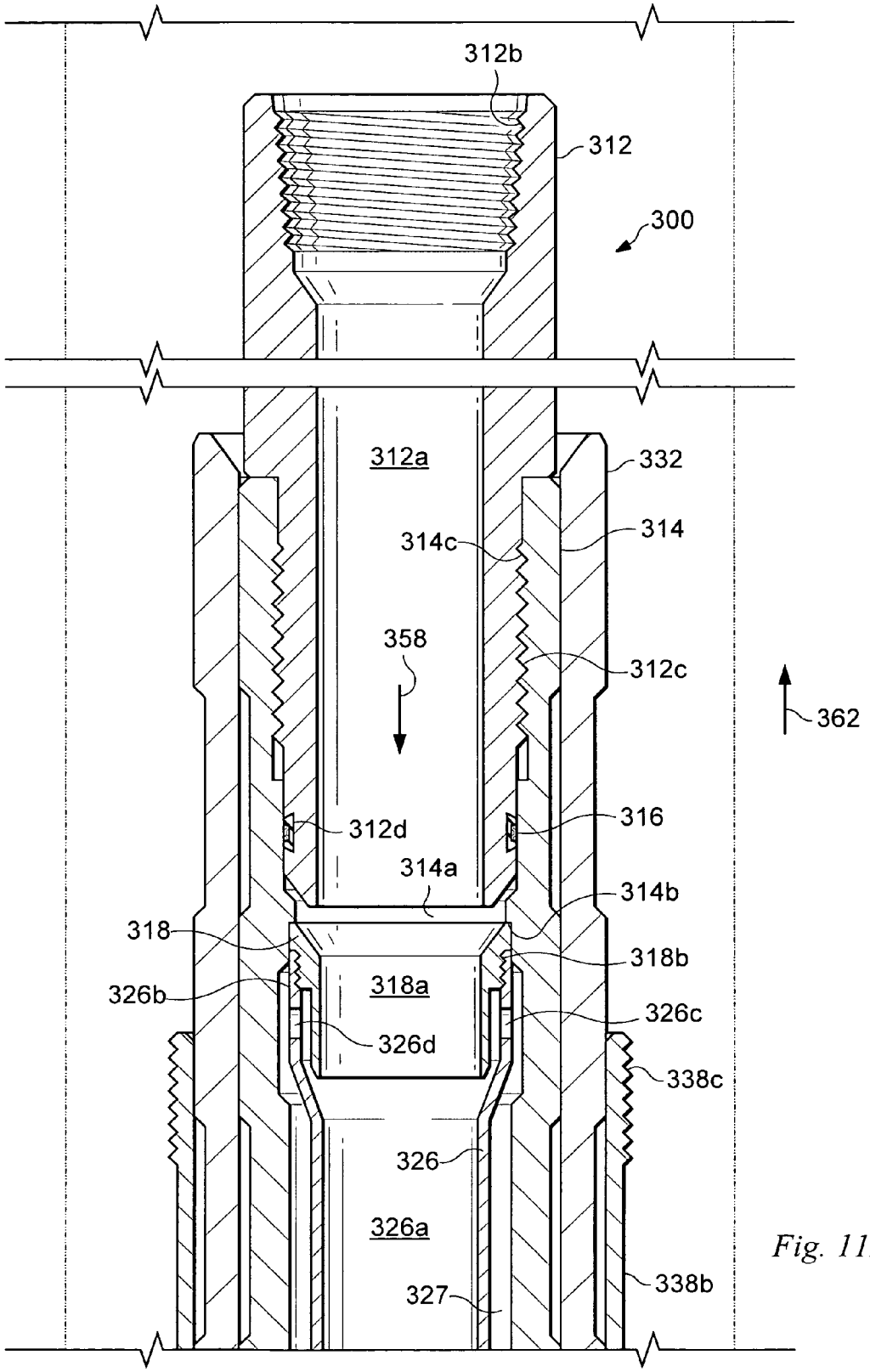
Figure 11B:
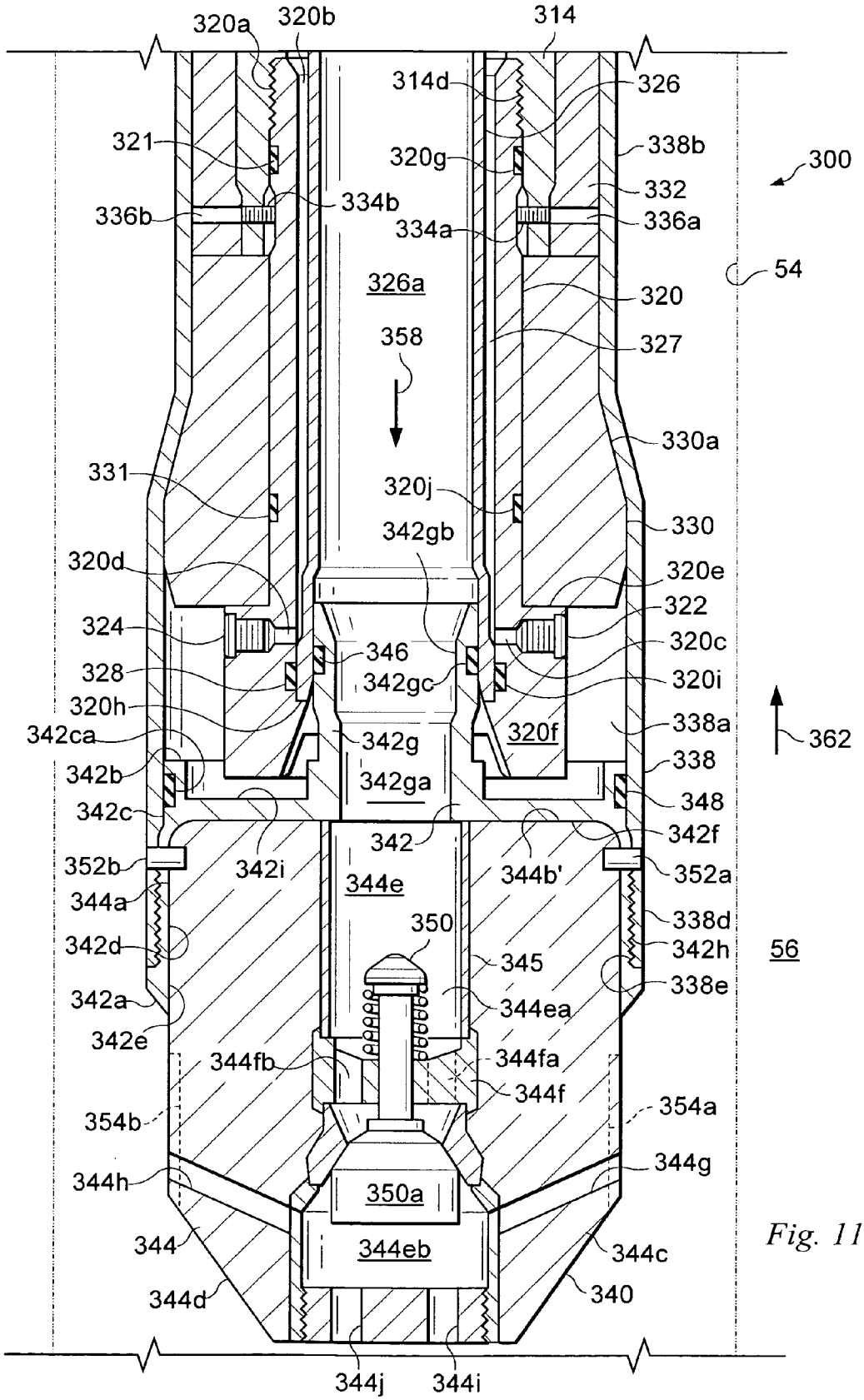

Referring to FIGS. 11, 11*a* and 11*b*, an exemplary embodiment of an apparatus 300 for radially expanding and plastically deforming a tubular member includes a tubular support 312 that defines an internal passage 312*a*, and includes a threaded connection 312*b* at one end and a threaded connection 312*c* at the other end. In an exemplary embodiment, during operation of the apparatus 300, a threaded end of a conventional tubular support member (not shown) that defines an internal passage such as, for example, a tubular string in the form of coiled tubing, jointed tubing, or the like, may be coupled to the threaded connection 312*b* of the tubular support member 312.

An end of a tubular support 314 that defines an internal passage 314*a* having a variable inside diameter, and includes a shoulder 314*b* and threaded connections 314*c* and 314*d*, is coupled to the other end of the tubular support 312. A crimp seal 316 is disposed in an annular channel 312*d* formed in the external surface of the tubular support 312 and sealingly engages the wall of the internal passage 314*a*. The crimp seal 316 is identical to the crimp seal 16 of the embodiment of FIGS. 1, 1*a*, 1*b*, 1*c*, 1*d* and 1*e* and therefore will not be described in detail. It is understood that the crimp seal 316 may be a high-temperature crimp seal.

A coupler 318 that defines an internal passage 318*a*, and includes a threaded connection 318*b*, is disposed in the internal passage 314*a* and is coupled to the tubular support 314, contacting the shoulder 314*b*.

A threaded connection 320*a* of an end of a tubular support 320 that defines an internal passage 320*b* and radial passages 320*c* and 320*d*, and includes an external flange 320*e*, and includes a plurality of circumferentially-spaced high-torque lugs 320*f* at the other end is coupled to the threaded connection 314*d* of the other end of the tubular support 314. In an exemplary embodiment, the tubular support 320 includes four circumferentially-spaced high-torque lugs 320*f*. A sealing element 321 extends in an annular channel 320*g* formed in the external surface of the tubular support 320 and sealingly engages the internal surface of the tubular support 314. An internal shoulder 320*h* of the tubular support 320 is defined between the radial passages 320*c* and 320*d* and the distal ends of the high-torque lugs 320*f*.

Rupture discs 322 and 324 are received and mounted within the radial passages 320*c* and 320*d*, respectively, of the tubular support 320. The rupture discs 322 and 324 are substantially similar to the rupture discs 22 and 24, respectively, of the embodiment of FIGS. 1, 1*a*, 1*b*, 1*c*, 1*d* and 1*e* and therefore will not be described in detail.

An end of a tubular support 326 that defines an internal passage 326*a* and an increased-diameter portion 326*b* is coupled to the threaded connection 318*b* of the coupler 318 and extends within the internal passages 314*a* and 320*b*, and includes an end that engages the internal shoulder 320*h* of the tubular support 320, thereby coupling the tubular support 326 and the coupler 318 to the tubular support 320. The coupler 318 partially extends within the portion of the internal passage 326*a* corresponding to the increased-diameter portion 326*b* of the tubular support 326. An annular region 327 is defined by the external surface of the tubular support 326 and the internal surfaces of the tubular supports 314 and 320.

Radial passages 326*c* and 326*d* are formed through the wall of the tubular support 326, in the vicinity of the coupler 318, so that the internal passage 326*a* is in fluid communication with the annular region 327. A sealing element 328 extends in an annular channel 320*i* formed in the internal surface of the tubular support 320 and sealingly engages the external surface of the tubular support 326. A tubular expansion cone 330 that includes a tapered external expansion surface 330*a* is coupled to the external surface of the tubular support 320, circumferentially extending around the tubular support 320 so that an end of the tubular expansion cone abuts the external flange 320*e*. A sealing element 331 extends in an annular channel 320*j* formed in the external surface of the tubular support 320 and sealingly engages the internal surface of the tubular expansion cone 330.

A tubular support 332 is coupled to the tubular support 314 so that the tubular support 314 extends within the tubular support 332. An end of the tubular support 332 abuts the other end of the tubular expansion cone 330. Set screws 334*a* and 334*b* extend through and threadably engage radial passages 336*a* and 336*b*, respectively, that are formed through the tubular supports 314 and 332. The distal ends of the set screws 334*a* and 334*b* contact and apply pressure against the external surface of the tubular support 320, thereby reducing the possibility of decoupling and/or relative movement between two or more of the tubular supports 314, 320 and 332 and parts coupled and/or engaged thereto during the operation of the apparatus 300, discussed below.

An expandable tubular member 338 that defines an internal passage 338*a* for receiving the tubular supports 314, 320, 326 and 332 and the coupler 318 mates with and is supported by the external expansion surface 330*a* of the tubular expansion cone 330. The expandable tubular member 338 includes an upper portion 338*b* having a smaller inside diameter and a threaded connection 338*c*, and further includes a lower portion 338*d* having a larger inside diameter and a threaded connection 338*e*. It is understood that another expandable tubular member may be coupled to the expandable tubular member 338 via the threaded connection 338*c*, and yet another expandable tubular member may be coupled to the former in a similar manner and so on, thereby forming a string of expandable tubular members having a continuous internal passage.

A nose or shoe 340 is coupled to the lower portion 338*d* of the expandable tubular member 338 via a threaded connection 338*e*. The shoe 340 includes an upper component 342 composed of a material having a material hardness, and a lower component 344 coupled to the upper component and composed of another material having another material hardness. In an exemplary embodiment, the material hardness of the material of the lower component 44 may be less than the material hardness of the material of the upper component 42. In an exemplary embodiment, the upper component 342 may be composed of an aluminum alloy and the lower component 344 may be composed of a composite material. In another exemplary embodiment, the upper component 342 may be composed of an aluminum alloy and the lower component 344 may be composed of a concrete material. It is understood that the upper component 342 and the lower component 344 may each be composed of a wide variety of materials.

A casing 342*a* of the upper component 342 defines external surfaces 342*b* and 342*c* and a cavity 342*d* having internal surfaces 342*e* and 342*f*. An annular portion 342*g* extends in an upward direction from the external surface 342*b* and into the internal passage 326*a* of the tubular support 326, defining an internal passage 342*ga* and a plug seat 342*gb* including a lead-in angled surface 342*gba*. A threaded connection 342*h* is coupled to the threaded connection 338*e*. Circumferentially-spaced lug pockets 342*i* for receiving the lugs 320*f* of the tubular support 320 are formed in the external surface 342*b*, thereby enabling torque loads or other types or combinations of loads to be transmitted between the tubular support 320 and the shoe 340 at any point during operation of the apparatus 300, discussed below, and/or for any conventional reason before, during or after the operation of the apparatus. In an exemplary embodiment, a quantity of eight circumferentially-spaced lug pockets 342*i* may be formed in the external surface 342*b*.

A sealing element 346 extends in an annular groove 342*gc* formed in the external surface of the annular portion 342*g* and sealingly engages the internal surface of the tubular support 326. A sealing element 348 extends in an annular groove

342*ca* in the external surface 342*c* and sealingly engages the internal surface of the expandable tubular member 338.

The lower component 344 is disposed in the cavity 342*d* and coupled to the upper component 342. External surfaces 344*a* and 344*b* are defined and are mated against the internal surfaces 342*e* and 342*f*, respectively. It is understood that the lower component 344 may be coupled to the upper component 342 via one or more threaded engagements, adhesives, friction or other conventional coupling techniques, or any combination thereof, so that torque loads or other types or combinations of loads may be easily transferred between the components. It is further understood that internal ribs (not shown) may extend from the internal surface 342*e* and/or 342*f* in order to facilitate the transmission of loads between the upper component 342 and the lower component 344.

Although tapered surfaces 344*c* and 344*d* are defined by the lower component 344, it is understood that the portion of the lower component extending below the upper component 342 may be substantially cylindrical.

An internal passage 344*e* is formed in the lower component 344, and a valve seat portion 344*f* of the lower component is disposed in the internal passage, extending from the internal walls therefrom and dividing the internal passage into sub-passages 344*ea* and 344*eb*, with a tubular support 345 extending within the passage 344*ea* from the valve seat portion 344*f* to the external surface 344*a*. Passages 344*fa* and 344*fb* are formed through the valve seat portion 344*f*. Passages 344*g*, 344*h*, 344*i* and 344*j* are formed through the lower component 344, fluidically connecting the sub-passage 344*eb* to the environment outside of the apparatus 300.

A one-way poppet valve 350 is movably coupled to the valve seat portion 344*f* of the lower component 344 of the shoe 340, and includes a valve element 350*a* for controllably sealing fluidic-material flow through the passages 344*fa* and 344*fb*. In an exemplary embodiment, the one-way poppet valve 350 only permits fluidic materials to be exhausted from the apparatus 300.

Shear pins 352*a* and 352*b* extend through the expandable tubular member 338 and the upper component 342, and into the lower component 344 to lock the shoe 340 to the expandable tubular member. In an exemplary embodiment, the shear pins 352*a* and 352*b* may be in the form of knurled drive-in shear pins, in which case it is understood that the shear pins can be easily installed and removed with a conventional tool such as, for example, a slide hammer. Anti-rotation flats 354*a* and 354*b* are formed in the lower component 344.

During operation, with continuing reference to FIGS. 11, 11*a* and 11*b*, the apparatus 300 is positioned within a preexisting structure such as, for example, the wellbore 54 that transverses the subterranean formation 56. In an exemplary embodiment, during or after the positioning of the apparatus 300 within the wellbore 54, fluidic material 358 may be circulated through and out of the apparatus into the wellbore through the internal passages 312*a*, 314*a*, 318*a*, 326*a*, 342*ga*, 344*e*, 344*fa*, 344*fb*, 344*g*, 344*h*, 344*i* and 344*j*. It is understood that the lead-in angled surface 342*gba* of the plug seat 342*gb* may reduce any turbulence present in the flow of the fluidic material 358 through the internal passage 342*ga*. In an exemplary embodiment, the angle of the lead-in angled surface 342*gba* of the plug seat 342*gb* may be about 15 degrees.

In an exemplary embodiment, movement of the tubular supports 312, 314, 320, 326 and 332, the coupler 318, and the tubular expansion cone 330, relative to the expandable tubular member 338, the shoe 340 and the valve 350, is possible in either an upward or downward direction as long as there is a gap between the distal ends of the lugs 320*f* and the bottom surfaces of the corresponding lug pockets 342*i* of the upper component 342 of the shoe 340. For example, when the apparatus 300 encounters a resistance during placement in the wellbore 54 such as, for example, the shoe 340 becoming jammed or stuck in the wellbore 54, the tubular supports 312, 314, 320, 326 and 332, the coupler 318, and the tubular expansion cone 330 may move downward, relative to the expandable tubular member 338, the shoe 340 and the valve 350, until the distal ends of the lugs 320*f* contact the bottom surfaces of the corresponding lug pockets 342*i*. At this point, torque loads or other types or combinations of loads may be applied to the apparatus 300 in any conventional manner in an effort to free the apparatus 300 from the aforementioned resistance.

Figures 12, 12A, 12B:
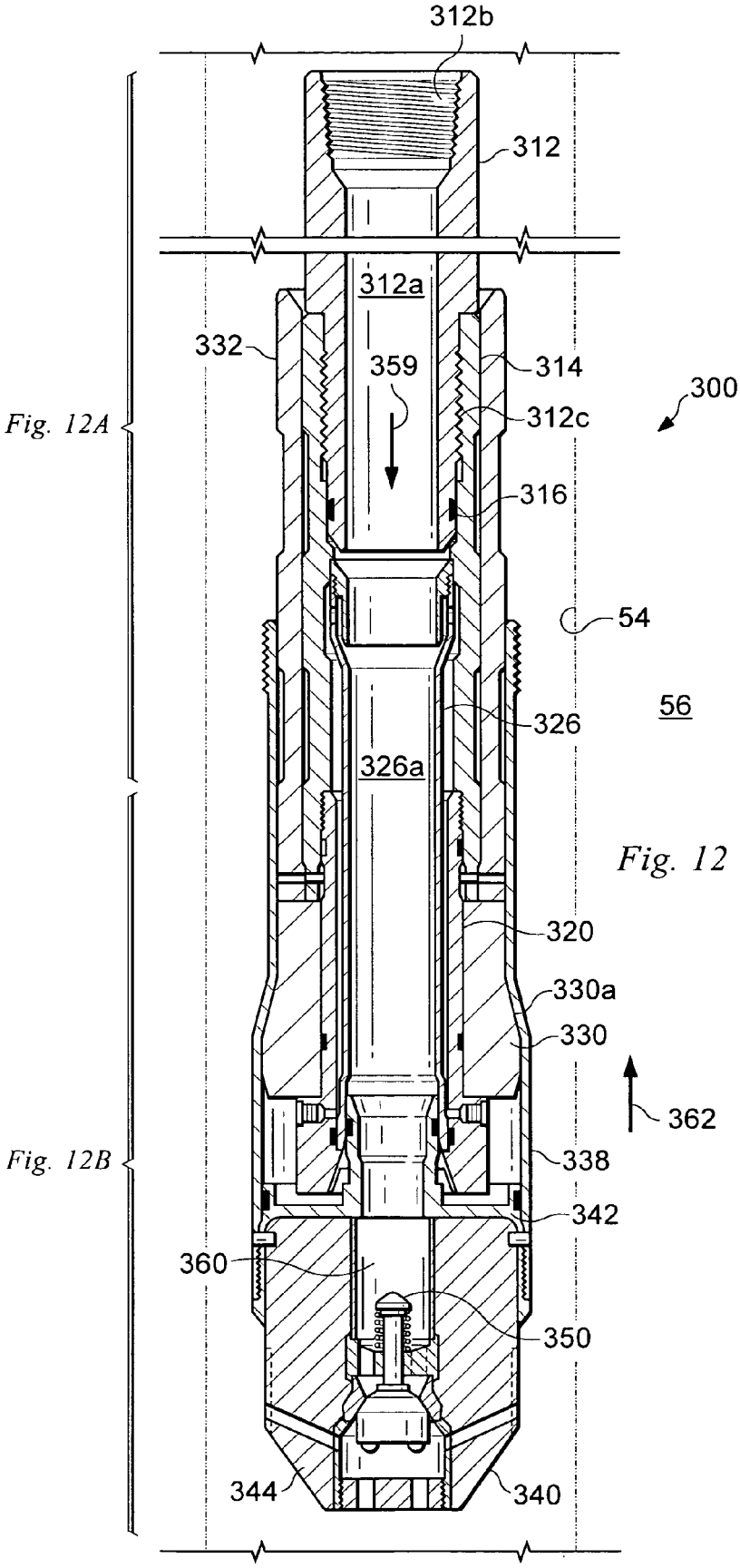
FIGS. 12, 12*a* and 12*b* are fragmentary cross-sectional illustrations of the apparatus of FIGS. 11,11*a* and 11*b* during the injection of a hardenable fluidic sealing material into an annulus between the exterior of the apparatus and the wellbore.
Figure 12A:
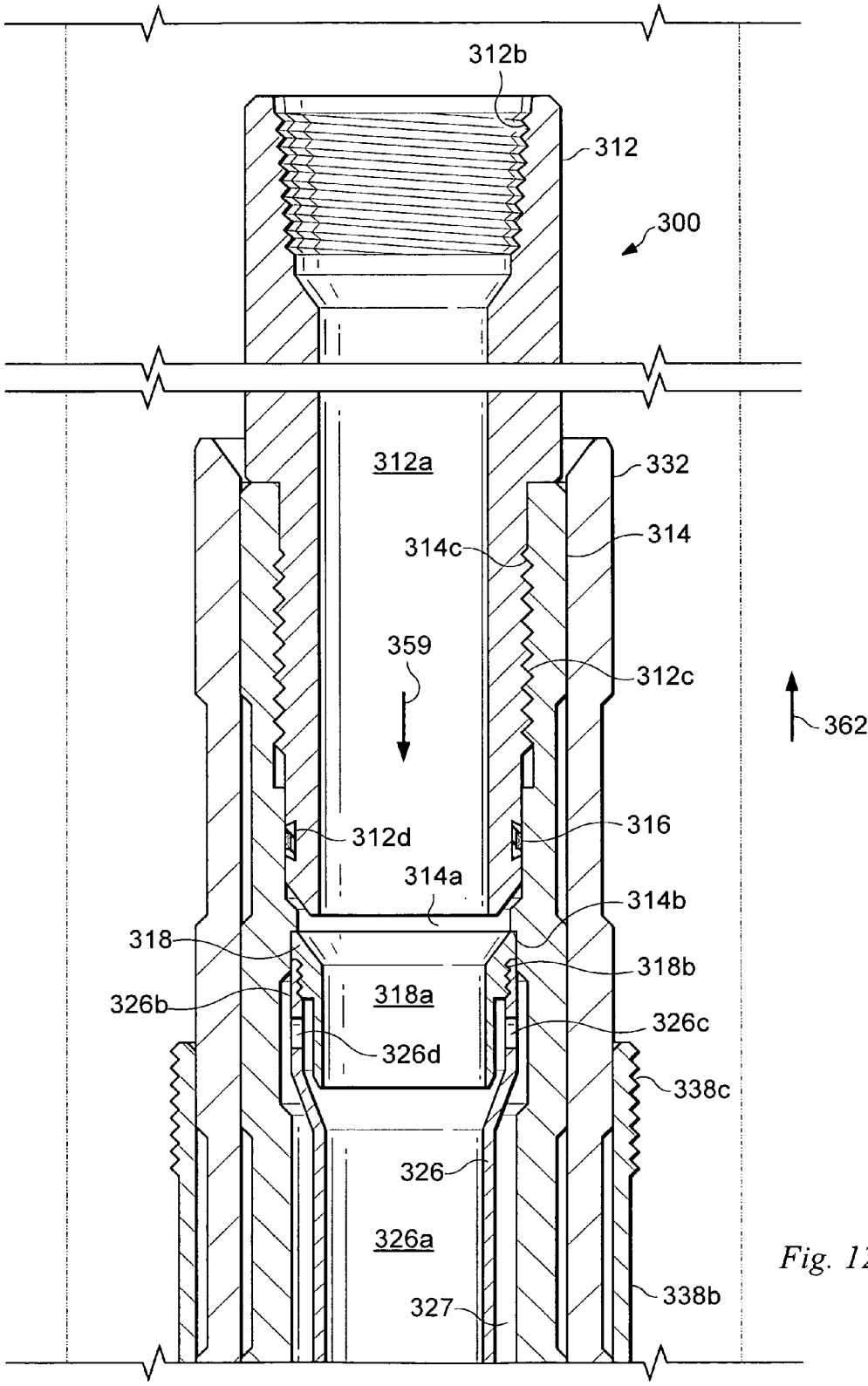
Figure 12B:
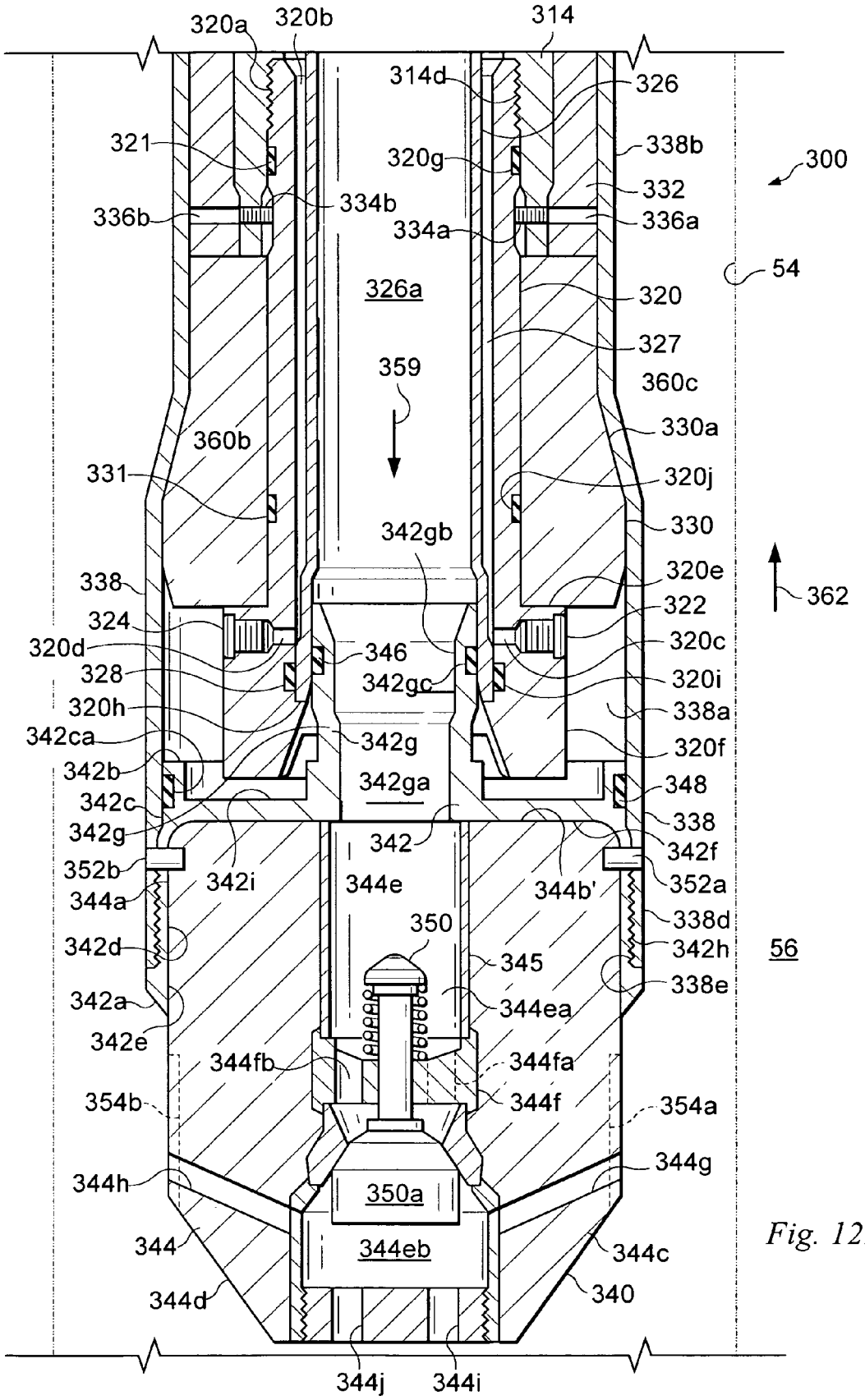

In an exemplary embodiment, as illustrated in FIGS. 12, 12*a* and 12*b*, with continuing reference to FIGS. 11, 11*a* and 11*b*, the apparatus 300 may be placed in the desired position within the wellbore 54 such as, for example, the apparatus may be set down onto the bottom of the wellbore. At this point, a hardenable fluidic sealing material 359 such as, for example, cement, may be injected into the apparatus 300 through the internal passages 312*a*, 314*a*, 318*a*, 326*a*, 342*ga*, 344*e*, 344*fa*, 344*fb*, 344*g*, 344*h*, 344*i* and 344*j*, and into the annulus defined between the external surface of the expandable tubular member 338 and the internal surface of the wellbore 54. As a result, an annular body of the hardenable fluidic sealing material 359 is formed within the annulus between the external surface of the expandable tubular member 338 and the internal surface of the wellbore 54.

Figures 13, 13A, 13B:
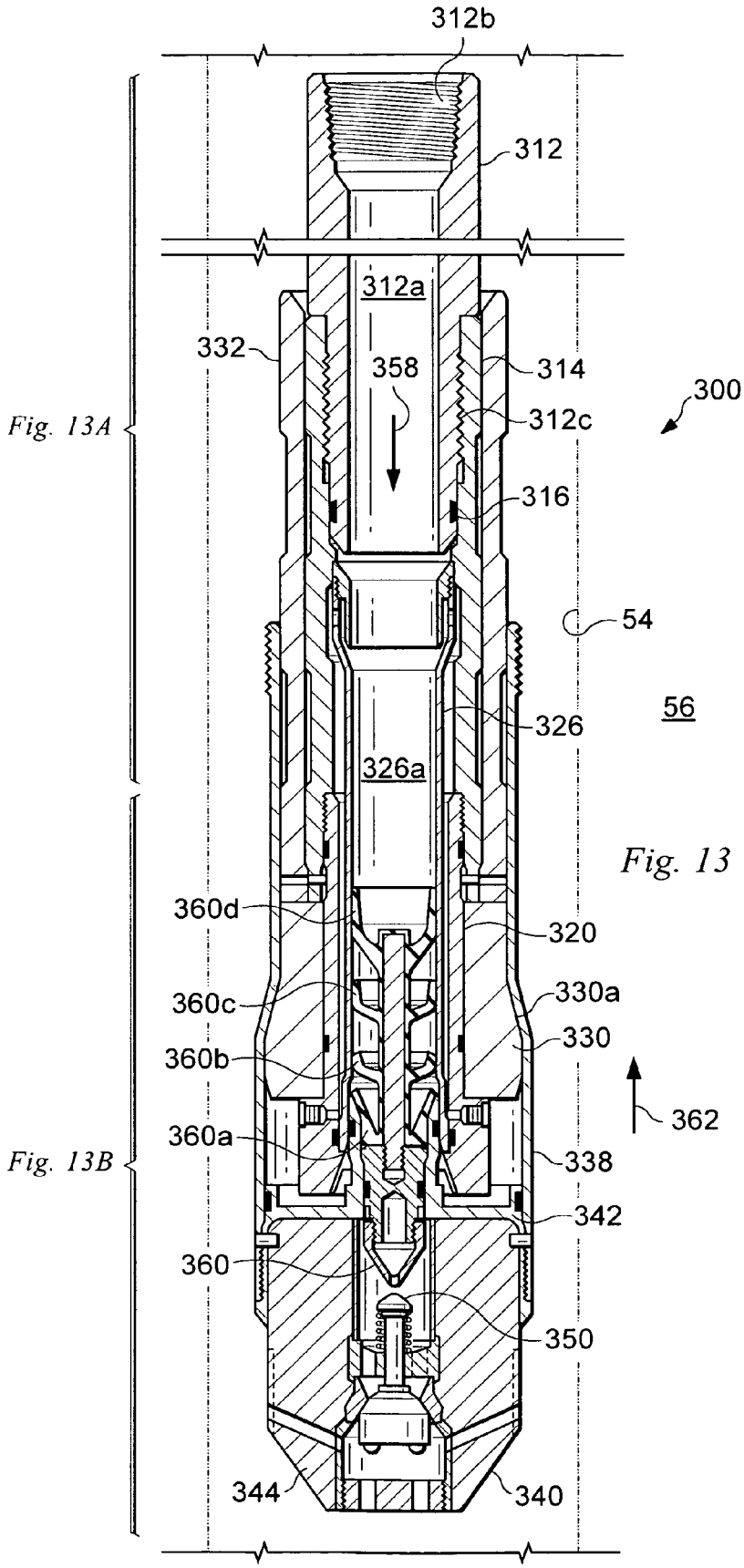
FIGS. 13, 13*a* and 13*b* are fragmentary cross-sectional illustrations of the apparatus of FIGS. 11, 11*a* and 11*b* during the radial expansion and plastic deformation of the tubular member.
Figure 13A:
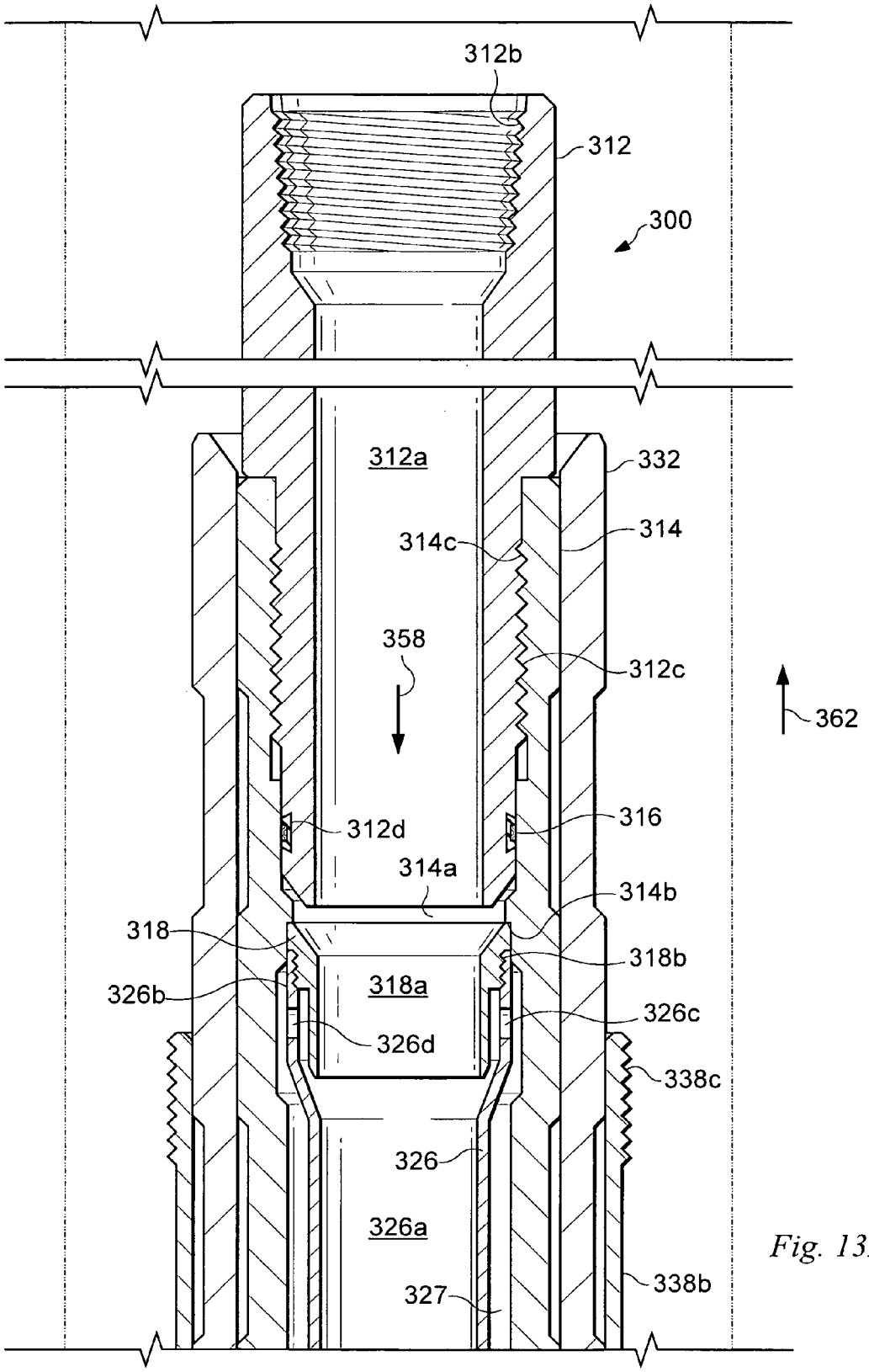
Figure 13B:
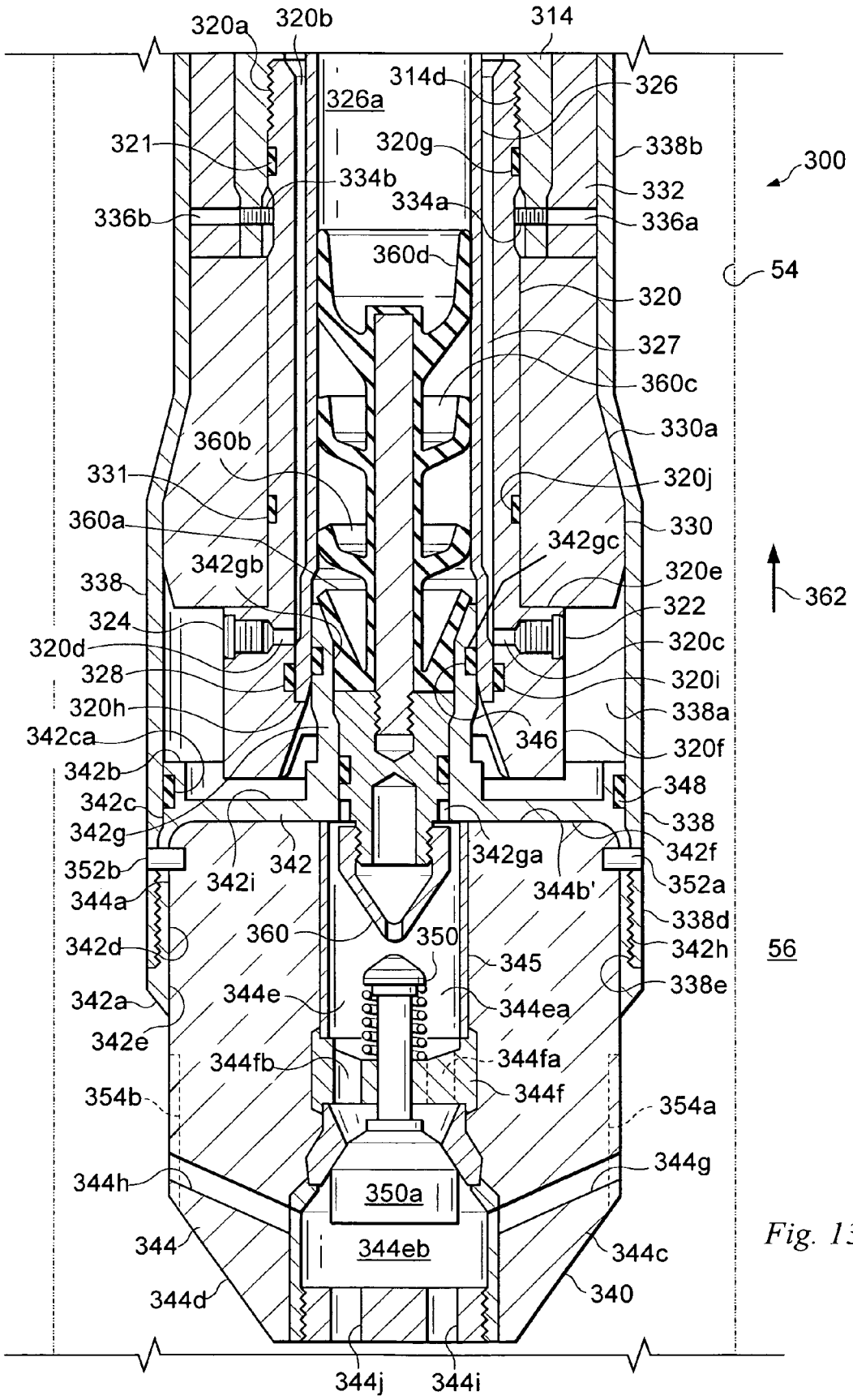

In an exemplary embodiment, as illustrated in FIGS. 13, 13*a* and 13*b*, with continuing reference to FIGS. 11, 11*a*, 11*b*, 12, 12*a* and 12*b*, during operation of the apparatus 300, a plug element 360 having wipers 360*a*, 360*b*, 360*c* and 360*d* may be injected into the apparatus, along with the fluidic material 358 and through the passages 312*a*, 314*a*, 318*a*, 326*a* and 342*ga* until the plug element 360 is seated in the plug seat 342*gb*. At this point, the plug element 360 sealingly engages the plug seat 342*gb* and the internal surface of the tubular support 326 in a manner described in detail below. As a result, any flow of fluidic material through the internal passage 326*a* is blocked. It is understood that the plug element 360 may be injected into the apparatus 300 before, during or after the above-described circulation of the fluidic material 358 through and out of the apparatus.

Continued injection of the fluidic material 358 into the apparatus 300, following the seating of the plug element 360 in the plug seat 342*gb*, pressurizes the internal passage 326*a* of the tubular support 326. This pressurization causes the fluidic material 358 in the internal passage 326*a* to flow through the radial passages 326*c* and 326*d* of the tubular support 326, and to flow axially through the annular region 327 until reaching the rupture discs 322 and 324. The rupture discs 322 and 324 rupture when the pressurization reaches a predetermined pressure value. Thus, the radial passages 320*c* and 320*d* of the tubular support 320 are opened so that the annular region 327 is in fluid communication with the internal passage 338*a* of the expandable tubular member 338.

As a result, the fluidic material 358 flows through the radial passages 320*c* and 320*d*, thereby pressurizing the portion of the internal passage 338*a* that is below the tubular expansion cone 330. Due to this pressurization, the tubular supports 312, 314, 320, 326 and 332, the coupler 318, and the tubular expansion cone 330 are displaced in an upward direction 362, relative to the expandable tubular member 338, the shoe 340, the valve 350 and the plug element 360, thereby radially expanding and plastically deforming the expandable tubular member 338.

It is understood that, during operation of the apparatus 300, after radially expanding and plastically deforming the expandable tubular member 338, the tubular supports 312, 314, 320, 326 and 332, the coupler 318, and the tubular expansion cone 330 may be reinserted into the expandable tubular member 338, and displaced in a downward direction, relative to the expandable tubular member 338, the shoe 340, the valve 350 and the plug element 360, and for any conventional reason, until the distal ends of the lugs 320*f* contact the bottom surfaces of the corresponding lug pockets 342*i*. Due to the downward movement of the tubular support 326 relative to the plug element 360, one or more of the wipers 360*a*, 360*b*, 360*c* and 360*d* of the plug element may bend downwards and sealingly engage the internal surface of the tubular support 326.

It is understood that, after radially expanding and plastically deforming the expandable tubular member 338, the shoe 340 may be drilled out in any conventional manner for any conventional reason such as, for example, continuing with the next drilling operation. It is further understood that, due to the lower component 344 of the shoe 340 having a lower material hardness, the drill-out time for the shoe may be reduced.

In several exemplary embodiments, it is understood that one or more of the operational steps in each embodiment may be omitted.

Figure 14:
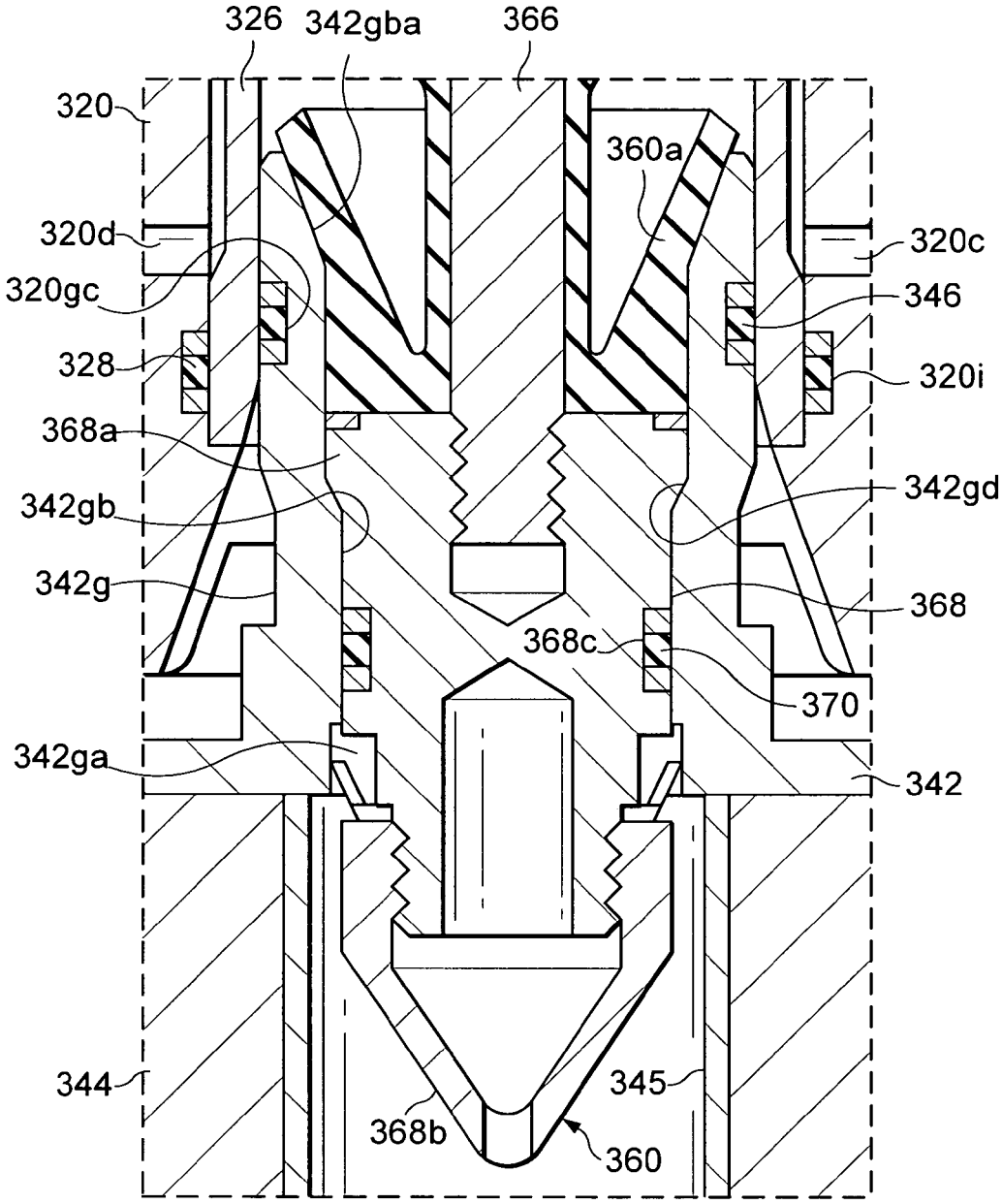
FIG. 14 is an enlarged view of an embodiment of a portion of the apparatus of FIGS. 13, 13*a* and 13*b*.

In an exemplary embodiment, as illustrated in FIG. 14, with continuing reference to FIGS. 11, 11*a*, 11*b*, 12, 12*a*, 12*b*, 13, 13*a* and 13*b*, a core 366 extends through the wipers 360*a*, 360*b*, 360*c* and 360*d* of the plug element 360 and is coupled to an increased-diameter portion 368*a* of a generally cylindrical support 368 having a nose cone 368*b* coupled thereto. In an exemplary embodiment, one or more of the wipers 360*a*, 360*b*, 360*c* and 360*d* may be in the form of a composite seal constructed of elastomeric and/or thermoplastic components. In another exemplary embodiment, one or more of the wipers 360*a*, 360*b*, 360*c* and 360*d* may be in the form of an elastomeric cup-type seal with polyetherether-ketone (PEEK) backup and the cylindrical support 368 may be composed of a metal alloy. A sealing element 370 is spaced from the wiper 360*a* and extends in an annular channel 368*c* formed in the external surface of the cylindrical support 368. In an exemplary embodiment, the sealing element 370 may be in the form of a composite seal constructed of elastomeric and/or thermoplastic components. In another exemplary embodiment, the sealing element 370 may be in the form of an elastomeric D-seal with PEEK backups.

During operation of the apparatus 300, as described above, the plug element 360 may be injected into the apparatus through the passages 312*a*, 314*a*, 318*a*, 326*a* and 342*ga* until the plug element is seated in the plug seat 342*gb* and any flow of fluidic material through the internal passage 342*ga* is blocked. At this point, the wipers 360*b*, 360*c* and 360*c* are compressed and sealingly engage the internal surface of the tubular support 326. The wiper 360*a* is also compressed and sealingly engages the plug seat 342*gb*, including the lead-in angled surface 342*gba* of the plug seat 342*gb*. In an exemplary embodiment, the plug seat 342*gb* may have a coating composed of an erosion-resistant material such as, for example, an elastomer coating, a hard chromium electroplate coating, an electroless nickel coating with dispersed carbide particles, or a high-velocity oxy-fuel (HVOF) coating with tungsten carbide (WC) particles in nickel binder. It is understood that the plug seat 342*gb* may have other coatings. Also at this point, the increased-diameter portion 368*a* of the cylindrical support 368 of the plug element 360 contacts and sealingly engages a shoulder 342*gd* formed in plug seat 342*gb*, and the sealing element 370 sealingly engages the plug seat 342*gb*.

Figure 15:
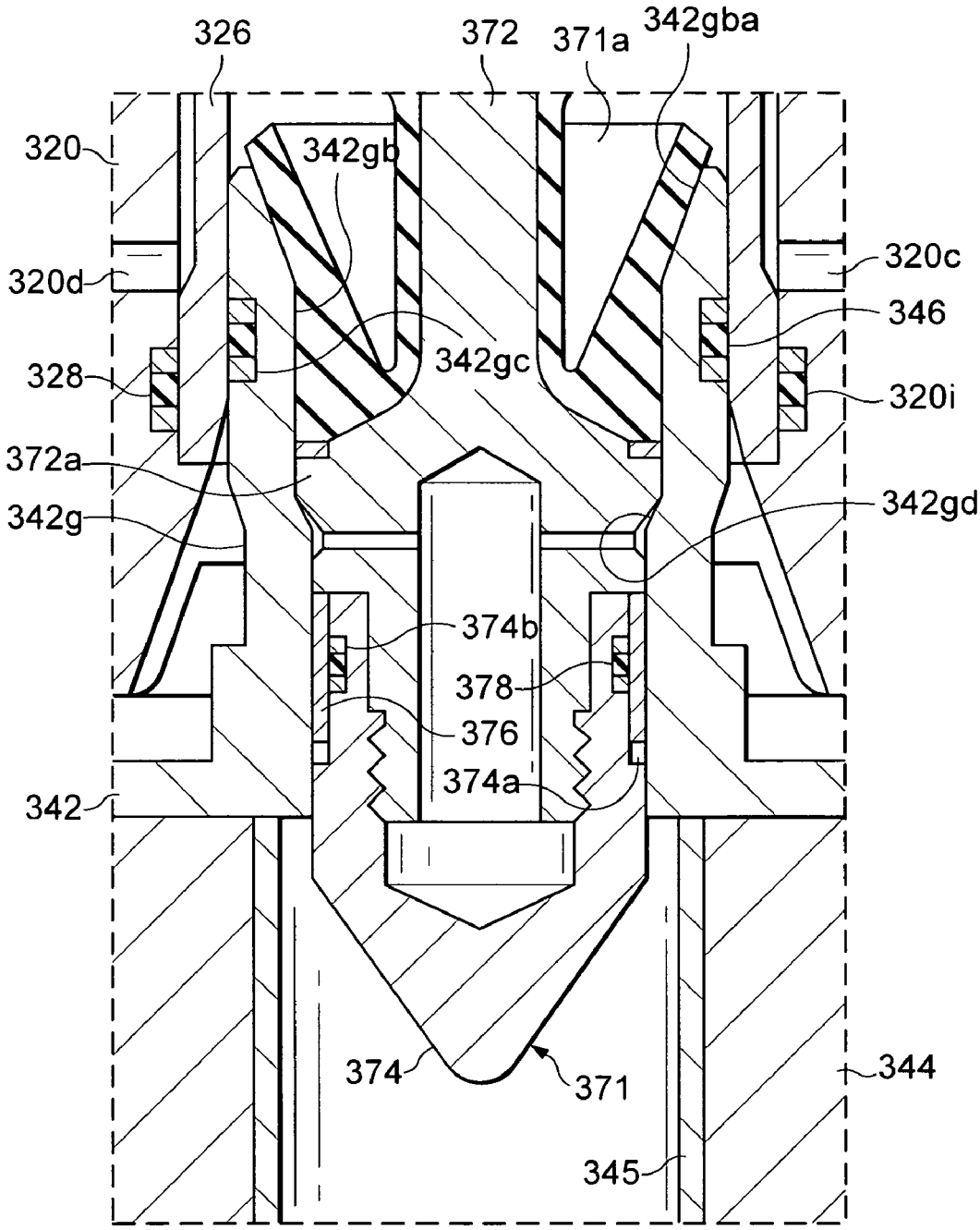
FIG. 15 is an enlarged view of an embodiment of a portion of the apparatus of FIGS. 13, 13*a* and 13*b*.

As illustrated in FIG. 15, with continuing reference to FIGS. 11, 11*a*, 11*b*, 12, 12*a*, 12*b*, 13, 13*a*, 13*b* and 14, another exemplary embodiment of a plug element is generally referred to by the reference numeral 371 and is similar to the plug element 360 of FIGS. 13, 13*a*, 13*b* and 14, and includes wipers 371*a*, 371*b*, 371*c* and 371*d*. The wipers 371*b*, 371*c* and 371*d* are not shown in FIG. 15 and are understood to be substantially similar to the wipers 360*b*, 360*c* and 360*d*, respectively. A core 372 including an increased-diameter portion 372*a* extends through the wipers 371*a*, 371*b*, 371*c* and 371*d* of the plug element 371 and is coupled to a nose 374. In an exemplary embodiment, one or more of the wipers 371*a*, 371*b*, 371*c* and 371*d* may be in the form of a composite seal constructed of elastomeric and/or thermoplastic components. In another exemplary embodiment, one or more of the wipers 371*a*, 371*b*, 371*c* and 371*d* may be in the form of an elastomeric cup-type seal with polyetheretherketone (PEEK) backup and the core 372 may be composed of a metal alloy. A sealing element in the form of a sleeve 376 extends in an annular channel 374*a* formed in the external surface of the nose 374. In an exemplary embodiment, the sleeve 376 may be in the form of a metal friction ring. A sealing element 378 extends in an annular channel 374*b* formed in a surface of the nose 374 defined by the annular channel 374*a*, and the sealing element sealingly engages the internal surface of the sleeve 376.

During operation of the apparatus 300, as described above, the plug element 371 may be injected into the apparatus through the passages 312*a*, 314*a*, 318*a*, 326*a* and 342*ga* until the plug element is seated in the plug seat 342*gb* and any flow of fluidic material through the internal passage 342*ga* is blocked. At this point, the wipers 371*b*, 371*c* and 371*d* are compressed and sealingly engage the internal surface of the tubular support 326. The wiper 371*a* is also compressed and sealingly engages the plug seat 342*gb*, including the lead-in angled surface 342*gba* of the plug seat 342*gb*. In an exemplary embodiment, the plug seat 342*gb* may have a coating composed of an erosion-resistant material such as, for example, an elastomer coating, a hard chromium electroplate coating, an electroless nickel coating with dispersed carbide particles, or a high-velocity oxy-fuel (HVOF) coating with tungsten carbide (WC) particles in nickel binder. It is understood that the plug seat 342*gb* may have other coatings. Also at this point, the increased-diameter portion 372*a* of the core 372 of the plug element 371 contacts and sealingly engages the shoulder 342*gd* formed in the plug seat 342*gb*, and the sleeve 376 sealingly engages the plug seat 342*gb*.

Figure 16:
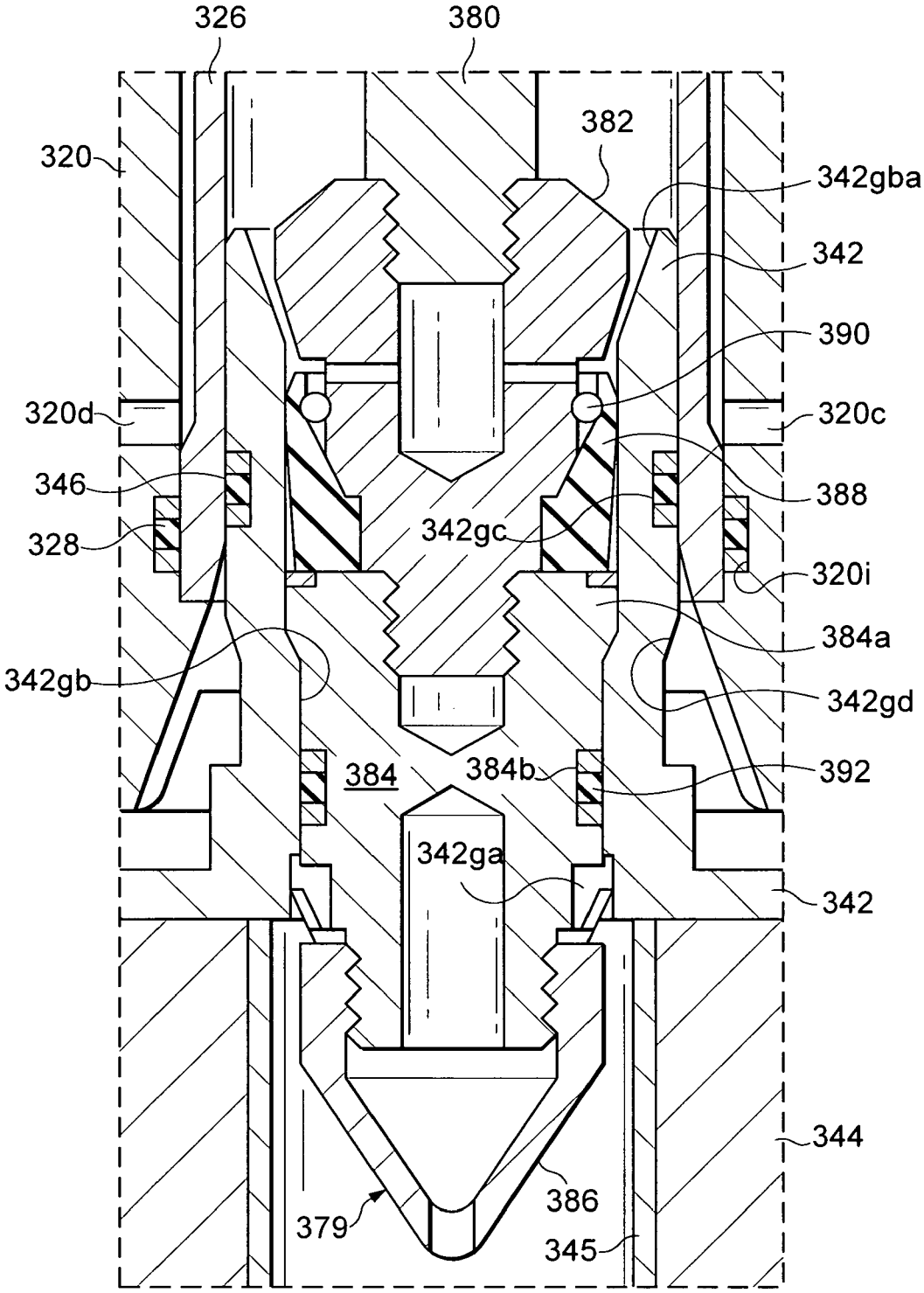
FIG. 16 is an enlarged view of an embodiment of a portion of the apparatus of FIGS. 13, 13*a* and 13*b*.

As illustrated in FIG. 16, with continuing reference to FIGS. 11, 11*a*, 11*b*, 12, 12*a*, 12*b*, 13, 13*a*, 13*b* and 14, another exemplary embodiment of a plug element is generally referred to by the reference numeral 379 and is similar to the plug element 360 of FIGS. 13, 13*a*, 13*b* and 14, and includes wipers 379*a*, 379*b*, 379*c* and 379*d*. The wipers 379*a*, 379*b*, 379*c* and 379*d* are not shown in FIG. 16 and are understood to be substantially similar to the wipers 360*a*, 360*b*, 360*c* and 360*d*, respectively. A core 380 extends through the wipers 379*a*, 379*b*, 379*c* and 379*d* and into a coupler 382 that is coupled to a cylindrical support 384 including an increased-diameter portion 384*a*. In an exemplary embodiment, one or more of the wipers 379*a*, 379*b*, 379*c* and 379*d* may be in the form of a composite seal constructed of elastomeric and/or thermoplastic components. In another exemplary embodiment, one or more of the wipers 379*a*, 379*b*, 379*c* and 379*d* may be in the form of an elastomeric cup-type seal with polyetheretherketone (PEEK) backup.

A nose 386 is coupled to an end of the cylindrical support 384. A seal 388 extends around the coupler 382 and an end of the seal abuts the other end of the cylindrical support 384. A ring 390 extends around the coupler 382, engaging the external surface of the coupler and the internal surface of the seal 388. In an exemplary embodiment, the seal 388 may be in the form of a composite seal constructed of elastomeric and/or thermoplastic components. In another exemplary embodiment, the seal 388 may be in the form of an elastomeric cup-type seal with polyetheretherketone (PEEK) backup. A sealing element 392 extends in an annular channel 384*b* formed in the external surface of the cylindrical support 384. In an exemplary embodiment, the sealing element 392 may be in the form of a composite seal constructed of elastomeric and/or thermoplastic components. In another exemplary embodiment, the sealing element 392 may be in the form of an elastomeric D-seal with PEEK backups.

During operation of the apparatus 300, as described above, the plug element 379 may be injected into the apparatus through the passages 312*a*, 314*a*, 318*a*, 326*a*and 342*ga* until the plug element is seated in the plug seat 342*gb* and any flow of fluidic material through the internal passage is blocked. At this point, the wipers 379*a*, 379*b*, 379*c* and 379*d* are compressed and sealingly engage the internal surface of the tubular support 326. The portion of the seal 388 in the vicinity of the ring 390 is also compressed and sealingly engages the plug seat 342*gb*. In an exemplary embodiment, the plug seat 342*gb* may have a coating composed of an erosion-resistant material such as, for example, an elastomer coating, a hard chromium electroplate coating, an electroless nickel coating with dispersed carbide particles, or a high-velocity oxy-fuel (HVOF) coating with tungsten carbide (WC) particles in nickel binder. It is understood that the plug seat 342*gb* may have other coatings. Also at this point, the increased-diameter portion 384*a* of the core 384 of the plug element 379 contacts and sealingly engages the shoulder 342*gd* formed in the plug seat 342*gb*, and the sealing element 392 sealingly engages the plug seat 342*gb*.

Figure 17A:
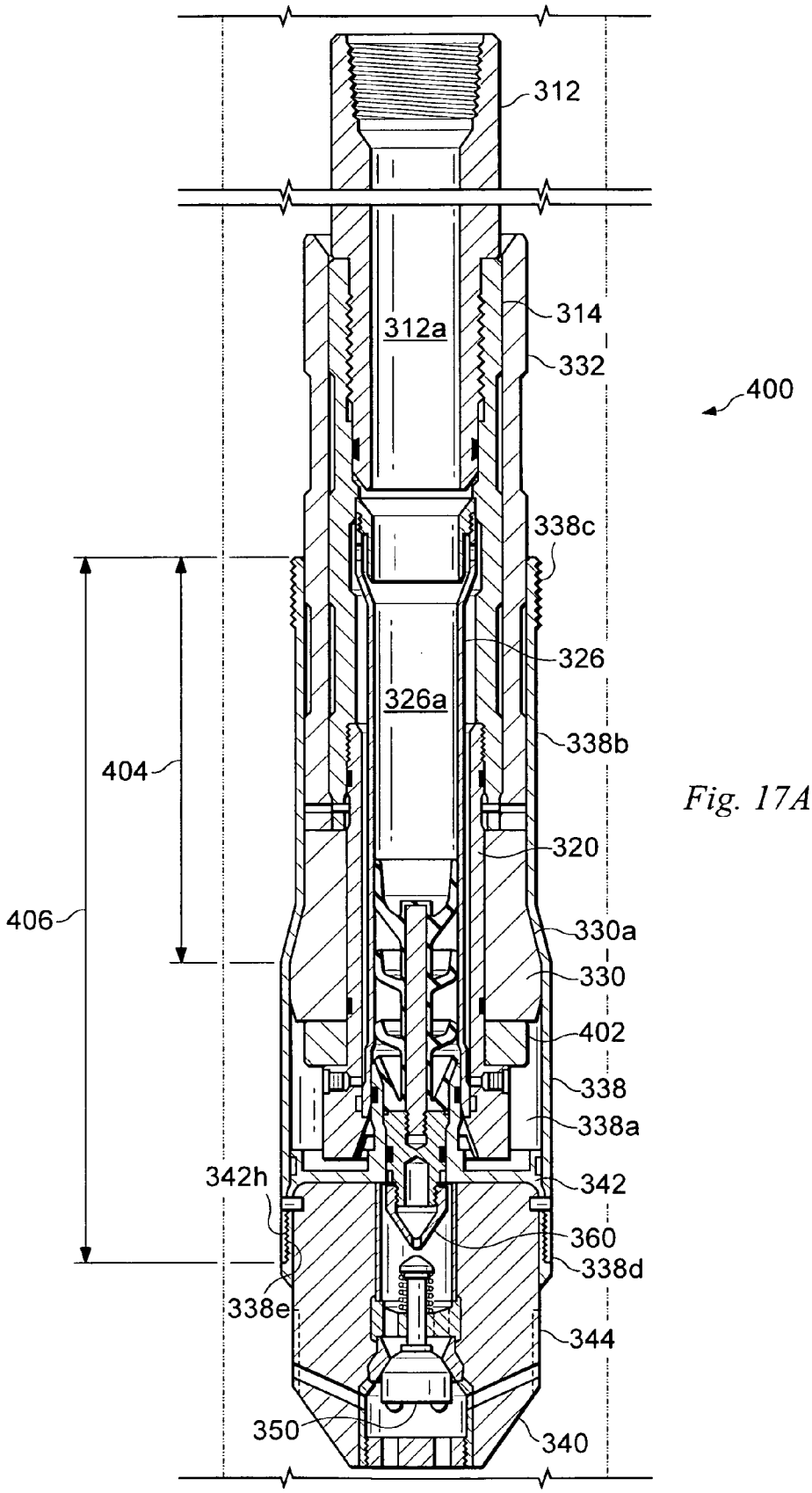
FIG. 17*a* is a cross-sectional illustration of an embodiment of an apparatus for radially expanding and plastically deforming a tubular member during the placement of the apparatus within a wellbore.

Referring to FIG. 17*a*, an exemplary embodiment of an apparatus for radially expanding and plastically deforming a tubular member is generally referred to by the reference numeral 400 and is similar to the apparatus 300 of the embodiment of FIGS. 13, 13*a* and 13*b* and contains several parts of the embodiment which are given the same reference numerals. In the embodiment of FIG. 17*a*, an annular member or spacer 402 extends around the tubular support 320 and is disposed between and abuts the tubular expansion cone 330 and the external flange 320*e*. A dimension 404 is defined between the lower end of the tapered expansion surface 330*a* of the tubular expansion cone 330, having a circumference substantially equal to the inside diameter of the lower portion 338*d* of the expandable tubular member 338, and an end of the expandable tubular member 338 corresponding to an end of the threaded connection 338*c*. A dimension 406 is defined as the length of the expandable tubular member 338.

The operation of the apparatus 400 is similar to that of the apparatus 300 of the embodiment of FIGS. 11,11*a* and 11*b* and therefore will not be described in detail. It is understood that, due to the pressurization of the portion of the internal passage 338*a* that is below the tubular expansion cone 330, the tubular supports 312, 314, 320, 326 and 332, the coupler 318, the tubular expansion cone 330 and the spacer 402 are displaced in the upward direction 362, relative to the expandable tubular member 338, the shoe 340, the valve 350 and the plug element 360, thereby radially expanding and plastically deforming the expandable tubular member 338.

Figure 17B:
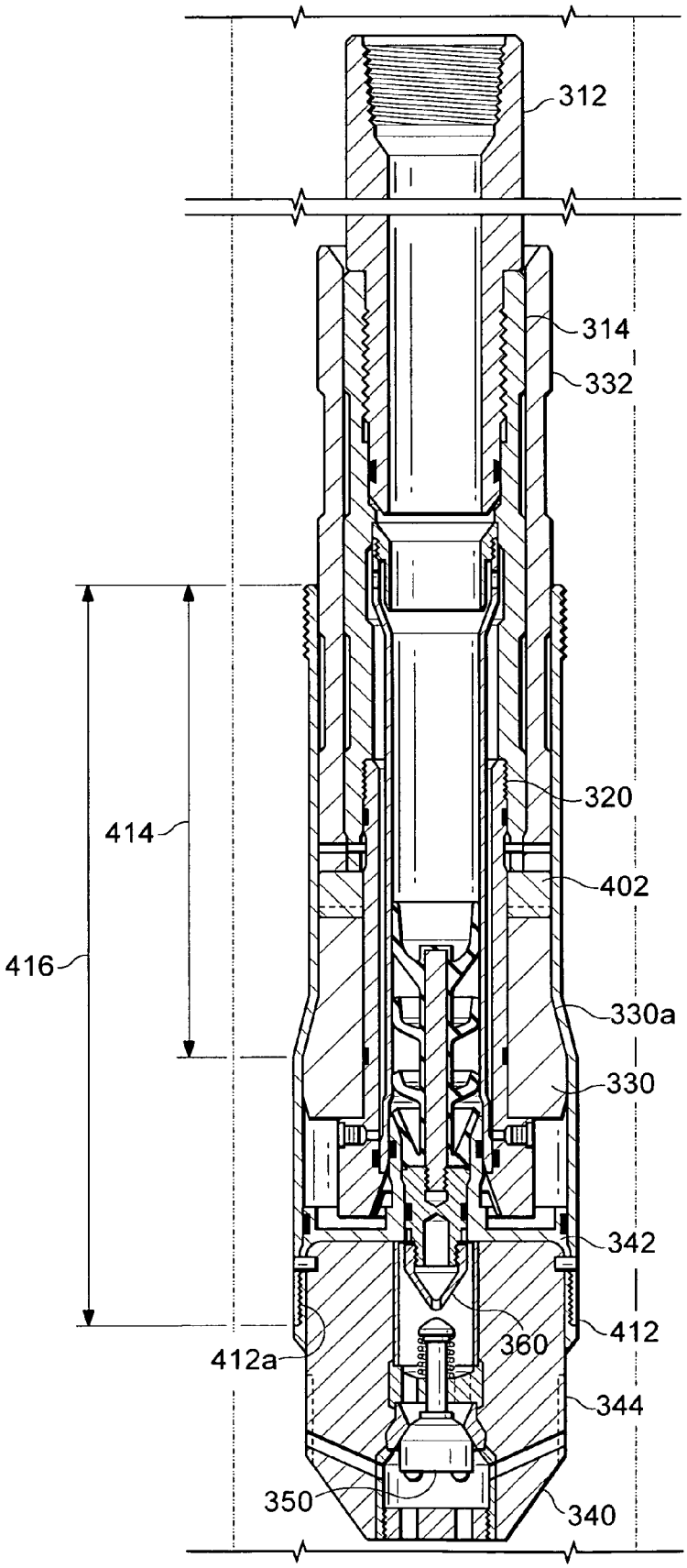
FIG. 17*b* is a cross-sectional illustration of an embodiment of an apparatus for radially expanding and plastically deforming a tubular member during the placement of the apparatus within a wellbore, and that is similar to the apparatus illustrated in FIG. 12*a*.

Referring to FIG. 17*b*, with continuing reference to FIG. 17*a*, an exemplary embodiment of an apparatus for radially expanding and plastically deforming a tubular member is generally referred to by the reference 410 and is similar to the apparatus 400 of the embodiment of FIG. 17*a* and contains several parts of the embodiment which are given the same reference numerals. In the embodiment of FIG. 17*b*, the spacer 402 extends around the tubular support 320 and is disposed between and abuts the tubular support 332 and the tubular expansion cone 330. An expandable tubular member 412 is coupled to the tubular expansion cone 330 and is coupled to the shoe 340 via a threaded connection 412*a*. The expandable tubular member 412 defines a dimension 414 between the lower end of the tapered expansion surface 330*a* of the tubular expansion cone 330 and an end of the expandable tubular member opposing the threaded connection 412*a*, and defines a dimension 416 corresponding to the length of the expandable tubular member.

The expandable tubular member 412 is in the form of a modification of the expandable tubular member 338 of the apparatus 400 of the embodiment of FIG. 17*a*, and is identical to the expandable tubular member 338 of the apparatus 400 of the embodiment of FIG. 17*a* except that the length of the expandable tubular member 412 is reduced because the threaded connection 412*a* is in the form of recut thread. That is, due to the recut thread of the threaded connection 412*a*, the dimension 416 corresponding to the length of the expandable tubular member 412 is less than the dimension 406 corresponding to the length of the expandable tubular member 338. However, due to the positioning of the spacer 402 between the tubular support 332 and the tubular expansion cone 330, the dimension 414 of the apparatus 410 shown in FIG. 17*b* is substantially equal to the dimension 404 of the apparatus 400 shown in FIG. 17*a*. Thus, notwithstanding the shortened length of the expandable tubular member 412 due to the recut thread of the threaded connection 412*a*, the distance between the lower end of the tubular expansion surface 330*a* and the end of the tubular member 412 opposing the threaded connection 412 (the value of the dimension 414) is maintained at a substantially constant value.

The operation of the apparatus 410 is similar to that of the apparatus 400 of the embodiment of FIG. 17*a* and therefore will not be described in detail.

In several of the embodiments, the expandable tubular members 38, 138, 238, 338 and/or 412 are radially expanded and plastically deformed using one or more of the methods and apparatuses disclosed in one or more of the following: (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338,filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No. 6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. Pat. No. 6,564,875, which was filed as application Ser. No. 09/679,907, on Oct. 5, 2000, which claims priority from provisional patent application Ser. No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application serial no. 60/212,359, filed on Jun. 19, 2000, (21) U.S. provisional patent application Ser. No. 60/165,228, filed on Nov. 12, 1999, (22) U.S. provisional patent application Ser. No. 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, which claims priority from provisional application 60/124,042, filed on Mar. 11, 1999, (44) PCT application US 02/25727,filed on Aug. 14, 2002, which claims priority from U.S. provisional patent application Ser. No. 60/317,985, filed on Sep. 6, 2001, and U.S. provisional patent application Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, filed on Dec. 10, 2002, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 2, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Dec. 7, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, filed on Jul. 1, 2002, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. No. 60/405,610, filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. No. 60/423,363, filed on Dec. 10, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. Pat. No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Dec. 5, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2002, (101) U.S. provisional patent application Ser. No. 60/436,106, filed on Dec. 23, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No. 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 3, 2003, (110) U.S. patent application Ser. No. 10/421,682, filed on Apr. 23, 2003, which is a continuation of U.S. patent application Ser. No. 09/523,468, filed on Mar. 10, 2000, which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional patent application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000, which claims priority from provisional application 60/124,042, filed on Mar. 11, 1999, (122) PCT patent application serial no. PCT/US04/06246, filed on Feb. 26, 2004, (123) PCT patent application Ser. No. PCT/US04/08170, filed on Mar. 15, 2004, (124) PCT patent application Ser. No. PCT/US04/08171, filed on Mar. 15, 2004, (125) PCT patent application Ser. No. PCT/US04/08073, filed on Mar. 18, 2004, (126) PCT patent application Ser. No. PCT/US04/07711, filed on Mar. 11, 2004, (127) PCT patent application Ser. No. PCT/US2004/009434, filed on Mar. 26, 2004, (128) PCT patent application Ser. No. PCT/US2004/010317, filed on Apr. 2, 2004, (129) PCT patent application Ser. No. PCT/US2004/010712, filed on Apr. 7, 2004, (130) PCT patent application Ser. No. PCT/US2004/010762, filed on Apr. 6, 2004, (131) PCT patent application Ser. No. PCT/US2004/011973, filed on Apr. 15, 2004, (132) U.S. provisional patent application Ser. No. 60/495,056, filed on Aug. 14, 2003, (133) U.S. Provisional patent application Ser. No. 60/600,679, filed on Aug. 11, 2004, (134) PCT patent application Ser. No. PCT/US2004/028887, filed on Sep. 7, 2004, (134) PCT patent application Ser. No. PCT/US2004/028888, filed on Sep. 7, 2004, (135) PCT patent application Ser. No. PCT/US2004/029025, filed on Sep. 7, 2004, (136) PCT patent application Ser. No. PCT/US2004/028889, filed on Sep. 7, 2004, (138) PCT patent application Ser. No. PCT/US2004/028831, filed on Sep. 7, 2004, (139) U.S. Provisional patent application Ser. No. 60/631,703, filed on Nov. 30, 2004, the disclosures of which are incorporated herein by reference.

An apparatus for radially expanding and plastically deforming an expandable tubular member has been described that includes a first tubular support defining an internal passage and one or more radial passages; a tubular expansion cone coupled to the first tubular support and comprising an external expansion surface wherein the tubular expansion cone and the first tubular support are adapted to extend within the expandable tubular member so that the expandable tubular member is coupled to the external expansion surface of the tubular expansion cone; a second tubular support coupled to the first tubular support and defining an internal passage; a third tubular support coupled to the second tubular support so that the third tubular support at least partially extends within the second tubular support; and a fourth tubular support coupled to the second tubular support so that the second tubular support at least partially extends within the fourth tubular support; wherein the tubular expansion cone and the first, second, third and fourth tubular supports are movable relative to the expandable tubular member when the first tubular support and the tubular expansion cone extend within the expandable tubular member. In an exemplary embodiment, the apparatus comprises a fifth tubular support defining an internal passage and coupled to the first and second tubular supports, the fifth tubular support extending within the first and second tubular supports. In an exemplary embodiment, the coupling between the tubular expansion cone and the first tubular support defines one or more internal passages in fluid communication with respective ones of the one or more radial passages of the first tubular support.

An apparatus for radially expanding and plastically deforming an expandable tubular member has been described that includes a first tubular support defining an internal passage and one or more radial passages; one or more rupture discs coupled to and positioned within corresponding radial passages of the first tubular support; a tubular expansion cone coupled to the first tubular support and comprising an external expansion surface; the expandable tubular member coupled to the external expansion surface of the tubular expansion cone and defining an internal passage; a second tubular support at least partially extending within the first tubular support and defining an internal passage; and an annular region at least partially defined by the internal surface of first tubular support and the external surface of the second tubular support wherein the internal passage of the second tubular support is in fluid communication with the annular region; wherein, when the one or more rupture discs rupture, the internal passage of the second tubular support is in fluid communication with the internal passage of the expandable tubular member via the annular region and the one or more radial passages of the first tubular support. In an exemplary embodiment, fluidic-material flow from the annular region and to the internal passage of the expandable tubular member via the one or more radial passages of the first tubular support causes the tubular expansion cone and the first tubular support to move relative to the expandable tubular member. In an exemplary embodiment, the second tubular support is coupled to the first tubular support so that the second tubular support moves relative to the expandable tubular member during the movement of the tubular expansion cone and the first tubular support.

A system has been described that includes a tubular member defining an internal passage and adapted to extend within a preexisting structure; and means for radially expanding and plastically deforming the tubular member within the preexisting structure, the means comprising a shoe coupled to the tubular member, the shoe comprising an annular portion at least partially extending into the internal passage of the tubular member and defining an internal passage and a plug seat having an internal shoulder; and a plug element adapted to extend into the internal passage of the annular portion, the plug element defining an increased-diameter portion adapted to sealingly engage the internal shoulder of the plug seat, the plug element comprising a first sealing element extending in an annular channel formed in an external surface of the plug element and adapted to sealingly engage the plug seat; and a second sealing element in a spaced relation from the first sealing element and adapted to sealingly engage the plug seat. In an exemplary embodiment, at least a portion of the plug seat is coated with an erosion-resistant coating. In an exemplary embodiment, the coating is selected from the group consisting of elastomer, hard chromium electroplate, electroless nickel, and high-velocity oxy-fuel coatings. In an exemplary embodiment, the first sealing element is in the form of a friction ring. In an exemplary embodiment, the form of the first sealing element is selected from the group consisting of an elastomeric seal and a composite seal. In an exemplary embodiment, the first sealing element is in the form of an elastomeric D-seal with polyetherether-ketone backups. In an exemplary embodiment, the second sealing element is in the form of a wiper. In an exemplary embodiment, the second sealing element is in the form of a cup-type seal. In an exemplary embodiment, the second sealing element is in the form of a composite cup-type seal. In an exemplary embodiment, the second sealing element is in the form of an elastomeric cup-type seal with polyetherether-ketone backup.

A system has been described that includes a tubular member adapted to extend within a preexisting structure; and means for radially expanding and plastically deforming the tubular member within the preexisting structure; wherein the means comprises a shoe coupled to the tubular member, the shoe comprising a first component composed of a first material having a first material hardness, and a second component coupled to the first component and composed of a second material having a second material hardness. In an exemplary embodiment, the second material hardness is less than the first material hardness. In an exemplary embodiment, the second material hardness is less than the first material hardness so that the drill-out time of the shoe is reduced. In an exemplary embodiment, the first material is an aluminum alloy and the second material is a composite material. In an exemplary embodiment, the first material is an aluminum alloy and the second material is a concrete material.

An apparatus for radially expanding and plastically deforming an expandable tubular member has been described that includes a first tubular support defining an internal passage and one or more radial passages having countersunk portions; a tubular expansion cone coupled to the first tubular support and comprising an external expansion surface; the expandable tubular member coupled to the external expansion surface of the tubular expansion cone and defining an internal passage; one or more rupture discs coupled to and positioned within corresponding radial passages of the first tubular support wherein each of the one or more rupture discs is in the form of an annular body member defining an internal passage and comprises a shoulder defined at an end portion of the annular body member and contacting a wall defined by the countersunk portion of the corresponding radial passage; a threaded connection formed in the external surface of the annular body member and extending within the corresponding radial passage to couple the annular body member to the corresponding radial passage; a sealing element extending around the annular body member and sealingly engaging a surface of the corresponding radial passage, the sealing element axially positioned between the shoulder and the threaded connection; and a rupture element disposed in the internal passage of the annular body member wherein, when the rupture element ruptures, the internal passage of the first tubular support is in fluid communication with the internal passage of the expandable tubular member via the corresponding radial passage.

An apparatus for radially expanding and plastically deforming an expandable tubular member has been described that includes a first tubular support defining an internal passage and one or more radial passages; a tubular expansion cone coupled to the first tubular support and comprising an external expansion surface wherein the tubular expansion cone and the first tubular support are adapted to extend within the expandable tubular member and are moveable relative thereto; a second tubular support coupled to the first tubular support and defining an internal passage; a third tubular support coupled to the second tubular support so that the third tubular support at least partially extends within the second tubular support; and a sealing element comprising: an elastomeric element extending in a first annular channel formed in the external surface of the third tubular support wherein the elastomeric element sealingly engages the internal surface of the second tubular support, and a retainer extending in a second annular channel formed in the elastomeric element and biased against one or more walls of the second annular channel to retain the elastomeric element within the first annular channel. In an exemplary embodiment, the cross-section of the elastomeric element is generally trapezoidally shaped.

An apparatus for radially expanding and plastically deforming an expandable tubular member has been described that includes a first tubular support; a tubular expansion cone coupled to the first tubular support and comprising an external expansion surface; the expandable tubular member coupled to the external expansion surface of the tubular expansion cone wherein the expandable tubular member comprises a first portion and a second portion wherein the inside diameter of the first portion is less than the inside diameter of the second portion, and wherein a dimension is defined between an end of the expandable tubular member corresponding to an end of the first portion and an end of the external expansion surface of the tubular expansion cone having a circumference substantially corresponding to the inside diameter of the second portion; a shoe defining one or more internal passages coupled to the second portion of the expandable tubular member; and means for maintaining the value of the dimension substantially constant when the length of the expandable tubular member is reduced. In exemplary embodiment, a second tubular support is coupled to the first tubular support and the maintaining means comprises a spacer extending around the first tubular support, the spacer having a first configuration in which the expandable tubular member has a first length and is coupled to the shoe via a first threaded connection formed in an end portion of the expandable tubular member corresponding to the end of the second portion; and the spacer is disposed between the tubular expansion cone and an external flange defined by the first tubular support; and a second configuration in which the expandable tubular member has a second length and is coupled to the shoe via a second threaded connection formed in the end portion of the expandable tubular member corresponding to the end of the second portion wherein the second length is less than the first length and the second threaded connection is in the form of recut thread; and the spacer is disposed between the tubular expansion cone and the second tubular support.

A method of radially expanding and plastically deforming an expandable tubular member within a preexisting structure has been described that includes coupling a tubular expansion cone to a first tubular support; coupling a second tubular support to the first tubular support; coupling a third tubular support to the second tubular support so that the third tubular support at least partially extends within the second tubular support; and coupling a fourth tubular support to the second tubular support so that the second tubular support at least partially extends within the fourth tubular support; wherein the tubular expansion cone and the first, second, third and fourth tubular supports are movable relative to the expandable tubular member. In an exemplary embodiment, the method comprises at least partially extending the first tubular support and the tubular expansion cone within the expandable tubular member so that an external expansion surface of the tubular expansion cone is coupled to the expandable tubular member. In an exemplary embodiment, the method comprises displacing the tubular expansion cone and the first, second, third and fourth tubular supports relative to the expandable tubular member. In an exemplary embodiment, the method comprises coupling a fifth tubular support defining an internal passage to the first and second tubular supports so that the fifth tubular support extends within the first and second tubular supports, and so that an annular region is at least partially defined by the external surface of the fifth tubular support and the internal surfaces of the first and second tubular supports, wherein the internal passage of the fifth tubular support is in fluid communication with the annular region. In an exemplary embodiment, the step of displacing comprises injecting a fluidic material into the internal passage of the fifth tubular support to pressurize the internal passage of the fifth tubular support so that the fluidic material flows from the internal. passage of the fifth tubular support and to the annular region. In an exemplary embodiment, the method comprises coupling a shoe to an end of the expandable tubular member; and coupling a fifth tubular support defining an internal passage to the shoe so that the fifth tubular support at least partially extends within the first tubular support, and so that an annular region is at least partially defined by the external surface of the fifth tubular support and the internal surface of the first tubular support, wherein the internal passage of the fifth tubular support is in fluid communication with the annular region. In an exemplary embodiment, the step of displacing comprises injecting a fluidic material into the internal passage of the fifth tubular support to pressurize the internal passage of the fifth tubular support so that the fluidic material flows from the internal passage of the fifth tubular support and to the annular region.

A method of radially expanding and plastically deforming an expandable tubular member within a preexisting structure has been described that includes coupling one or more rupture discs to and positioning the one or more rupture discs within corresponding one or more radial passages defined by a first tubular support; coupling a tubular expansion cone to the first tubular support so that an external expansion surface of the tubular expansion cone is coupled to the expandable tubular member wherein the expandable tubular member defines an internal passage; extending a second tubular support defining an internal passage within the first tubular support so that an annular region is defined by the external surface of the second tubular support and the internal surface of the first tubular support wherein the annular region is in fluid communication with the internal passage of the second tubular support; and displacing the tubular expansion cone and the first tubular support relative to the expandable tubular member wherein the step of displacing comprises permitting fluidic-material flow from the internal passage of the second tubular support and to the internal passage of the expandable tubular member. In exemplary embodiment, the step of displacing comprises pressurizing the internal passage of the second tubular support to a predetermined pressure value so that the one or more rupture discs rupture; wherein the fluidic material flows from the internal passage of the second tubular support and to the internal passage of the expandable tubular member via the annular region and the one or more radial passages. In an exemplary embodiment, wherein the step of pressurizing comprises inserting a plug element into an annular portion of a shoe coupled to an end of the expandable tubular member so that the plug element sealingly engages a plug seat defined by the annular portion; and injecting the fluidic material into the internal passage of the second tubular support. In an exemplary embodiment, the method comprises coupling the second tubular support to the first tubular support wherein the first and second tubular supports are movable relative to the expandable tubular member. In an exemplary embodiment, the method comprises coupling the second tubular support to the annular portion of the shoe wherein, during the step of displacing, the tubular expansion cone moves relative to the second tubular support.

A method has been described that includes inserting an expandable tubular member into a preexisting structure; and radially expanding and plastically deforming the expandable tubular member within the preexisting structure wherein the step of radially expanding and plastically deforming comprises coupling a shoe defining at least one internal passage and a plug seat to the expandable tubular member; and sealingly engaging a plug element with the plug seat so that fluidic-material flow through the at least one internal passage of the shoe is blocked, the step of sealingly engaging the plug element with the plug seat comprising sealingly engaging an increased-diameter portion of the plug element with an internal shoulder defined by the plug seat; sealingly engaging a first sealing element extending in an annular channel formed in an external surface of the plug element with the plug seat; and sealingly engaging a second sealing element in a spaced relation from the first sealing element with the plug seat. In an exemplary embodiment, the method comprises coating the plug seat with an erosion-resistant coating. In an exemplary embodiment, the form of the first sealing element is selected from the group consisting of a friction ring, an elastomeric seal and a composite seal. In an exemplary embodiment, the form of the second sealing element is selected from the group consisting of a wiper and a cup-type seal.

It is understood that variations may be made in the foregoing without departing from the scope of the invention. For example, the teachings of the present invention may be used to provide a wellbore casing, a pipeline or a structural support. Further, the elements and teachings of the various illustrative embodiments may be combined in whole or in part in some or all of the illustrative embodiments. Still further, in several exemplary embodiments, it is understood that one or more of the operational steps in each embodiment may be omitted.

Although illustrative embodiments of the invention have been shown and described, a wide range of modification, changes and substitution is contemplated in the foregoing disclosure. In some instances, some features of the present invention may be employed without a corresponding use of the other features. Accordingly, all such modifications, changes and substitutions are intended to be included within the scope of this invention as defined in the following claims, and it is appropriate that the claims be construed broadly and in a manner consistent with the scope of the invention. In the claims, means-plus-function clauses are intended to cover the structures described herein as performing the recited function and not only structural equivalents, but also equivalent structures.

What is claimed is:

1. An apparatus for radially expanding and plastically deforming an expandable tubular member, the apparatus comprising:

a first tubular support defining an internal passage and one or more radial passages;

a tubular expansion cone coupled to the first tubular support and comprising an external expansion surface wherein the tubular expansion cone and the first tubular support are adapted to extend within the expandable tubular member so that the expandable tubular member is coupled to the external expansion surface of the tubular expansion cone;

a second tubular support coupled to the first tubular support and defining an internal passage;

a third tubular support coupled to the second tubular support so that the third tubular support at least partially extends within the second tubular support; and a fourth tubular support coupled to the second tubular support so that the second tubular support at least partially extends within the fourth tubular support;

wherein the tubular expansion cone and the first, second, third and fourth tubular supports are movable relative to the expandable tubular member when the first tubular support and the tubular expansion cone extend within the expandable tubular member.

2. The apparatus of claim 1 further comprising a fifth tubular support defining an internal passage and coupled to the first and second tubular supports, the fifth tubular support extending within the first and second tubular supports.

3. The apparatus of claim 2 wherein an annular region is at least partially defined by the external surface of the fifth tubular support and the internal surfaces of the first and second tubular supports; and wherein the internal passage of the fifth tubular support is in fluid communication with the annular region.

4. The apparatus of claim 3 wherein the fifth tubular support defines one or more radial passages via which the internal passage of the fifth tubular support is in fluid communication with the annular region.

5. The apparatus of claim 1 wherein the coupling between the tubular expansion cone and the first tubular support defines one or more internal passages in fluid communication with respective ones of the one or more radial passages of the first tubular support.

6. The apparatus of claim 1 further comprising the expandable tubular member defining an internal passage wherein the first tubular support and the tubular expansion cone extend within the expandable tubular member and the expandable tubular member is coupled to the external expansion surface of the tubular expansion cone, the expandable tubular member comprising a first portion and a second portion wherein the inside diameter of the first portion is less than the inside diameter of the second portion.

7. The apparatus of claim 6 further comprising a shoe defining one or more internal passages coupled to the second portion of the expandable tubular member.

8. The apparatus of claim 7 further comprising one or more drive-in shear pins extending through the expandable tubular member and into the shoe to lock the expandable tubular member to the shoe.

9. The apparatus of claim 7 wherein the shoe comprises a first component composed of a first material having a first material hardness, and a second component coupled to the first component and composed of a second material having a second material hardness.

10. The apparatus of claim 9 wherein the second material hardness is less than the first material hardness.

11. The apparatus of claim 7 further comprising one or more rupture discs coupled to and positioned within respective ones of the one or more radial passages of the first tubular support.

12. The apparatus of claim 11 further comprising a fifth tubular support coupled to the shoe and at least partially extending within the first tubular support and defining an internal passage; and an annular region at least partially defined by the internal surface of the first tubular support and the external surface of the fifth tubular support wherein the internal passage of the fifth tubular support is in fluid communication with the annular region;

wherein, when the one or more rupture discs rupture, the internal passage of the fifth tubular support is in fluid communication with the internal passage of the expandable tubular member via the annular region and the one or more radial passages.

13. The apparatus of claim 11 wherein each of the one or more radial passages comprises a countersunk portion; and wherein each of the one or more rupture discs is in the form of an annular body member defining an internal passage and comprises:

a shoulder defined at an end portion of the annular body member and contacting a wall defined by the countersunk portion of the corresponding radial passage;

a threaded connection formed in the external surface of the annular body member and extending within the corresponding radial passage to couple the annular body member to the corresponding radial passage;

a sealing element extending around the annular body member and sealingly engaging a surface of the corresponding radial passage, the sealing element axially positioned between the shoulder and the threaded connection; and a rupture element disposed in the internal passage of the annular body member wherein, when the rupture element ruptures, the internal passage of the first tubular support is in fluid communication with the internal passage of the expandable tubular member via the corresponding radial passage.

14. The apparatus of claim 7 wherein the shoe comprises an annular portion extending into the internal passage of the expandable tubular member and defining an internal passage and a plug seat having an internal shoulder; and further comprising a plug element adapted to extend into the internal passage of the annular portion, the plug element defining an increased-diameter portion adapted to sealingly engage the internal shoulder of the plug seat, the plug element comprising:

a first sealing element extending in an annular channel formed in an external surface of the plug element and adapted to sealingly engage the plug seat, and a second sealing element in a spaced relation from the first sealing element and adapted to sealingly engage the plug seat.

15. The apparatus of claim 7 wherein a dimension is defined between an end of the expandable tubular member corresponding to an end of the first portion and an end of the external expansion surface of the tubular expansion cone having a circumference substantially corresponding to the inside diameter of the second portion; and further comprising means for maintaining the value of the dimension substantially constant when the length of the expandable tubular member is reduced.

16. The apparatus of claim 1 further comprising a sealing element comprising:

an elastomeric element extending in a first annular channel formed in the external surface of the third tubular support wherein the elastomeric element sealingly engages the internal surface of the second tubular support; and a retainer extending in a second annular channel formed in the elastomeric element and biased against one or more walls of the second annular channel to retain the elastomeric element within the first annular channel.

17. An apparatus for radially expanding and plastically deforming an expandable tubular member, the apparatus comprising:

a first tubular support defining an internal passage and one or more radial passages;

one or more rupture discs coupled to and positioned within corresponding radial passages of the first tubular support;

a tubular expansion cone coupled to the first tubular support and comprising an external expansion surface;

the expandable tubular member coupled to the external expansion surface of the tubular expansion cone and defining an internal passage;

a second tubular support at least partially extending within the first tubular support and defining an internal passage; and an annular region at least partially defined by the internal surface of first tubular support and the external surface of the second tubular support wherein the internal passage of the second tubular support is in fluid communication with the annular region;

wherein, when the one or more rupture discs rupture, the internal passage of the second tubular support is in fluid communication with the internal passage of the expandable tubular member via the annular region and the one or more radial passages of the first tubular support.

18. The apparatus of claim 17 wherein fluidic-material flow from the annular region and to the internal passage of the expandable tubular member via the one or more radial passages of the first tubular support causes the tubular expansion cone and the first tubular support to move relative to the expandable tubular member.

19. The apparatus of claim 18 wherein the second tubular support is coupled to the first tubular support so that the second tubular support moves relative to the expandable tubular member during the movement of the tubular expansion cone and the first tubular support.

20. The apparatus of claim 19 wherein the second tubular support defines one or more radial passages via which the internal passage of the second tubular support is in fluid communication with the annular region.

21. The apparatus of claim 17 wherein the expandable tubular member comprises a first portion and a second portion wherein the inside diameter of the first portion is less than the inside diameter of the second portion; and further comprising a shoe defining one or more internal passages coupled to the second portion of the expandable tubular member.

22. The apparatus of claim 21 wherein the second tubular support is coupled to the shoe and defines an increased-diameter portion.

23. The apparatus of claim 22 further comprising:

a third tubular support defining an internal passage coupled to the first tubular support and into which the second tubular support at least partially extends;

a fourth tubular support coupled to the third tubular support and defining a reduced-diameter portion that at least partially extends into the increased-diameter portion of the second tubular support; and a second annular region is defined by the external surface of the reduced-diameter portion of the fourth tubular support and the internal surface of the increased-diameter portion of the second tubular support;

wherein the internal passage of the second tubular support is in fluid communication with the first-mentioned annular region via the second annular region.

24. The apparatus of claim 18 further comprising:

a third tubular support defining an internal passage coupled to the first tubular support;

a fourth tubular support coupled to the third tubular support so that the fourth tubular support at least partially extends within the third tubular support; and a fifth tubular support coupled to the third tubular support so that the third tubular support at least partially extends within the fifth tubular support;

wherein, when the first tubular support moves relative to the expandable tubular member, the third, fourth and fifth tubular supports correspondingly move relative to the expandable tubular member.

25. The apparatus of claim 21 wherein the shoe comprises an annular portion extending into the internal passage of the expandable tubular member and defining an internal passage and a plug seat having an internal shoulder; and wherein the apparatus further comprises a plug element adapted to extend into the internal passage of the annular portion, the plug element defining an increased-diameter portion adapted to sealingly engage the internal shoulder of the plug seat, the plug element comprising:

a first sealing element extending in an annular channel formed in an external surface of the plug element and adapted to sealingly engage the plug seat, and a second sealing element in a spaced relation from the first sealing element and adapted to sealingly engage the plug seat.

26. The apparatus of claim 21 wherein the shoe comprises a first component composed of a first material having a first material hardness, and a second component coupled to the first component and composed of a second material having a second material hardness.

27. The apparatus of claim 26 wherein the second material hardness is less than the first material hardness.

28. The apparatus of claim 26 wherein the first material is an aluminum alloy and the second material is selected from the group consisting of a composite material and a concrete material.

29. The apparatus of claim 21 wherein a dimension is defined between an end of the expandable tubular member corresponding to an end of the first portion and an end of the external expansion surface of the tubular expansion cone having a circumference substantially corresponding to the inside diameter of the second portion; and further comprising means for maintaining the value of the dimension substantially constant when the length of the expandable tubular member is reduced.

30. The apparatus of claim 21 further comprising one or more drive-in shear pins extending through the expandable tubular member and into the shoe to lock the expandable tubular member to the shoe.

31. The apparatus of claim 17 wherein each of the one or more radial passages of the first tubular support comprises a countersunk portion; and wherein each of the one or more rupture discs is in the form of an annular body member defining an internal passage and comprises:

a shoulder defined at an end portion of the annular body member and contacting a wall defined by the countersunk portion of the corresponding radial passage of the first tubular support;

a threaded connection formed in the external surface of the annular body member and extending within the corresponding radial passage of the first tubular support to couple the annular body member to the corresponding radial passage of the first tubular support;

a sealing element extending around the annular body member and sealingly engaging a surface of the corresponding radial passage of the first tubular support, the sealing element axially positioned between the shoulder and the threaded connection; and a rupture element disposed in the internal passage of the annular body member.

32. The apparatus of claim 17 further comprising further comprising:

a third tubular support coupled to the first tubular support and defining an internal passage;

a fourth tubular support coupled to the third tubular support so that the fourth tubular support at least partially extends within the third tubular support; and a sealing element comprising:

an elastomeric element extending in a first annular channel formed in the external surface of the fourth tubular support wherein the elastomeric element sealingly engages the internal surface of the third tubular support; and a retainer extending in a second annular channel formed in the elastomeric element and biased against one or more walls of the second annular channel to retain the elastomeric element within the first annular channel.

33. A system comprising:

a tubular member defining an internal passage and adapted to extend within a preexisting structure; and means for radially expanding and plastically deforming the tubular member within the preexisting structure, the means comprising:

a shoe coupled to the tubular member, the shoe comprising an annular portion at least partially extending into the internal passage of the tubular member and defining an internal passage and a plug seat having an internal shoulder; and a plug element adapted to extend into the internal passage of the annular portion, the plug element defining an increased-diameter portion adapted to sealingly engage the internal shoulder of the plug seat, the plug element comprising:

a first sealing element extending in an annular channel formed in an external surface of the plug element and adapted to sealingly engage the plug seat; and a second sealing element in a spaced relation from the first sealing element and adapted to sealingly engage the plug seat.

34. The system of claim 33 wherein at least a portion of the plug seat is coated with an erosion-resistant coating.

35. The system of claim 34 wherein the coating is selected from the group consisting of elastomer, hard chromium electroplate, electroless nickel, and high-velocity oxy-fuel coatings.

36. The system of claim 33 wherein the first sealing element is in the form of a friction ring.

37. The system of claim 33 wherein the form of the first sealing element is selected from the group consisting of an elastomeric seal and a composite seal.

38. The system of claim 33 wherein the first sealing element is in the form of an elastomeric D-seal with polyetherether-ketone backups.

39. The system of claim 33 wherein the second sealing element is in the form of a wiper.

40. The system of claim 33 wherein the second sealing element is in the form of a cup-type seal.

41. The system of claim 40 wherein the second sealing element is in the form of a composite cup-type seal.

42. The system of claim 40 wherein the second sealing element is in the form of an elastomeric cup-type seal with polyetherether-ketone backup.

43. The system of claim 33 wherein the plug seat comprises a lead-in angled surface for reducing the turbulence of fluidic-material flow through the internal passage of the annular portion of the shoe.

44. The system of claim 43 wherein the angle of the lead-in angled surface is about 15 degrees.

45. The system of claim 33 wherein the shoe further comprises:

a first component composed of a first material having a first material hardness and from which the annular portion extends; and a second component coupled to the first component and composed of a second material having a second material hardness.

46. The system of claim 45 wherein the second material hardness is less than the first material hardness.

47. The system of claim 45 wherein the means further comprises one or more drive-in shear pins extending through the tubular member and the first component of the shoe and into the second component of the shoe to lock the tubular member to the shoe.

48. The system of claim 33 wherein the means further comprises:

a first tubular support defining an internal passage and one or more radial passages, the first tubular support extending within the internal passage of the tubular member;

one or more rupture discs coupled to and positioned within corresponding radial passages of the first tubular support;

a tubular expansion cone coupled to the first tubular support and comprising an external expansion surface wherein the tubular member is coupled to the external expansion surface of the tubular expansion cone;

a second tubular support at least partially extending within the first tubular support and defining an internal passage in fluid communication with the annular portion of the shoe; and an annular region at least partially defined by the internal surface of first tubular support and the external surface of the second tubular support wherein the internal passage of the second tubular support is in fluid communication with the annular region;

wherein, when the one or more rupture discs rupture, the internal passage of the second tubular support is in fluid communication with the internal passage of the tubular member via the annular region and the one or more radial passages.

49. The system of claim 48 wherein the means further comprises:

a third tubular support coupled to the first tubular support and defining an internal passage;

a fourth tubular support coupled to the third tubular support so that the fourth tubular support at least partially extends within the third tubular support; and a fifth tubular support coupled to the third tubular support so that the third tubular support at least partially extends within the fifth tubular support;

wherein the tubular expansion cone and the first, third, fourth and fifth tubular supports are movable relative to the tubular member.

50. A system comprising:

a tubular member adapted to extend within a preexisting structure; and means for radially expanding and plastically deforming the tubular member within the preexisting structure;

wherein the means comprises a shoe coupled to the tubular member, the shoe comprising:

a first component composed of a first material having a first material hardness, and a second component coupled to the first component and composed of a second material having a second material hardness.

51. The system of claim 50 wherein the second material hardness is less than the first material hardness.

52. The system of claim 51 wherein the second material hardness is less than the first material hardness so that the drill-out time of the shoe is reduced.

53. The system of claim 50 wherein the first material is an aluminum alloy and the second material is a composite material.

54. The system of claim 50 wherein the first material is an aluminum alloy and the second material is a concrete material.

55. The system of claim 50 wherein the shoe further comprises an annular portion at least partially extending into the tubular member and defining an internal passage and a plug seat having an internal shoulder; and a plug element adapted to extend into the internal passage of the annular portion, the plug element defining an increased-diameter portion adapted to sealingly engage the internal shoulder of the plug seat, the plug element comprising:

a first sealing element extending in an annular channel formed in an external surface of the plug element and adapted to sealingly engage the plug seat; and a second sealing element in a spaced relation from the first sealing element and adapted to sealingly engage the plug seat.

56. The system of claim 50 wherein the means further comprises one or more drive-in shear pins extending through the tubular member and the first component of the shoe and into the second component of the shoe to lock the tubular member to the shoe.

57. An apparatus for radially expanding and plastically deforming an expandable tubular member, the apparatus comprising:

a first tubular support defining an internal passage and one or more radial passages having countersunk portions;

a tubular expansion cone coupled to the first tubular support and comprising an external expansion surface;

the expandable tubular member coupled to the external expansion surface of the tubular expansion cone and defining an internal passage;

one or more rupture discs coupled to and positioned within corresponding radial passages of the first tubular support wherein each of the one or more rupture discs is in the form of an annular body member defining an internal passage and comprises:

a shoulder defined at an end portion of the annular body member and contacting a wall defined by the countersunk portion of the corresponding radial passage;

a threaded connection formed in the external surface of the annular body member and extending within the corresponding radial passage to couple the annular body member to the corresponding radial passage;

a sealing element extending around the annular body member and sealingly engaging a surface of the corresponding radial passage, the sealing element axially positioned between the shoulder and the threaded connection; and a rupture element disposed in the internal passage of the annular body member wherein, when the rupture element ruptures, the internal passage of the first tubular support is in fluid communication with the internal passage of the expandable tubular member via the corresponding radial passage.

58. An apparatus for radially expanding and plastically deforming an expandable tubular member, the apparatus comprising:

a first tubular support defining an internal passage and one or more radial passages;

a tubular expansion cone coupled to the first tubular support and comprising an external expansion surface wherein the tubular expansion cone and the first tubular support are adapted to extend within the expandable tubular member and are moveable relative thereto;

a second tubular support coupled to the first tubular support and defining an internal passage;

a third tubular support coupled to the second tubular support so that the third tubular support at least partially extends within the second tubular support; and a sealing element comprising:

an elastomeric element extending in a first annular channel formed in the external surface of the third tubular support wherein the elastomeric element sealingly engages the internal surface of the second tubular support, and a retainer extending in a second annular channel formed in the elastomeric element and biased against one or more walls of the second annular channel to retain the elastomeric element within the first annular channel.

59. The apparatus of claim 58 wherein the cross-section of the elastomeric element is generally trapezoidally shaped.

60. The apparatus of claim 58 further comprising a fourth tubular support coupled to the second tubular support so that the second tubular support at least partially extends within the fourth tubular support;

wherein, when the tubular expansion cone and the first tubular support moves relative to the expandable tubular member, the second, third and fourth tubular supports correspondingly move relative to the expandable tubular member.

61. An apparatus for radially expanding and plastically deforming an expandable tubular member, the apparatus comprising:

a first tubular support;

a tubular expansion cone coupled to the first tubular support and comprising an external expansion surface;

the expandable tubular member coupled to the external expansion surface of the tubular expansion cone wherein the expandable tubular member comprises a first portion and a second portion wherein the inside diameter of the first portion is less than the inside diameter of the second portion, and wherein a dimension is defined between an end of the expandable tubular member corresponding to an end of the first portion and an end of the external expansion surface of the tubular expansion cone having a circumference substantially corresponding to the inside diameter of the second portion;

a shoe defining one or more internal passages coupled to the second portion of the expandable tubular member; and means for maintaining the value of the dimension substantially constant when the length of the expandable tubular member is reduced.

62. The apparatus of claim 61 further comprising a second tubular support coupled to the first tubular support;

wherein the maintaining means comprises a spacer extending around the first tubular support, the spacer having:

a first configuration in which:

the expandable tubular member has a first length and is coupled to the shoe via a first threaded connection formed in an end portion of the expandable tubular member corresponding to the end of the second portion; and the spacer is disposed between the tubular expansion cone and an external flange defined by the first tubular support; and a second configuration in which:

the expandable tubular member has a second length and is coupled to the shoe via a second threaded connection formed in the end portion of the expandable tubular member corresponding to the end of the second portion wherein the second length is less than the first length and the second threaded connection is in the form of recut thread; and the spacer is disposed between the tubular expansion cone and the second tubular support.

63. A method of radially expanding and plastically deforming an expandable tubular member within a preexisting structure, the method comprising:

coupling a tubular expansion cone to a first tubular support;

coupling a second tubular support to the first tubular support;

coupling a third tubular support to the second tubular support so that the third tubular support at least partially extends within the second tubular support; and coupling a fourth tubular support to the second tubular support so that the second tubular support at least partially extends within the fourth tubular support;

wherein the tubular expansion cone and the first, second, third and fourth tubular supports are movable relative to the expandable tubular member.

64. The method of claim 63 further comprising at least partially extending the first tubular support and the tubular expansion cone within the expandable tubular member so that an external expansion surface of the tubular expansion cone is coupled to the expandable tubular member.

65. The method of claim 64 further comprising displacing the tubular expansion cone and the first, second, third and fourth tubular supports relative to the expandable tubular member.

66. The method of claim 65 further comprising coupling a fifth tubular support defining an internal passage to the first and second tubular supports so that the fifth tubular support extends within the first and second tubular supports, and so that an annular region is at least partially defined by the external surface of the fifth tubular support and the internal surfaces of the first and second tubular supports, wherein the internal passage of the fifth tubular support is in fluid communication with the annular region.

67. The method of claim 66 wherein the step of displacing comprises injecting a fluidic material into the internal passage of the fifth tubular support to pressurize the internal passage of the fifth tubular support so that the fluidic material flows from the internal passage of the fifth tubular support and to the annular region.

68. The method of claim 65 further comprising coupling a shoe to an end of the expandable tubular member;

and coupling a fifth tubular support defining an internal passage to the shoe so that the fifth tubular support at least partially extends within the first tubular support, and so that an annular region is at least partially defined by the external surface of the fifth tubular support and the internal surface of the first tubular support, wherein the internal passage of the fifth tubular support is in fluid communication with the annular region.

69. The method of claim 68 wherein the step of displacing comprises injecting a fluidic material into the internal passage of the fifth tubular support to pressurize the internal passage of the fifth tubular support so that the fluidic material flows from the internal passage of the fifth tubular support and to the annular region.

70. A method of radially expanding and plastically deforming an expandable tubular member within a preexisting structure, the method comprising:

coupling one or more rupture discs to and positioning the one or more rupture discs within corresponding one or more radial passages defined by a first tubular support;

coupling a tubular expansion cone to the first tubular support so that an external expansion surface of the tubular expansion cone is coupled to the expandable tubular member wherein the expandable tubular member defines an internal passage;

extending a second tubular support defining an internal passage within the first tubular support so that an annular region is defined by the external surface of the second tubular support and the internal surface of the first tubular support wherein the annular region is in fluid communication with the internal passage of the second tubular support;

and displacing the tubular expansion cone and the first tubular support relative to the expandable tubular member wherein the step of displacing comprises permitting fluidic-material flow from the internal passage of the second tubular support and to the internal passage of the expandable tubular member.

71. The method of claim 70 wherein the step of displacing further comprises pressurizing the internal passage of the second tubular support to a predetermined pressure value so that the one or more rupture discs rupture;

wherein the fluidic material flows from the internal passage of the second tubular support and to the internal passage of the expandable tubular member via the annular region and the one or more radial passages.

72. The method of claim 71 wherein the step of pressurizing comprises:

inserting a plug element into an annular portion of a shoe coupled to an end of the expandable tubular member so that the plug element sealingly engages a plug seat defined by the annular portion; and injecting the fluidic material into the internal passage of the second tubular support.

73. The method of claim 72 further comprising coupling the second tubular support to the first tubular support wherein the first and second tubular supports are movable relative to the expandable tubular member.

74. The method of claim 72 further comprising coupling the second tubular support to the annular portion of the shoe wherein, during the step of displacing, the tubular expansion cone moves relative to the second tubular support.

75. The method of claim 72 wherein, when the plug element sealingly engages the plug seat, an increased-diameter portion defined by the plug element sealingly engages an internal shoulder defined by the plug seat, a first sealing element extending in an annular channel formed in an external surface of the plug element sealingly engages the plug seat, and a second sealing element in a spaced relation from the first sealing element sealingly engages the plug seat.

76. The method of claim 70 further comprising:

coupling a third tubular support to the first tubular support so that the second tubular support at least partially extends into the third tubular support;

coupling a fourth tubular support to the third tubular support so that the fourth tubular support at least partially extends within the third tubular support; and coupling a fifth tubular support to the third tubular support so that the third tubular support at least partially extends within the fifth tubular support;

wherein the third, fourth and fifth tubular supports are movable relative to the expandable tubular member.

77. A method comprising:

inserting an expandable tubular member into a preexisting structure; and radially expanding and plastically deforming the expandable tubular member within the preexisting structure wherein the step of radially expanding and plastically deforming comprises:

coupling a shoe defining at least one internal passage and a plug seat to the expandable tubular member; and sealingly engaging a plug element with the plug seat so that fluidic-material flow through the at least one internal passage of the shoe is blocked, the step of sealingly engaging the plug element with the plug seat comprising:

sealingly engaging an increased-diameter portion of the plug element with an internal shoulder defined by the plug seat;

sealingly engaging a first sealing element extending in an annular channel formed in an external surface of the plug element with the plug seat; and sealingly engaging a second sealing element in a spaced relation from the first sealing element with the plug seat.

78. The method of claim 77 further comprising coating the plug seat with an erosion-resistant coating.

79. The method of claim 77 wherein the form of the first sealing element is selected from the group consisting of a friction ring, an elastomeric seal and a composite seal.

80. The method of claim 77 wherein the form of the second sealing element is selected from the group consisting of a wiper and a cup-type seal.

* * * * *